United States Patent [19]

Ellis et al.

[11] 4,356,684

[45] Nov. 2, 1982

[54] BATCH METHOD AND APPARATUS FOR HEATING ENVELOPE EDGES TO SEPARATE THE ENVELOPE PANELS

[75] Inventors: James B. Ellis, Palatine; Raymond E. Sims, Elk Grove Village, both of Ill.

[73] Assignee: AES Technology Systems, Inc., Elk Grove Village, Ill.

[21] Appl. No.: 135,356

[22] Filed: Mar. 31, 1980

[51] Int. Cl.[3] ..... B65B 43/38

[52] U.S. Cl. ..... 53/492; 53/381 R; 83/912

[58] Field of Search ..... 53/381 R, 492, 388; 219/245, 255, 388, 68, 105; 83/912; 414/412; 51/76 R, 80 A, 400; 432/230, 231

[56] References Cited

U.S. PATENT DOCUMENTS

| | | | |
|---|---|---|---|
| 2,992,629 | 7/1961 | Belopavlovich, Jr. . | |
| 3,116,718 | 1/1964 | Krupotich et al. . | |
| 3,132,629 | 5/1964 | Krupotich et al. . | |
| 3,590,548 | 7/1971 | Pierce et al. | 53/381 R X |
| 3,677,460 | 7/1972 | Whitman | 53/381 R X |
| 3,815,325 | 6/1974 | Berger | 53/381 R |
| 3,816,213 | 6/1974 | Whitman . | |
| 3,822,523 | 7/1974 | Russell et al. | 53/381 R X |
| 3,871,573 | 3/1975 | Whitman | 53/381 R X |
| 3,875,722 | 4/1975 | Russell et al. | 53/381 R X |
| 3,888,069 | 6/1975 | Pierce et al. | 83/912 X |
| 3,902,429 | 9/1975 | Berger . | |
| 4,069,011 | 1/1978 | Gunther, Jr. | 432/231 X |
| 4,082,603 | 4/1978 | McPherson et al. | 53/381 R X |
| 4,106,432 | 8/1978 | Gunther . | |
| 4,123,890 | 11/1978 | Russell et al. | 53/381 R X |
| 4,189,341 | 2/1980 | McPherson et al. | 53/381 R X |

*Primary Examiner*—Horace M. Culver

*Attorney, Agent, or Firm*—Dressler, Goldsmith, Shore, Sutker & Milnamow, Ltd.

[57] ABSTRACT

A method and apparatus are disclosed for opening envelopes by applying an envelope material degrading chemical to the edges of the envelopes. The edges are contacted with a planar heating member and the envelopes are bent inwardly so that the edges are laterally displaced out of the planes defined by the major portions of the associated envelopes to promote more effective contact of the envelope edges with the heated member.

18 Claims, 32 Drawing Figures

END EDGE HEATING STATION

END EDGE BRUSHING STATION

INVERTED TOP EDGE JOGGING STATION

INVERTED TOP EDGE HEATING STATION

INVERTED TOP EDGE BRUSHING STATION 126
13
13.
28
219
221
218
216'
217
220
222
224
200
216
215
214
265
212
225
229
213
266
261
226
228
227
187
201
264
263
262
260
184
186
188
185
202
198
203
199
208
209
180
206

280
249
278
277'
275
272
279
270'
276
277
282
283
286
284
274
273
206
208
271
209
250
202
270
269
220
216
203
268
267
266
221
222
218
201
265
264
221
218
216
215
216
250
211
198
205
220
222
199
204
207
210a 15
15
AIR 17.
550
562
560
708
706
634
640
626
630
694
608
602
690
692
672
696
698
702
610
556
754
564
566
704
752
750
756
552
712
710
711

550
600
560
562
626
640
630
612
602
664
666
650
660
604
652
584
576
596
572
578
590
592
588
594
610
608
564
566
552
554
708
586
556
580
582
570
599
28
570'
18.
200
704
712
711
714
716
718
710
728
727
726
722
720
740
732
724
730
734

25.
200
1112
1142
1164
907
880
1120
1128
28
842
888
1190
1192
886
1194
1140
1144
25.
1174
1108
1122
1100
1110
1108
1102

BATCH METHOD AND APPARATUS FOR HEATING ENVELOPE EDGES TO SEPARATE THE ENVELOPE PANELS

RELATED U.S. PATENT APPLICATIONS

The present invention is related to the inventions described and illustrated in the concurrently filed U.S. patent application entitled "Method and Apparatus for Opening Envelopes With a Chemical Spray", Ser. No. 135,353 and in the concurrently filed U.S. patent application entitled "Method and Apparatus for Conveying and Opening Envelopes", Ser. NO. 135,326.

TECHNICAL FIELD

The present invention is related to a method and apparatus for opening the edges of a sealed envelope, and in particular, to a method and apparatus for opening a plurality of envelopes simultaneously by means of chemically degrading or deteriorating one or more of the edges of each envelope.

BACKGROUND OF THE INVENTION

Various methods and machines have been disclosed for automatically opening envelopes, either singly or in batches.

Mechanical envelope openers which slit or cut an edge or edges of the envelope are disclosed in the U.S. Pat. Nos. 2,992,629 and 3,116,718.

An apparatus which contacts the edge of an envelope with a heated rod to carbonize the envelope material and cause mechanical failure of the envelope material is disclosed in the U.S. Pat. No. 3,132,629.

More recently, methods and apparatus have been developed for treating the edges of envelopes with chemicals that degrade or deteriorate the envelope material. Examples of such methods and apparatus are disclosed in the U.S. Pat. Nos. 3,677,460, 3,871,573, 3,816,213, 4,069,011, and 4,106,432.

In some of the above-disclosed methods, a first chemical is applied to the envelope edges and activated by the application of an additional developing chemical so as to deteriorate the envelope paper along the edges. Mild mechanical abrasive action may be employed to fully separate the treated edges. Some of these chemical methods are activated or assisted by the application of heat. For example, in the aforerentioned U.S. Pat. Nos. 3,816,213, 3,871,573, and 3,677,460, a process of heating the envelope edges by radiant means is disclosed. Similarly, U.S. Pat. Nos. 3,902,429, and 3,815,325 disclose methods of chemically deteriorating envelope edges wherein heat is applied to the chemically treated edges of the envelopes with forced warm air.

In other methods of opening envelopes by chemical deterioration of the envelope edges, heat is applied by direct contact with a heating member. Such a process is disclosed in the aforementioned U.S. Pat. No. 4,069,011 and also in the U.S. Pat. No. 4,082,603.

When automatically opening large numbers of envelopes arranged in batches by heat-assisted chemical deterioration of the envelope edges, it is desirable to provide a transfer of heat to the envelope edges. In general, it is desirable to raise the envelope edge temperature to a level where the amount and/or rate of chemical deterioration of the envelope material is significantly increased.

In those instances where it is desired to heat the envelope edges with a heating member to promote, assist, or activate the chemical deterioration of the envelope edges, it is desirable to provide good contact between each envelope edge and the heating member.

In processes disclosed in some of the above-discussed patents, a chemical solution is sprayed onto the envelope edges prior to the envelope being brought into contact with the heating member. It would be beneficial, once the sprayed chemical has sufficiently penetrated the envelope material along the envelope edges, to concentrate the chemical on the envelope, as by raising the temperature of the chemical and causing evaporation of some of the liquid, if any, in the chemical solution. If the temperature is raised sufficiently, the chemical deterioration of the paper will be effected at a greatly increased rate. Further, vapors that may be generated between the edges of adjacent envelopes should preferably be dissipated.

It would also be desirable to provide an apparatus for quickly and easily applying a controlled amount of a liquid spray of an envelope degrading chemical or chemicals to the edges of the envelopes in a manner that assures a uniform coverage of the liquid on each envelope edge to be opened.

It would also be advantageous to provide an apparatus for conveying batches of envelopes in a relatively compact path wherein one, two, or three edges of each envelope could be efficiently opened.

In a method for opening envelopes by chemical deterioration of the envelope edges, it would be desirable to ensure that the edges of the envelopes were properly aligned with the spray (and heat source if used) during the opening process to ensure that each of the envelopes in a given batch has substantially uniformly deteriorated edges.

With a chemical envelope opening process, it would also be desirable to provide a vapor filtration and recirculation system to eliminate undesirable gaseous releases to the atmosphere.

In a method for opening the edges of chemically treated envelopes, it would also be advantageous to provide means for mildly abrading the chemically degraded envelope edges to remove any particulate matter and to insure complete mechanical failure of the envelope edges.

SUMMARY OF THE INVENTION

According to the preferred form of the present invention, sealed envelopes are arranged and aligned in face-to-face relationship in a batch. A degrading agent is applied, such as with a liquid chemical spray, to the envelopes along at least one edge of each envelope in the batch. The degrading agent is one that functions more effectively (e.g., rapidly) when heated.

Next, relative movement between the batch of envelopes and a heated surface is effected to contact the edges of the envelopes with the heated surface and to bend the envelopes inwardly of the edges to laterally displace at least some of the edges of the envelopes out of the planes defined by the major portions of the associated envelopes and to promote more effective contact of the envelope edges with the heated surface.

The application of the heat-assisted degrading agent to the envelopes may be effected at any time, e.g., minutes or days, prior to the application of heat to the envelope edges. The application of the heat-assisted degrading agent may be effected in the same apparatus or in an apparatus separate from an apparatus in which the envelope edges are contacted by the heated surface.

Numerous other advantages and features of the present invention will become readily apparent from the following detailed description of the invention and of one embodiment thereof, from the claims, and from the accompanying drawings.

BRIEF DESCRIPTION OF THE DRAWINGS

In the accompanying drawings forming part of the specification, and in which like numerals are employed to designate like parts throughout the same.

FIG. 20 is a fragmentary, cross-sectional view taken generally along the plane 20—20 in FIG. 19;

DESCRIPTION OF THE PREFERRED EMBODIMENT

Figure 1:
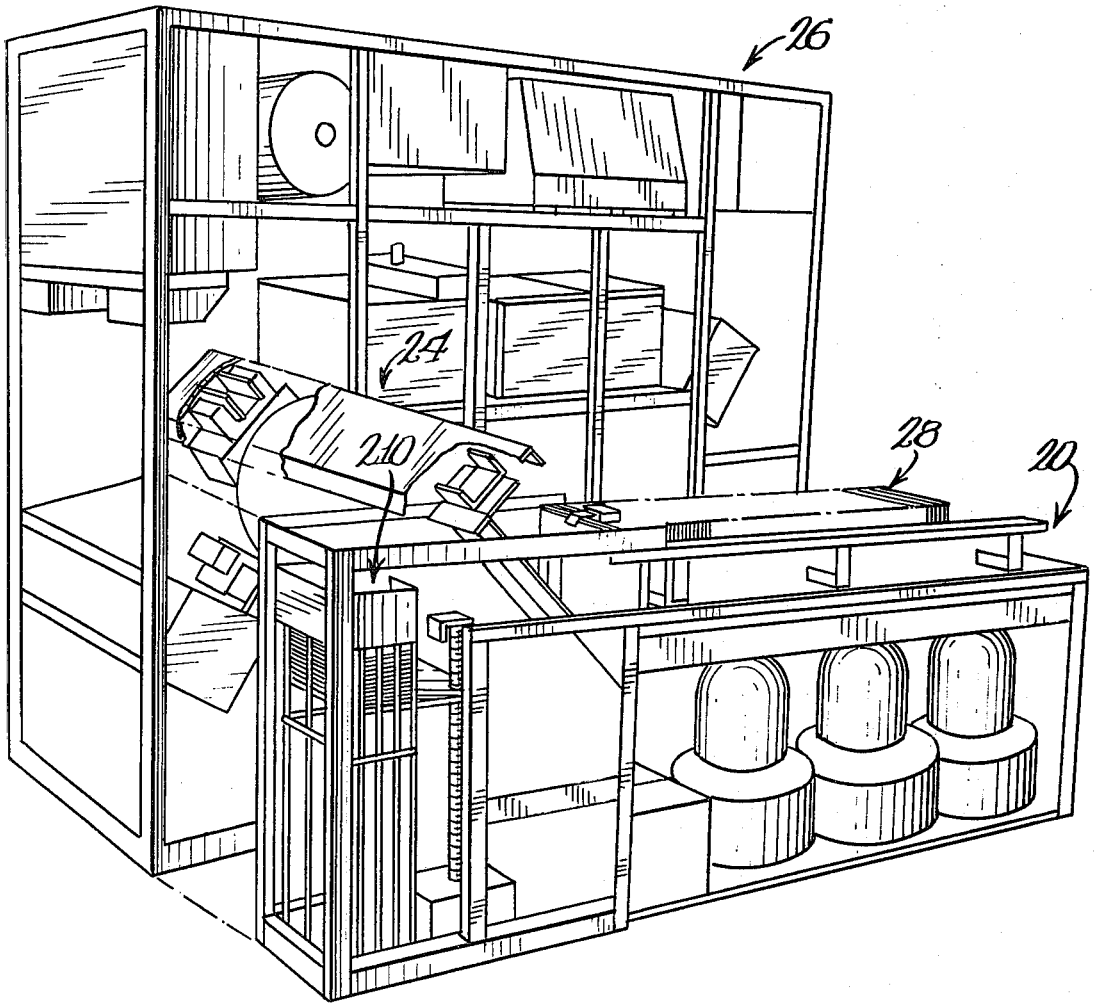
FIG. 1 is a perspective view, with much detail omitted, of the envelope opening apparatus of the present invention shown in conjunction with an envelope feeding device and an envelope transfer device.

While this invention is susceptible of embodiment in many different forms, there is shown in the drawings and will herein be described in detail one specific embodiment, with the understanding that the present disclosure is to be considered as an exemplification of the principles of the invention and is not intended to limit the invention to the embodiment illustrated.

The precise shapes and sizes of the components herein described are not essential to the invention unless otherwise indicated, since the invention is described with reference to an illustrative embodiment thereof.

For ease of description, the apparatus will be described herein in a normal operating position, and terms such as upper, lower, horizontal, etc., will be used with reference to this position. It will be understood, however, that the apparatus of this invention may be manufactured, stored, transported, used and sold in an orientation other than the position described.

The apparatus described herein has certain conventional drive mechanisms and control mechanisms the details of which, though not fully illustrated or described, will be apparent to those having skill in the art and an understanding of the necessary functions of such mechanisms.

The choice of materials used in the construction of the apparatus described herein is dependent upon the particular application involved and other variables, as those skilled in the art will appreciate.

FIG. 1 illustrates an envelope opening apparatus 26 shown operating in conjunction with an envelope batch feeding apparatus 20 and an envelope batch transfer apparatus 24. The envelope feeding apparatus 20 supplies a plurality of envelopes arranged in discrete batches to the transfer apparatus 24 which then transfers the envelopes, one batch at a time, to the infeed station of the envelope opening apparatus 26.

After the envelope opening apparatus 26 has taken a batch of sealed envelopes from the transfer device 24, the envelope opening apparatus 26 presents a batch of opened envelopes to the transfer device 24 which then carries the batch of opened envelopes back to the envelope feeding apparatus 20. The envelope feeding apparatus 20 carries the batch of opened envelopes to an exit station where the batch is deposited in a receiving means 210. The envelope feeding apparatus 20 illustrated in FIG. 1 is fully described and illustrated in the concurrently filed patent application entitled, "Method and Apparatus for Feeding Envelopes," Ser. No. 135,354. The envelope batch transfer apparatus 24 illustrated in FIG. 1 is fully described and illustrated in the concurrently filed patent application entitled "Method and Apparatus for Transferring Envelopes," Ser. No. 135,355.

It is to be realized that the envelope opening apparatus 26 illustrated and described herein will function to receive envelopes in discrete batches from suitable mechanisms, such as the transfer apparatus 24, or from operating personnel manually loading batches of envelopes into the apparatus 26. The method for loading batches of envelopes into the apparatus 26 will be described in more detail hereinafter.

Figure 3:
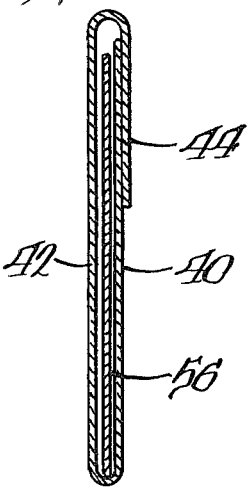
FIG. 3 is a greatly enlarged, cross-sectional view taken generally along the plane 3—3 in FIG. 2.
Figure 2:
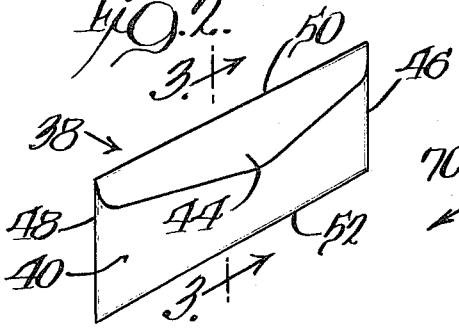
FIG. 2 is a perspective view of a sealed envelope that can be opened according to the method and apparatus disclosed herein.

One form of the preferred method of opening envelopes is illustrated with reference to a sequence shown chronologically in FIGS. 2–10. FIGS. 2 and 3 show an envelope 38 of conventional construction having a front face, panel, or side 40, a rear face, panel or side 42, and a flap 44 which is folded over and sealed to the front side 40. The envelope 38 is generally rectangular in configuration and has a pair of oppositely facing, generally parallel end edges 46 and 48, a top edge 50 and a bottom edge 52 that is oppositely facing from top edge 50 and which is generally parallel to top edge 50. The envelope 38 is typically sealed around a document or other contents 56.

According to one form of the method for opening envelopes, the envelopes are treated with an envelope material degrading agent. The agent may be a solid, gas, or liquid. Typically the agent is a liquid chemical degrading agent that functions to deteriorate or destroy the envelope material.

Conventional envelope material is a cellulosic paper. Chemicals for deteriorating cellulosic paper are well known in the art and are disclosed in the various United States patents discussed above in the section entitled "Background of the Invention." Preferably, however, the liquid chemical agent used in the preferred method disclosed herein is an aqueous solution of a non-noxious organic acid, the action of which can be assisted by the application of heat.

One such organic acid is disclosed in the U.S. Pat. No. 4,194,342 of Savit entitled, "Folded Paper Edge Opening Process." That patent application discloses that the acid solution is preferably applied to the envelope edges while the envelope edges are held together in a stack or batch so that the edges of the plurality of envelopes defines a plane. Further, that application discloses that the organic acid solution is preferably applied to the envelopes in the form of a spray and that the envelope edges are subsequently heated to concentrate the solution and to promote the rate of degradation of the cellulose material at the paper edges.

Figure 4:
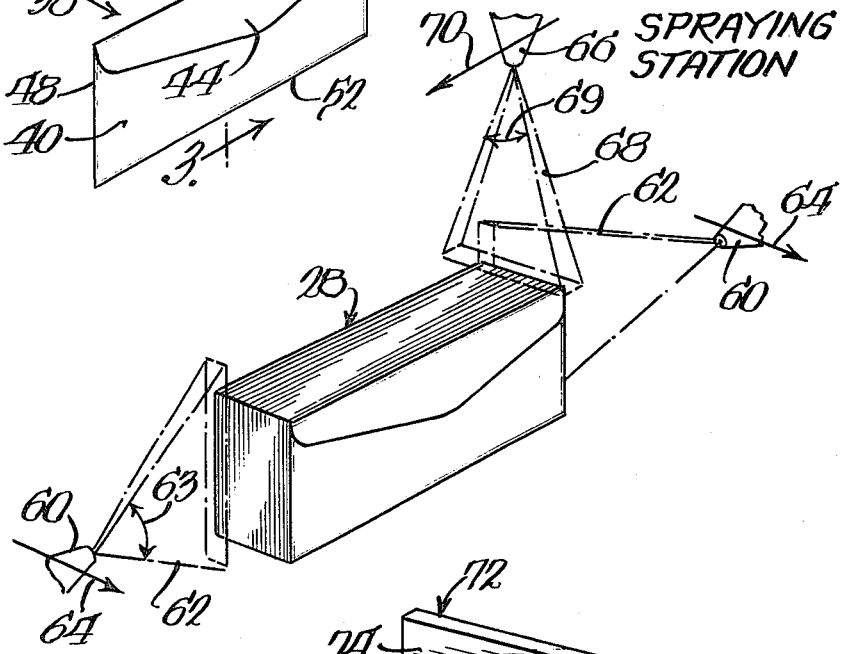
FIG. 4 is a schematic representation of a batch of envelopes to which a liquid envelope material degrading agent is being sprayed along the top edges of the envelopes in the batch and along the end edges of the envelopes in the batch.

According to the preferred form of the method illustrated herein, the envelopes are arranged and aligned in a batch so that at least one edge of each envelope, and preferably, so that all of the corresponding edges of the envelopes are aligned in registry in common planes as illustrated for the batch 28 in FIG. 4. The batch may be maintained in alignment by suitable means, such as a clamp (not illustrated).

FIG. 4 illustrates the step of spraying the envelope batch 28 with the liquid envelope material degrading agent that functions more effectively when heated (by speeding up the rate of reaction of the agent upon the envelope edges). The opposing end edges of the envelopes are sprayed with the liquid agent from nozzles 60. The spraying is effected in a substantially planar fan pattern 62 that is substantially parallel to the planes of the envelopes. The spray nozzles 60 are moved along in a direction indicated by the arrows 64 that is generally normal to the planes of the envelopes. If it is desired to open only one edge of the envelopes in the batch 28, only one spray nozzle need be employed.

The top or bottom edges of the envelopes may also be opened. FIG. 4 illustrates the top edges of the envelopes, which are normal to the end edges of the envelopes, being sprayed with the liquid envelope material degrading agent by means of a nozzle 66. The spraying is effected to form a substantially planar fan pattern 68 which is oriented substantially transversely to the planes of the envelopes. The nozzle is moved substantially parallel to the planes of the envelopes in a direction generally indicated by arrow 70. The nozzle 66 is moved to spray the top edges of the envelopes along the entire length of the envelopes.

Preferably, the solution of the organic acid envelope degrading agent is sprayed from each nozzle at about 73 psi gauge pressure from a so-called "18 thousandths" elongated orifice. The "18 thousandths" designation is known to those skilled in the art as being the equivalent circular diameter for the elongated orifice.

Preferably, each end edge nozzle 60 is positioned about $3\frac{1}{2}$ inches away from the end edges of the envelopes in the batch. Similarly, the top edge spray nozzle 66 is preferably positioned about 5 inches away from the top edges of the envelopes in the batch.

Further, in the preferred form of the method, the vertex angle of the fan-shaped spray pattern, indicated by arrow 63 for nozzle 60 in FIG. 4 is about 70 degrees. Preferably, the vertex angle of the fan-shaped spray pattern from the nozzle 66, as indicated by double headed arrow 69, is about 55 degrees.

Also, the nozzles 60 and 66 are preferably moved along the envelope batch in the direction of the arrows 64 and 70, respectively, at a speed between about 1 and 1,000 inches per second, and preferably at about 10 inches per second.

Of course, rather than moving the spray nozzles 60 and 66, the envelope batch 28 may be moved as necessary relative to stationary nozzles.

Figure 5:
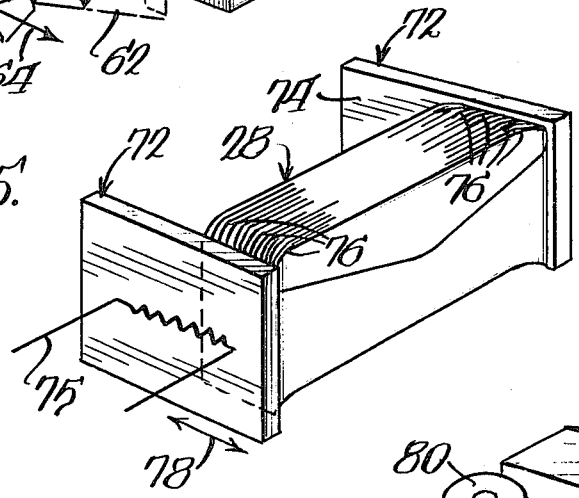
FIG. 5 is a schematic illustration showing a pair of opposed heating platens being moved against the batch of envelopes.

Since the degrading agent applied to the envelopes is of the type that functions more effectively (e.g., rapidly) when heated, end edge heating members 72 are provided, as illustrated in FIG. 5, for heating the envelope edges. Each member 72 has an electrical resistance heating element 75, as schematically illustrated in FIG. 5, for generating heat which is conducted to a planar heating surface 74. The members 72 are arranged to face each other and are moved against the end edges of the envelopes in batch 28 to contact the edges of the envelopes with the heated surfaces 74 and to bend or flex the envelopes inwardly of the edges, as at 76. The members are preferably moved in a direction perpendicular to the plane of the envelope end edges. However, any movement toward and against the end edges of the envelopes will function to provide the desired contact. The flexing action of the envelopes laterally displaces at least some of the edges out of the planes defined by the major portions of the associated envelopes and, it is believed, promotes more effective contact of the envelope edges with the heated surfaces 74.

If just one end edge of each envelope in the batch 28 is to be opened, only one heating member 72 need be provided. In such a case, the heating member 72 may be brought against the batch of envelopes 28 to bend or flex the envelopes inwardly of that one edge. Alternatively, the heating member 72 may remain stationary and the batch of envelopes 28 may be moved against the heating member 72 to effect the bending or flexing of the envelopes.

It is believed that better edge contact is provided by bending the envelopes in the manner illustrated in FIG. 5. Owing to the tolerances in envelope manufacturing, some envelopes are slightly shorter than other envelopes. Further, not every envelope is perfectly planar. That is, there may be a certain amount of curvature in the envelope which may be most pronounced at one or both of its edges. Thus, it is desirable to provide a method whereby the edges of each envelope in the batch can be assured of contact with the heating member. It is believed that the method of bending the envelopes inwardly of their edges as illustrated in FIG. 5 ensures good contact with the envelope edges. The exact mechanism by which such improved contact is not necessarily completely understood and there is no intent herein to be bound by any theory or by any explanation as provided above or hereinafter.

Instead of, or in addition to, bending the envelopes inwardly as illustrated in FIG. 5, relative movement may be effected between the heating member heating surface 74 and the contacting edges of the envelopes in a direction parallel to the plane of the heating surface 74 so as to wipe the edges of the envelopes with the surface 74. In the preferred form of the method, the heating member 72 is aadditionally reciprocated in the opposing directions indicated by the double headed arrow 78 in FIG. 5. The direction of reciprocation is substantially normal to the planes of the envelopes. However, instead of moving the heating member 72, the envelope batch 28 may be reciprocated against a stationary heating member.

If the envelopes are flexed or bent inwardly against the heating member 72 as illustrated in FIG. 5, reciprocation of the heating member 72 will reverse the orientation of the envelope bends 76 and effect at least a transient increase in the spacing between the edges of the adjacent envelopes. It is believed that the reversal of the envelope bends promotes escape of vapor from the edges of the envelopes. It is further believed that the relative reciprocation between the envelope edges and the heating surface 74 provides for increased contact of the envelope edges with the heating surface 74. This is believed to be true even in the case where the envelope edges are not bent or flexed inwardly.

In the preferred form of the method, the heating surface is in contact with the envelope end edges are smooth. However, if desired, the surfaces may be channelled or grooved to provide additional vapor escape capability.

In the preferred form of the method, the heating members 72 are reciprocated against the envelopes with the envelopes bent or flexed inwardly between about 1/32 and 3/16 inch, and preferably about an eighth of an inch on each end and with the reciprocation stroke being about three inches at a frequency of about ¼ Hertz for a total of three cycles.

The thickness of the envelope batch 28 processed in this manner is preferably about 3½ inches when clamped between opposing holding members exerting a suitable compressive force. Preferably, with conventional number 9 size envelopes, the clamping force is generated through opposed clamping members that each have a substantially planar envelope contacting surface generally rectangular in shape and that each extend to within about 1/16 to 2 inches of the envelope end edges and to within about 1/16 to 2 inches of the envelope top edges.

In one form of the method, the envelope edges are preferably raised to a temperature of between 250 degrees F. and 650 degrees F., and preferably to about 400 degrees F. by contact with the heating surface 24. This is less than the combustion temperature of paper material used in conventional envelope construction. The end edges of the envelopes are preferably contacted with the heating surface for a total time of between 5 seconds and 120 seconds, and preferably for about 24 seconds. However, the time period for heating the end edges depends upon the envelope material, the batch size, and the actual end edge temperature that is desired. Further, the time period for heating the envelope end edges is believed to also be dependent upon the force of the heating members 72 against the end edges of the envelopes. The total time period of the contact heating of the envelope edges may be divided up into short intervals that add up to the total desired time.

In the preferred form of the method, the envelope batch 28 is allowed to "soak" for a period of time after being sprayed and before being heated and processed further. This ensures that the degrading agent has been absorbed by the envelope and has fully penetrated through the thickness of the envelope material at the sprayed edges.

Preferably, the soak time interval is between 5 and 30 seconds, and preferably about 12 seconds. If desired, the "soak" interval can be eliminated and the envelopes can be immediately contacted with the heating surfaces 74. On the other hand, the soak time can be considerably extended, if desired, without adversely affecting the end result.

Of course, when attempting to process batches of envelopes rapidly according to this method, high speed operation is generally desirable. Therefore, it is usually advantageous to minimize the amount of time required for the "soaking" of the envelope batch, as well as the time required for the spraying step illustrated in FIG. 4 and the time required for the heating step illustrated in FIG. 5. Of course, other variables can also be adjusted to effect a more rapid processing of the envelopes. These include the quantity of liquid spray, the size of the spray droplets, the size and shape of the spray patterns, the rate of movement of the spray nozzles, the temperature of the heating surfaces, the heater surface contact time, and the speed of reciprocation of the heating surfaces (or of the envelopes).

When optimizing the speed of the entire operation, it is to be realized that some amount of "soak" time is required to allow effective penetration of the envelope edges by the chemical agent before the edges are heated. If the envelope edges are heated before full penetration of the edges by the agent is effected, the agent may react to deteriorate the envelope material only to the depth to which it had penetrated. In such a case the full thickness of the material may not be deteriorated.

It has been found that the above-described soak time of 12 seconds permits full thickness penetration and the subsequent heating time of 24 seconds permits a chemical reaction such that, upon completion of the reaction, the envelope end edges 40 and 42 separate and mechanically fail as desired. Of course, lesser time periods of soaking and heating may also be sufficient. The extent of the resulting deterioration and failure has been found to be sufficient, especially when the end edges of the envelopes are subsequently mildly abraded as will next be explained.

Figure 6:
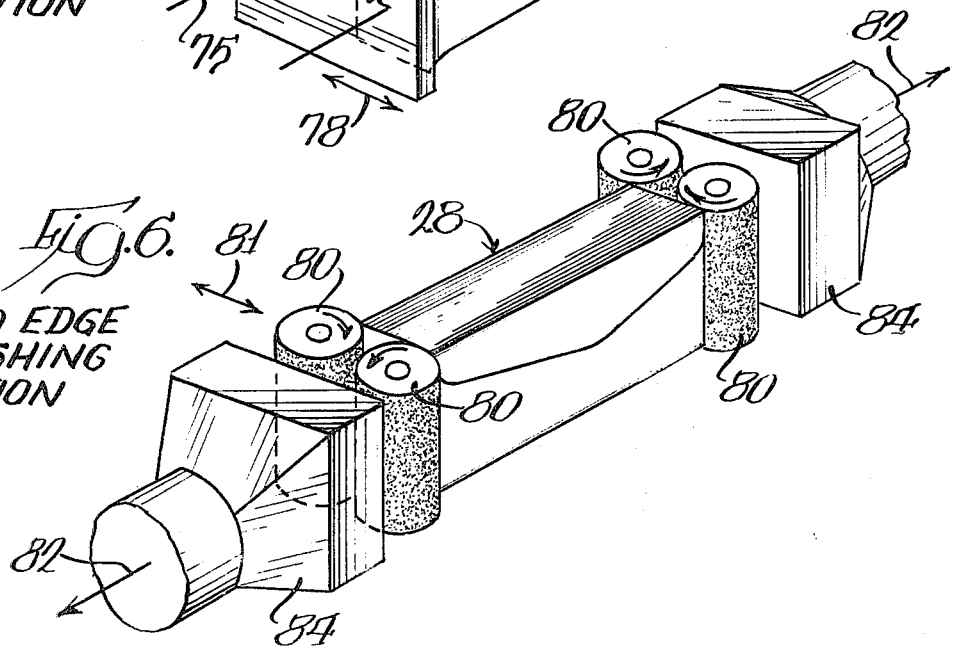
FIG. 6 is a schematic illustration showing the end edges of the envelopes being abraded by rotating brushes.

After the deterioration of the envelope edges has been enhanced or accelerated by the application of heat as illustrated in FIG. 5, the deteriorated edges are preferably mildly abraded as illustrated in FIG. 6. The particulate matter of deteriorating envelope material is brushed away from the envelope end edges by pairs of oppositely rotating brushes 80. Preferably, the particulate matter brushed away from the edges is carried away by means of a vacuum-induced air flow indicated by arrows 82. The vacuum-induced air flow is directed by means of a duct 84 from the brushes 80 through a suitable receiving system.

If desired, the brushes 80 may be reciprocated along the edges of the envelopes in batch 28 in a direction generally perpendicular to the planes of the envelopes as indicated by double headed arrow 81.

Figure 7:
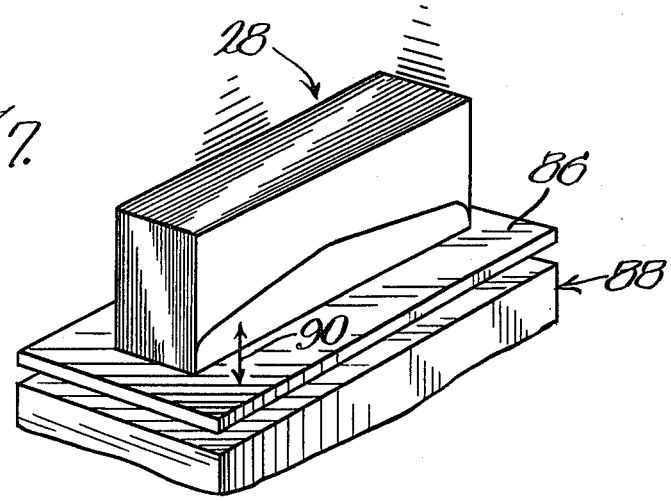
FIG. 7 is a schematic illustration of the batch of envelopes illustrated in FIGS. 4–6 inverted and being vibrated to align the inverted envelope top edges in a common plane.

If the top edges of the envelopes in batch 28 are treated with the envelope material deteriorating agent (as with spray 68 shown in FIG. 4), the top edges can be subsequently heated to assist or enhance the deterioration of the envelope edges. However, if desired, the batch 28 may be inverted so that the top edges of the batch are oriented at the bottom of the batch for contacting a heating member. When the batch is inverted, it may be desirable or necessary to align the inverted top edges of the envelopes as illustrated in FIG. 7.

Specifically, the inverted batch 28 is guided on either side (e.g., by loosened clamps) and permitted to drop under the influence of gravity against a support plate 86 that is part of a conventional document jogging device 88. The plate 86 is vibrated by device 88 with a vertical component of vibrational movement acting in the directions indicated by double headed arrow 90. This causes the envelopes within the batch 28 to be vibrated sufficiently so that the inverted envelope top edges contact the plate 86 and become substantially aligned in a common plane on that plate 86.

Figure 8:
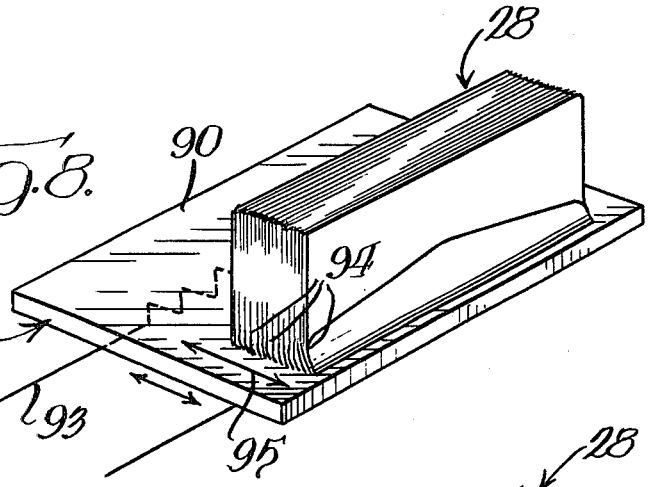
FIG. 8 is a schematic illustration showing a heating platen being moved against the inverted top edges of the envelopes in the batch.

After the inverted envelope batch has been jogged to align the inverted top edges in a common plane, the top edges are contacted by a heating surface 90 of heating member 92 as illustrated in FIG. 8. An electrical resistance heating element is schematically illustrated as element 93 and effects a generation of heat within the member 92 sufficient to heat the member surface 90 in contact with the inverted envelope top edges.

The heating member 90 may be moved against the inverted top edges of the envelopes to cause the envelopes to bend, as at 94, inwardly of the edges. Alternatively, or in addition, the heating member 92 may be reciprocated in a plane parallel to the aligned inverted top edges and in a direction substantially normal to the planes of the envelopes as indicated by the double headed arrow 95 in FIG. 8.

The flexing of the envelopes inwardly of their inverted top edges and/or the reciprocation of the envelope top edge heating member 92 is effected for the same purposes as discussed above with respect to the envelope end edge heating members 72 illustrated in FIG. 5. The time and temperature parameters relating to the heating of the inverted envelope top edges are substantially the same as for the heating of the envelope end edges previously described with reference to FIG. 5.

After the inverted top edges of the envelopes in batch 28 have been heated to enhance the chemical deterioration of the envelope material, the particles of deteriorating envelope material may be brushed away from the edges to remove loose particulate matter and to ensure separation of the sides of each envelope along its inverted top edge. This may be effected, as illustrated in FIG. 9, by bringing the envelope batch 28 into contact with a pair of oppositely rotating brushes 97.

Figure 9:
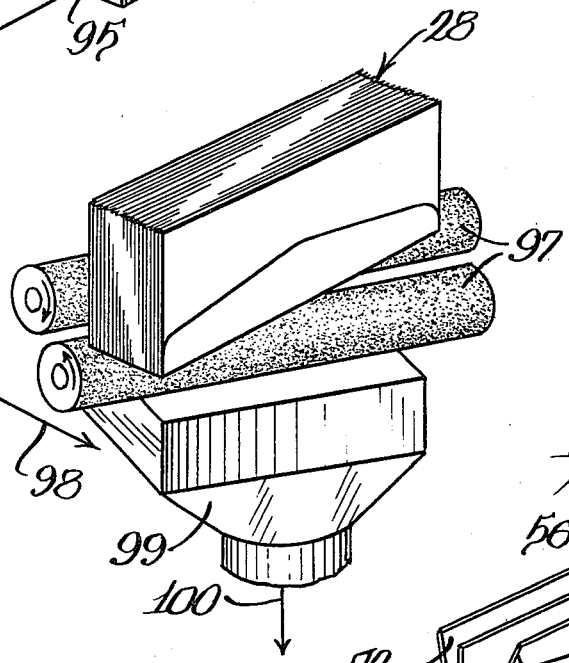
FIG. 9 is a schematic illustration showing the top edges of the envelopes in the inverted batch of envelopes being abraded by rotating brushes.

If desired, the batch of envelopes may be oriented at an angle with respect to the longitudinal axes of the brushes as illustrated in FIG. 9 and either the envelope batch 28 or the brushes 97 may be reciprocated in a plane parallel to the plane of inverted top edges of the envelopes and in a direction generally perpendicular to the planes of the envelopes in the batch 28 as indicated by the double headed arrow 98.

A vacuum duct 99 may be provided adjacent the brushes 97 and connected to a suitable source of vacuum for inducing an air flow, indicated by arrow 100, to remove the particulate matter from the region around the envelopes and from the brushes 97.

Figure 10:
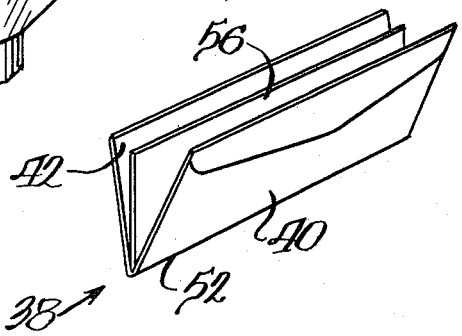
FIG. 10 is a perspective view of an envelope from the processed batch with the opposing end edges and top edge opened to expose the contents of he envelope.

When the steps illustrated in FIGS. 4–9 and described above have been comprised, the material comprising the envelope edges has deteriorated so that each envelope 38 has mechanically failed along the end and top edges as illustrated in FIG. 10 where the opposing sides 40 and 42 of the envelope 38 are shown partially opened about the fulcrum of the still connected bottom edge 52 to expose the contents 56. The opening of the sides 40 and 42 of the envelope to expose the contents 56 may be effected manually or by suitable automatic apparatus operating with conventional vacuum gripping systems, or by other suitable apparatus.

Figure 11:
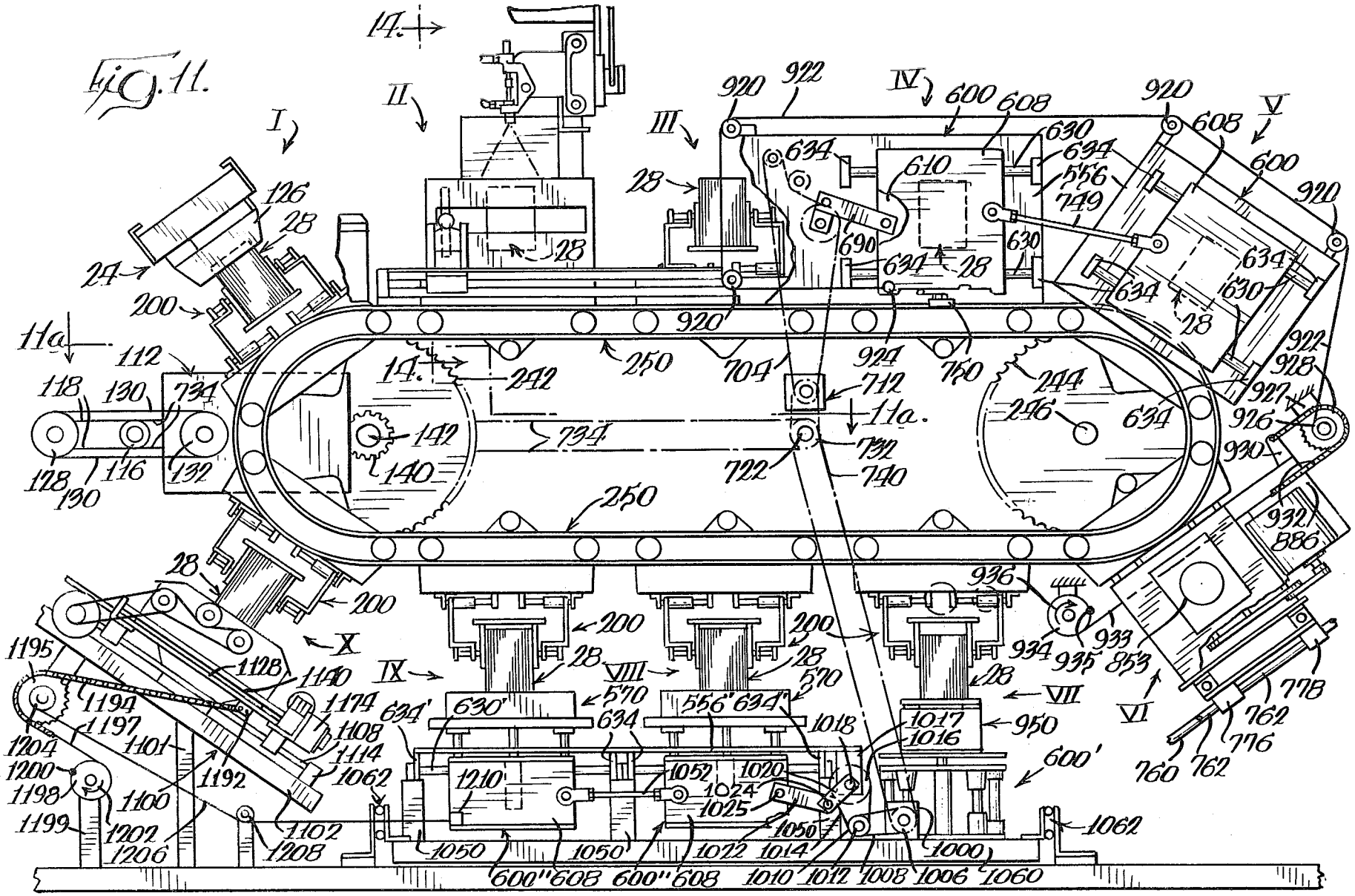
FIG. 11 is a simplified, schematic illustration of the conveying loop and ten operating stations of the envelope opening apparatus.

An apparatus for opening sealed envelopes in accordance with the above-described method is schematically illustrated in FIG. 11 wherein certain structural features, drive mechanisms, and control systems have been omitted for purposes of clarity. The apparatus is adapted to process a plurality of envelopes wherein the envelopes are arranged in discrete batches 28. The envelopes in each batch 28 are arranged in face-to-face relationship.

With envelopes having a rectangular shape, the side and bottom edges and the two end edges of each envelope are in registry with the corresponding edges of the other envelopes in the batch. Thus, the corresponding edges of the envelopes lie in common planes.

The sealed envelopes are loaded into the apparatus at a loading station designated generally by Roman numeral I in the upper left hand corner as viewed in FIG. 11. The loading is preferably effected by means of the transfer device 24 discussed above with reference to FIG. 1.

Although forming no part of the present invention, the transfer device 24 will be briefly described to afford a better understanding of how the envelope opening apparatus may be operated effectively with such an automatic loading device. Specifically, the device 24 is a pair of spaced-apart outwardly projecting paddles, one of which paddles 126 is visible in FIG. 11. The paddles are adapted to extend along a batch of envelopes 28 on either end of the batch while the batch is supported in the device 24 in a channel-shaped guide (not visible in FIG. 11).

Horizontal movement of the paddles (in a direction perpendicular to the plane of the drawing of FIG. 11) will move the batch of envelopes 28 along the channel-shaped guide in device 24 and into position in the envelope opening apparatus 26.

The sealed envelope batch 28 is received in the loading station I in a batch holding car 200. The envelope batch 28 is clamped to prevent movement of the envelopes therein. The structure of the envelope batch holding car 200 will be described in detail hereinafter.

The envelope batch holding car 200 is supported on a track 250 which forms part of an endless conveying loop with the loop oriented in a substantially vertical plane and defining upper and lower horizontal paths.

Ten such cars 200 are equally spaced about the track 250 in the conveying loop and each car 200 carries a plurality of envelopes arranged in a batch 28.

The cars 200 are mounted on the track 250 and moved around the track 250 by means of a novel driving mechanism. The principal features of the driving mechanism for the conveyor are schematically illustrated in FIGS. 11 and 11A and comprise a main drive chain 180, drive motor 110, and a conventional Geneva drive 112.

Figure 11A:
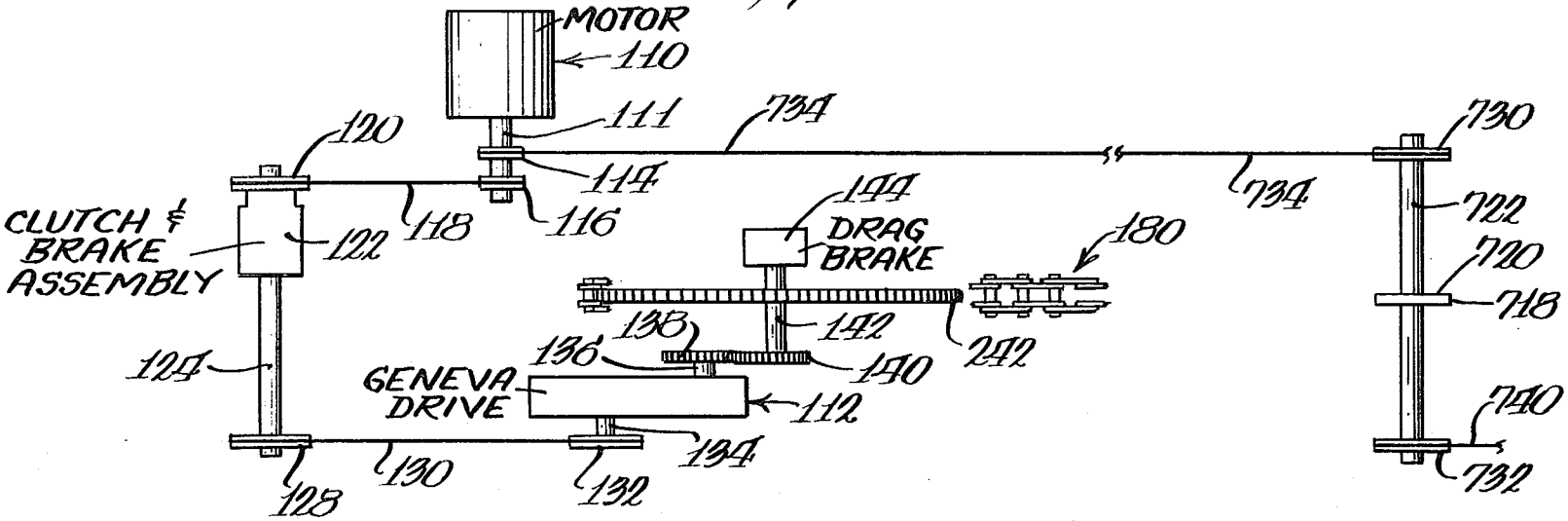
FIG. 11A is a schematic illustration of the drive mechanism of the apparatus which is represented with a view taken generally along the plane 11A—11A in FIG. 11 and in which the components are not drawn to scale.

With reference to FIG. 11A, the motor 110 has a drive shaft 111 to which are mounted sprockets 114 and 116. An endless loop drive chain 734 is trained around the sprocket 114 and another sprocket 730 to effect certain envelope batch edge heating operations discussed in detail hereinafter.

An endless loop drive chain 118 is trained around the motor shaft sprocket 116 and around another sprocket 120. The sprocket 120 is secured to the driving portion of a conventional electrically operated clutch and brake assembly 122. The driven portion of the clutch and brake assembly 122 is secured to a shaft 124 to which is mounted a sprocket 128. An endless loop drive chain 130 is trained around sprocket 128 and around a sprocket 132 on an input shaft 134 of the Geneva drive 112.

The output of the Geneva drive 112 is transmitted through a shaft 136 to a gear 138 mounted thereon. A gear 140 is mounted on a shaft 142 and is engaged with gear 138. Shaft 142 carries a main conveyor drive sprocket 242 for rotation therewith.

The sprocket 242 engages the main conveyor drive chain 180 (partially broken away in FIG. 11A and hidden in FIG. 11 behind track 250). At the other end of the conveying loop, as best illustrated in FIG. 11, the drive chain 180 is trained around an idler sprocket 244 mounted on a shaft 246. A drag brake 144 is mounted on a shaft 142 to apply a resistance to the rotation of the main drive sprocket 242 and of the drive chain 180 when the drag brake 144 is actuated.

The above-described drive system components function to move the ten, equally spaced envelope batch holding cars 200 in an endless loop about the apparatus. To this end, each holding car 200 is connected to the endless loop conveyor drive chain 180 in a manner that will be described in detail hereinafter.

The drive chain 180 is intermittently driven by the Geneva drive through an incremental linear distance equal to one tenth of the total conveyor loop length so as to advance each car 200 to the position previously occupied by the car immediately ahead of it. The cars 200 are intermittently moved in a clockwise direction about the conveyor as viewed in FIG. 11. After each incremental movement of the conveyor, the conveyor movement is terminated for a period of time to permit the various envelope batch treatment steps to be effected at ten stations around the conveyor as will be explained hereinafter.

According to the preferred method for operating the drive system, the motor 110 is continuously operated. The electrical clutch and brake assembly 122 (FIG. 11A) is intermittently actuated by the apparatus control system (such as by an electronic microprocessor) to release the brake and engage the clutch. This permits the motor 110 to drive the input shaft 134 of the Geneva drive. This causes the Geneva drive output shaft 136 to be rotated 90 degrees. Owing to the gear ratios, this incrementally moves the conveyor main drive chain 180 the one tenth loop travel distance.

During a last portion of the rotation of the Geneva drive output shaft 136 through the 90 degree angle of rotation, the drag brake 144 is applied to place a braking load on the rotating shaft 142. This load substantially eliminates the gear backlash tolerances and shaft bearing tolerances in the conveyor drive system to permit accurate registration of the cars 200 along the conveyor path. The drag brake 144 may be actuated from a first cam follower (not illustrated) engaging a first cam on the Geneva drive input shaft 134.

With the drag brake 144 applied, the rotation of the Geneva drive output shaft 136 is terminated by the Geneva drive after being rotated 90 degrees. Since the output shaft 136 is no longer driven by the Geneva drive, the conveyor drive chain 180 is thus also no longer driven. At this point, one or more of the holder cars 200 may be locked against the conveyor track 250 by a separate clamping means (such means may include a clamping pneumatic cylinder 1230 and clamping head 1234 illustrated in FIG. 20 and described in more detail hereinafter). Such a separate car clamping means may be actuated after a predetermined angle of rotation of the Geneva drive input shaft 134 by means of a second cam follower (not illustrated) engaged with a second cam on shaft 134.

The drag brake 144 is released after the car clamping means has been applied. To this end, the first cam follower is adapted to be engaged by the rotation of the first cam on the Geneva drive input shaft 134 at a point after the second cam follower has been engaged to apply the car clamping means.

A third cam follower (not illustrated) may be provided for being engaged by a third cam on the Geneva drive input shaft 134 after one complete rotation of the input shaft 134 and for then actuating the clutch and brake assembly 122 to apply the brake and disengage the clutch so that the Geneva drive input shaft 134 is no longer driven.

The Geneva drive remains inoperative for a predetermined period of time until the apparatus control system, such as the timer portion of the electronic microprocessor, actuates the clutch and brake assembly 122 to again release the brake and engage the clutch to permit the Geneva drive input shaft 134 to again be driven by the motor 110. During the period of time when the Geneva drive 112 is inoperative (and when the clutch and brake assembly 122 is actuated to disengage the clutch and apply the brake) the holder car track clamping means is still actuated to continue clamping one or more of the cars against the track 250. During this period, various operations are performed on the envelope batches in the cars 200 around the conveyor path at the ten stations.

When the clutch and brake assembly 122 is actuated to again release the brake and engage the clutch to begin driving the cars along the conveyor path, the car clamping system is released. To this end, the input shaft 134 of the Geneva drive 112 is rotated through a small initial angle of rotation before the output shaft 136 begins to rotate. During this small initial angle of rotation of the input shaft 134, the second cam follower is engaged by the second cam on the input shaft 134 to release the car clamping mechanisms.

Following this, the output shaft 136 of the Geneva drive begins rotating to start the conveyor movement cycle over again. This conveyor operating cycle is continuously repeated during operation of the envelope opening apparatus. Thus, after ten cycles of incremental conveyor movement, each holding car 200 has made one complete revolution of the conveyor and is back at its initial position.

After the envelope batch 28 is loaded into the holding car 200 at the loading station I, the conveyor is moved an incremental amount equal to one-tenth the conveyor loop length to bring the car 200 to the spraying station generally indicated in FIG. 11 by numeral II. At this station, the top edges and oppositely facing end edges of the envelopes in the batch 28 are sprayed with the envelope material degrading agent in the manner described above with reference to FIG. 4. The detailed structure of the apparatus for effecting the envelope edge spraying will be described hereinafter.

After the spraying station, the envelope batch 28 is moved to a soak station indicated generally by numeral III in FIG. 11. As explained above in describing a preferred method of opening envelopes, the soak station III ensures that sufficient time will be provided for the envelope material degrading agent to be absorbed by, and fully penetrate, the envelope material along the envelope edges.

Subsequently, the envelope batch 28 in car 200 is moved to an envelope end edge first heating station indicated generally by numeral IV in FIG. 11. At station IV, the opposing end edges of the envelopes in the batch 28 are contacted with heating members to assist in the deteriorating action of the envelope material degrading agent as discussed above with reference to the preferred method illustrated in FIG. 5.

The heating of the envelope end edges is accomplished in two separate stages. To this end, an envelope end edge second heating station V is provided downstream of the envelope end edge first heating station IV. The envelope batch is incremented in car 200 from station IV to station V.

Upon completion of the heating of the envelope end edges, the conveyor is advanced to bring the envelope batch 28 to an end edge brushing station designated generally by numeral VI in FIG. 11. At this station the end edges of the envelopes in the batch 28 are mildly abraded in a manner discussed above with respect to the preferred method illustrated in FIG. 6. The structural details of this station will be described hereinafter.

As the batch of envelopes moves around the conveyor end from the upper horizontal conveying path to the lower horizontal conveying path, the top edges of the envelopes are necessarily inverted as the entire batch 28 assumes the inverted orientation. To ensure that the inverted top edges of the envelopes are all properly aligned in a common plane for further processing, a jogging station is provided and is designated generally by VII in FIG. 11. At this station, the envelope batch 28 is temporarily released by the car holder 200 and the top edges of the envelopes are vibrationally aligned in the manner discussed above with respect to the method illustrated in FIG. 7. The structure of the jogging station VII will be described in more detail hereinafter. Subsequently, the batch of envelopes is reclamped in the car holder 200 with the inverted top edges of the envelopes aligned in a common plane.

After the inverted top edges of the envelopes in the batch 28 have been appropriately aligned with one another, the batch 28 is carried by its holding car 200 to an envelope top edge first heating station indicated generally by numeral VIII in FIG. 11. At this station, the top edges of the envelopes in the batch 28 are heated according to the general method discussed above with respect to the schematic illustration of that method in FIG. 8.

The heating of the envelope top edges is accomplished in two separate stages. To this end, an envelope top edge second heating station is provided, downstream of the envelope top edge first heating station, as indicated by numeral IX in FIG. 11. The top edge second heating station functions in the same manner as the top edge first heating station VIII.

In the last station, generally indicated by numeral X in FIG. 11, the inverted top edges of the envelopes in the batch 28 are mildly abraded according to the preferred method discussed above with respect to the schematic illustration of that method in FIG. 9. The structure of station X will be described in more detail hereinafter.

Upon termination of the abrading action on the envelope top edges at station X, all operations on the envelope batch 28 have been completed. The oppositely facing and end edges and the top edge of each envelope in the batch 28 have deteriorated and the envelope material forming the envelope edges has mechanically failed to provide an "opened" envelope.

The batch of opened envelopes is moved by the conveyor from station X back to station I where the batch of envelopes may be removed by operating personnel or automatically by suitable devices, such as the transfer device 24 illustrated in FIG. 1 and described in detail in the aforementioned concurrently filed U.S. patent application entitled "Method and Apparatus for Transferring Envelopes," Ser. No. 135,355.

The envelope batch holding car 200 will next be described in detail with reference to FIGS. 11, 12 and 13 in particular. The holding car 200 is illustrated in FIG. 12 as in position at station I of FIG. 11, but with the view of FIG. 12 rotated about 45 degrees to the vertical orientation for ease of viewing.

The transfer device 24 is positioned above the car 200 in station I and is adapted to transfer batches of sealed envelopes into the car 200 and to transfer batches of opened envelopes out of the car 200. The structure and operation of the transfer device 24 are described in detail in the aforementioned concurrently filed patent application entitled "Method and Apparatus for Transferring Envelopes," Ser. No. 135,355. Briefly, the envelopes are transferred to the car 200 by device 24 by means of a pair of opposed, downwardly projecting paddles, one of which paddles 126 is shown in FIG. 12. The paddles are spaced apart by distance greater than the length of the envelopes in the batch 28. When a batch of sealed envelopes is to be transferred by the device 24 into the car 200, the paddle 126 engages the facing end of the batch 28 and pushes the batch into the car 200.

The car 200 has a base 201 with wheels 202 and 205 mounted on a shaft 198 and with wheels 203 and 204 mounted on a shaft 199. The wheels support the base 201 for movement along the conveyor track 250 as best illustrated in FIG. 13. The track 250 includes a wheel guide 206 for receiving wheels 202 and 203 and wheel guide 207 for receiving wheels 204 and 205. With reference to FIG. 12, the guide 206 comprises a pair of spaced-apart angles 208 and 209. The horizontal leg of angle 209 extends slightly inwardly of the corresponding horizontal leg of angle 208 as illustrated in FIG. 13. Similarly, wheel guide 207 comprises a pair of spaced apart angles 210*a* and 211.

Figure 12:
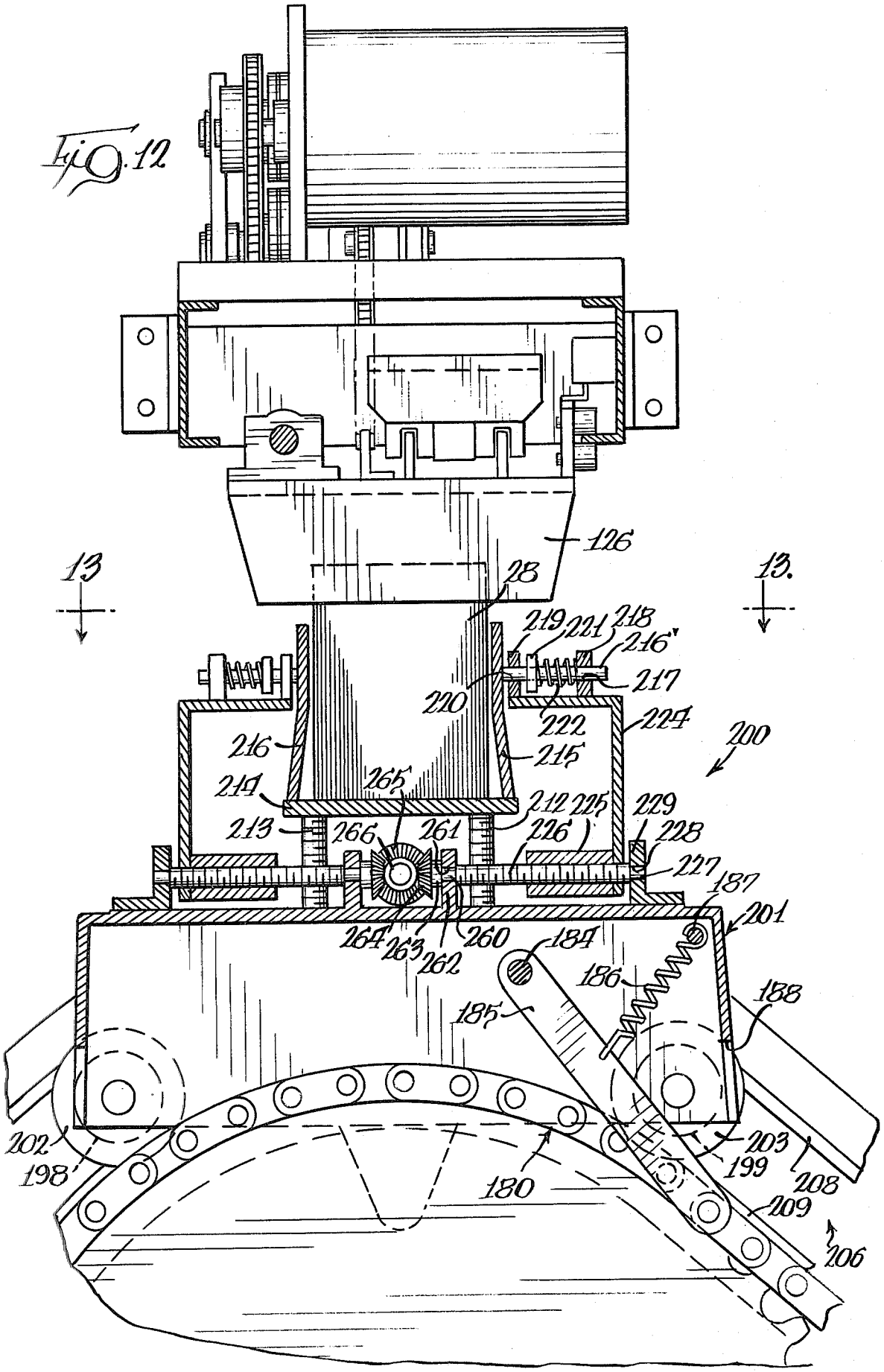
FIG. 12 is an enlarged, fragmentary, side view of the envelope batch loading station of the envelope opening apparatus showing a batch of sealed envelopes being positioned at the loading station by means of a transfer device.

As best illustrated in FIG. 12, the car 200 is connected to the conveyor drive system through the main conveyor drive chain 180. To this end, the car 200 has a generally horizontally disposed pin 184 mounted between opposing downwardly depending sidewalls of the car base 201. A connecting link 185 is rotatably mounted at one end to the pin 184 and at the other end to the main drive chain 180. The leading or front end of the car 200 and the connecting link 185 are biased together by means of a spring 186. The spring 186 is connected at one end to the link 185 intermediate of the ends of link 185 and is connected at its other end to a cross pin 187 secured between the downwardly depending sides of the car base 201 near the upper front corner of the car.

When the car 200 is on the straight section of the conveyor, rather than on the curved section illustrated in FIG. 12, the spring is biased upwardly against the surface 188 of a notched portion of the front of the car base 201. In this manner, the link maintains the car in a predetermined orientation on the chain 180 and permits accurate registration of the car at each of the stations I through X in the envelope opening apparatus.

The car 200 includes spaced apart support members 212 and 213 which support a base 214 on which the bottom edges of the envelopes in batch 28 rest. The envelopes are maintained in an orientation generally perpendicular to the base 214 by means of upstanding sidewalls or clamp members 215 and 216. The clamp members 215 and 216 are not connected to the base 214 but are adapted to slide relative to base 214 toward or away from each other.

A pair of rods 216' are secured to, and project outwardly from, clamp member 215. Each rod 216' is slidably disposed at its distal end in a bore 217 in a lug 218. Adjacent the clamp member 215 is another lug 219 defining a bore 220 therein through which is slidably received an inner portion of the rod 216'. The lugs 218 and 219 are mounted to an angle member 224.

Between the two lugs 218 and 219, the rod 216' has a collar 221 which is fixed to the rod for movement with the rod. Between the collar 221 and the outer lug 218 is a compression spring 222 which biases the collar 221 toward the envelope batch 28. This necessarily urges the rod 216' and hence, the plate 215 against the envelope batch 28. This mechanism thus applies a certain amount of clamping force to the one side of the envelope batch 28.

The angle 224 to which the lugs 218 and 219 are mounted carries a threaded bushing 225. A threaded adjusting rod 226 is threadingly engaged with the bushing 225. The threaded adjusting rod 226 has a reduced diameter unthreaded portion 227 received in a bore 228 of an angle bracket 229 mounted to base 201. At the other end, the threaded adjusting rod 226 has a reduced diameter portion 260 which is received in, and extends through, a bore 261 in a lug 262 projecting upwardly from base 201.

A bevel gear 264 with a mounting shaft portion 263 is mounted to the portion 260 of the rod 226. The bevel gear 264 is engaged with a driving bevel gear 265 which is mounted to shaft 266.

Figure 13:
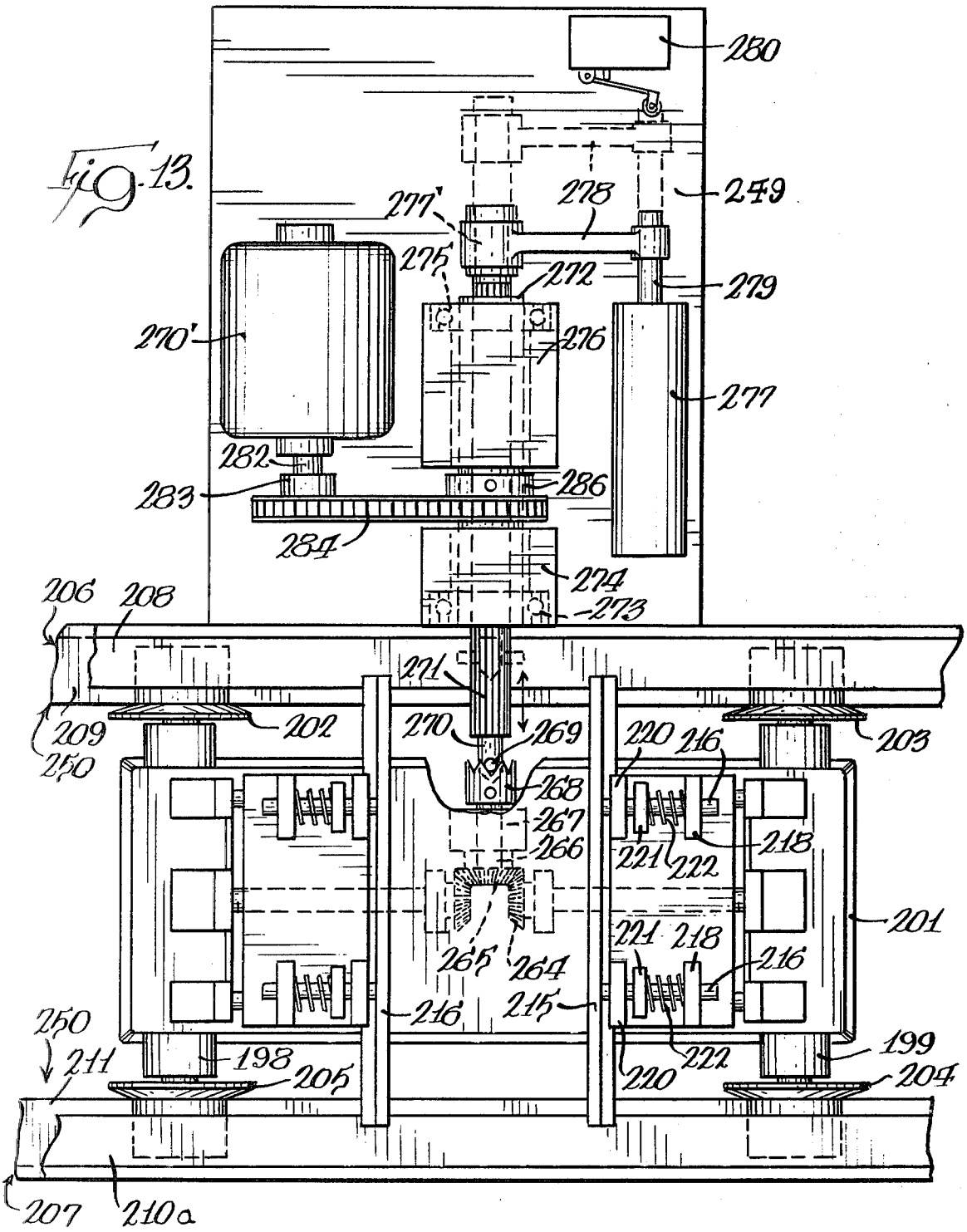
FIG. 13 is a fragmentary, cross-sectional view of the envelope batch loading station taken generally along the plane 13—13 in FIG. 12.

As best illustrated in FIG. 13, shaft 266 is journalled for rotation in a bearing 267 and carries, on its distal end, a toothed coupling member 268. The member 268 is adapted to be engaged by a rotatable and axially reciprocable driving pin 269 which is mounted on a reduced diameter extension 270 of a splined shaft 271.

The splined shaft 271 can be moved between an extended position shown in solid lines in FIG. 13 and a retracted position shown in dashed lines in FIG. 13 by a pneumatic cylinder mechanism 277. The shaft 271 is also continuously rotated by means of a motor 270'. To this end, the spline shaft is carried in a mating sleeve 272 which is supported for rotation in a bearing 273 within front housing 274 and for rotation at the other end in a bearing 275 supported within a rear housing 276. The splined shaft bearing housings 274 and 276, pneumatic cylinder 277, and motor 270' are suitably mounted to a support plate 249 fixed to the main frame of the envelope opening apparatus 26 adjacent the conveyor track 206. The splined shaft 271 is free to reciprocate along its longitudinal axis within the mating sleeve 272.

A rear portion 277' of the shaft 271 is not splined and is rotatably journalled within a bracket arm 278 secured to a piston 279 of the pneumatic cylinder 277. The reciprocation of the splined shaft 271 can thus be effected by reciprocation of the cylinder 277.

A limit switch 280 is mounted rearwardly of the pneumatic cylinder 277 for being actuated by the cylinder piston rod 279 when the splined shaft 271 is moved to the fully retracted position shown in dashed lines in FIG. 13.

The motor 270' is connected to rotate the splined shaft 271. To this end, the motor 270' has a shaft 282 on which is mounted a drive sprocket 283. A drive chain 284 is trained around the drive sprocket 283 and around a driven sprocket 286 which is secured to the sleeve 272 that is matingly engaged with the splined shaft 271.

When the splined shaft 271 is moved to the fully extended position shown in solid lines in FIG. 13, the driving pin 269 engages the toothed coupling member 268. Thus, rotation of the motor 270' will cause rotation of the coupling member 268.

Normally the motor 270' is de-energized and, therefore, not rotating. When the input car is properly registered by incremental movement of the conveyor at Station I, the splined shaft 271, which is normally retracted, is moved forward by actuation of the pneumatic cylinder 277 in response to appropriate signals generated by the envelope opening apparatus control system.

The control system also then energizes the motor 270' to rotate the splined shaft 271 in the appropriate direction so that the beveled drive gear 265 rotates the threaded rod 226 causing the angle 224 to move the clamp 215 toward and against an outer envelope of the batch or away from the envelope batch 28 as may be desired. In this manner, the side of the envelope batch can be clamped or unclamped by the side plate 215.

The clamp 216 is supported, spring biased and threadingly mounted to base 201 of the car 200 in the same manner as the clamp 215 described above. Thus, rotation of the bevel gear 265 is an appropriate direction by motor 272 will cause simultaneous movement of the clamps 215 and 216 toward or away from each other to clamp or unclamp the envelope batch 28 as may be desired.

The ten holding cars 200 on the conveying apparatus are identical and the corresponding elements of each car carry the same numeral in the figures.

A suitable pneumatic system and control means are provided for intermittently rotating the motor 270' in the proper directions and for operating the cylinder 277 as necessary to open the envelope batch clamps 215 and 216 at station I for receiving a new batch of envelopes and for then subsequently moving the clamps 215 and 216 against the envelope batch. The motor and cylinder are actuated to close the clamps in response to a signal from a sensing switch (not illustrated) which senses the admission of an envelope batch 28 between the clamps.

The clamping members 215 and 216 are maintained in the clamping position as the car 200 is moved through the various stations in the conveying path to station VII (FIG. 11). At station VII the clamping members 215 and 216 are moved apart to release the batch momentarily for purposes of vibrationally aligning the inverted top edges of the envelopes in a manner that will be described in detail hereinafter. After the envelope top edges have been aligned at station VII, the batch is reclamped and the car 200 is moved through the subsequent processing stations and ultimately back to station I (FIG. 11).

When the car 200 is back at station I, the envelope batch, with the envelopes now opened along their edges, is presented to the transfer device 24 or to operating personnel for removal. To this end, the direction of motor 270' is reversed and the cylinder operator 277 is actuated by the control system to release the clamping of the envelope batch. When the batch clamps 215 and 216 are moved apart to the unclamped position, the envelope batch 28 may be removed. If the transfer device 24 is used, a downwardly projecting paddle (similar to paddle 126 in FIG. 12 but on the opposite end of the envelope batch) is moved against the end of the batch to move the batch out of the holder 200 along a suitable guide channel (not illustrated) or along some other transfer surface.

With the envelope batch 28 suitably clamped in the batch holding car 200, the batch holding car 200 is moved to station II where the top and end edges of the envelopes are sprayed. Station II will now be described in detail with reference to FIGS. 14 and 15.

Figure 14:
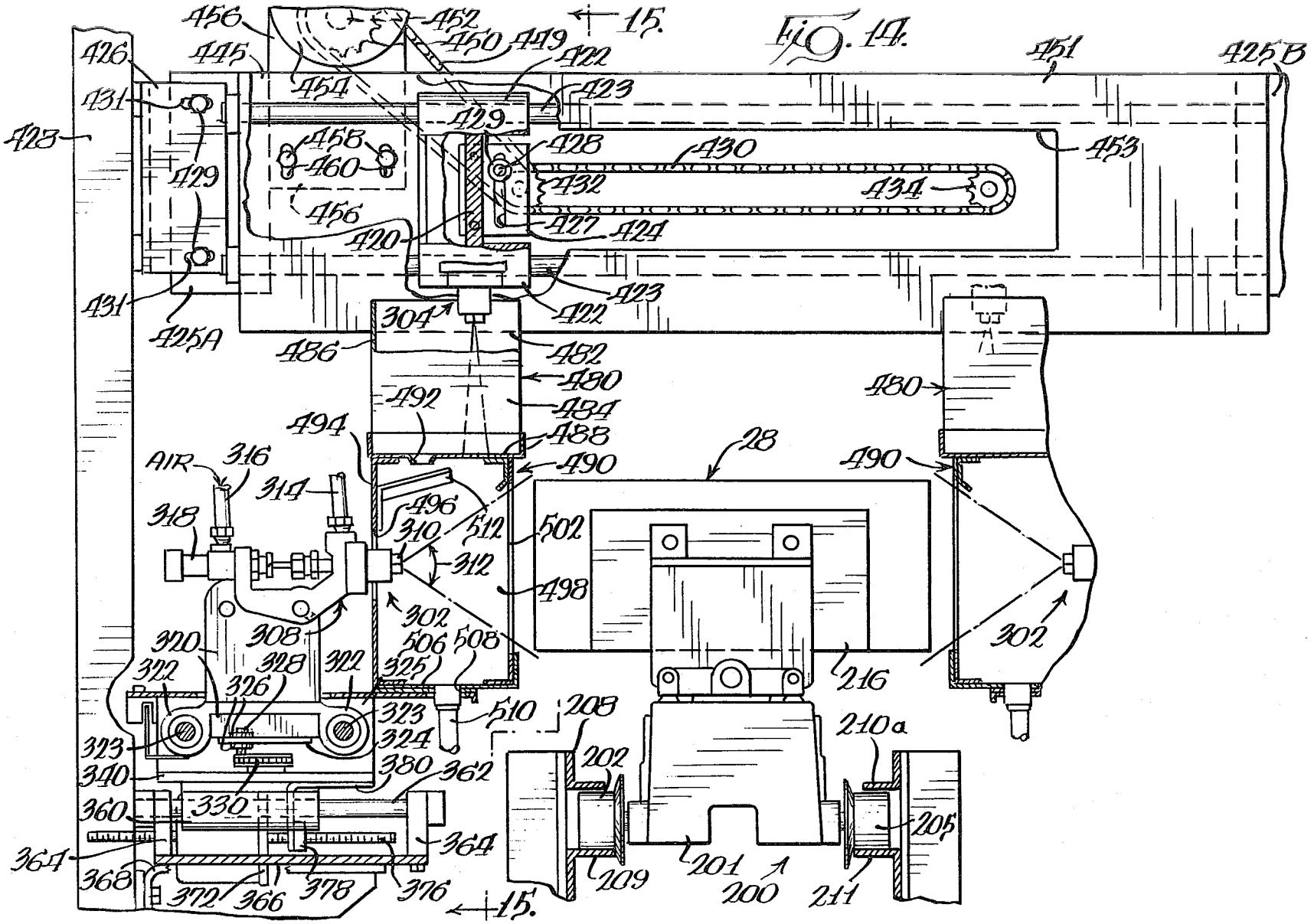
FIG. 14 is an enlarged, fragmentary, cross-sectional view of the envelope edge spraying station taken generally along the plane 14—14 in FIG. 11.
Figure 15:
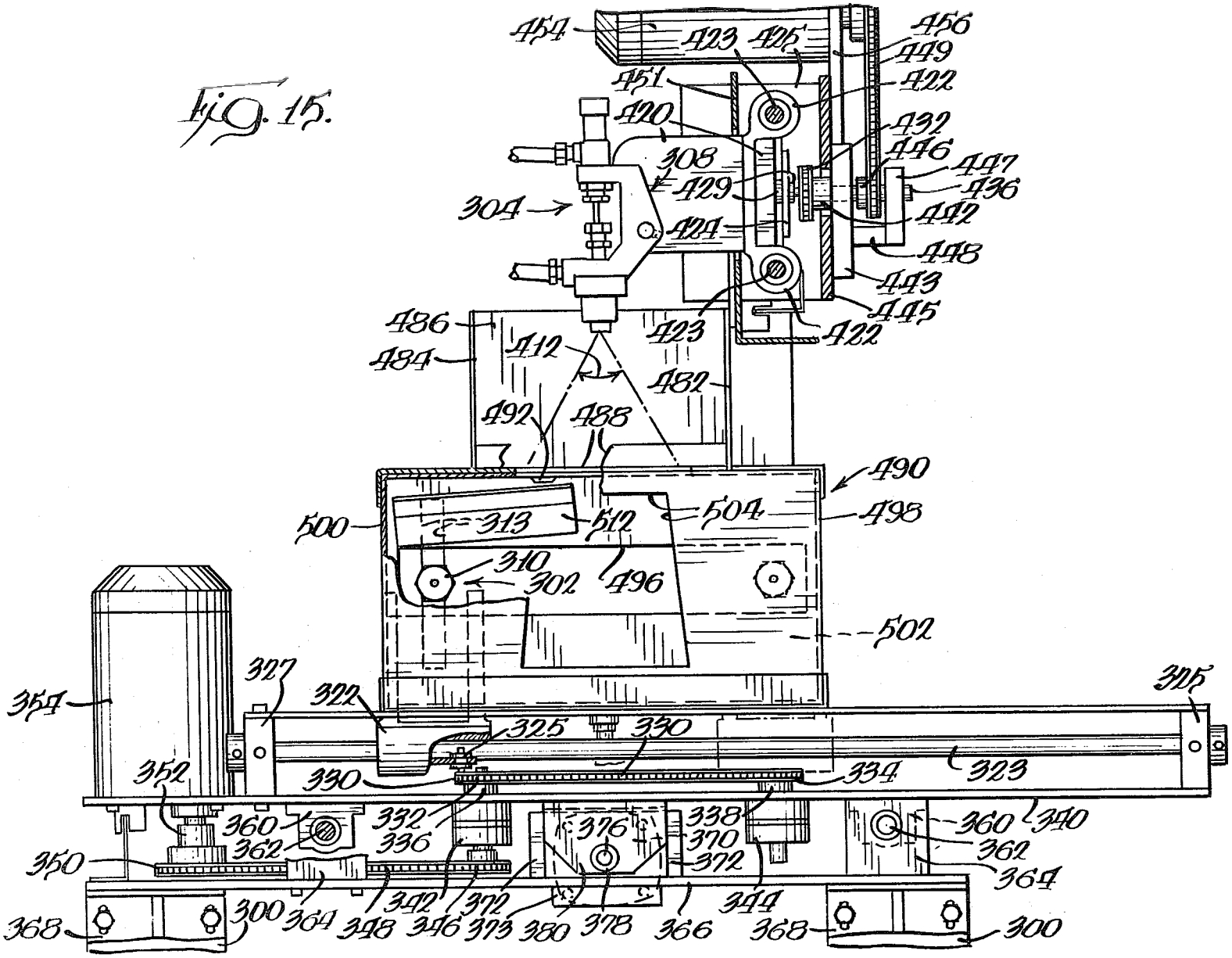
FIG. 15 is a fragmentary, cross-sectional view taken generally along the planes 15—15 in FIG. 14.

The spray station II is illustrated in FIG. 15 as being supported from upstanding frame members 300 on each side of the conveyor. An envelope batch holding car 200, identical to the car 200 illustrated in station I in FIG. 11 and in more detail in FIGS. 12 and 13, is shown properly positioned at the spray station in FIG. 14. Hence, the structural elements are indicated by the same numerals as used for the car in station I illustrated in FIGS. 12 and 13.

The spray station includes opposing, envelope end edge spray means or nozzle assemblies 302 which direct the envelope material degrading spray against the end edges of the envelopes in the batch 28. The spray station II also includes an envelope top edge spray means or nozzle assembly 304 which is adapted to direct the spray of envelope material degrading agent against the top edges of the envelopes in the batch 28.

With reference to FIG. 14, the left-hand assembly 302 will be described in detail. The righthand assembly 302 is substantially identical to the left-hand assembly 302 and will not be described in detail.

Spray assembly 302 includes a pressurized air-operated liquid spray gun 308 of conventional design. The gun 308 sprays the envelope material degrading agent solution from a nozzle 310 toward the end edges of the envelopes in the batch 28. Preferably, the nozzle 310 has an elongated orifice with a "18 thousandths" equivalent circular diameter and sprays the liquid in a substantially narrow band having a fan-shaped configuration with a vertex angle, indicated by double headed arrow 312, of about 70 degrees.

The gun 308 is operated with air pressure in the conventional manner. Briefly, the liquid envelope material degrading agent is supplied to the gun through conduit 314 and is maintained under pressure during operation of the envelope opening apparatus at all times. The pressurized air for operating the gun is supplied through conduit 316 by opening an electrically actuated solenoid valve 318 in the conduit 316. The air pressure drives the spray valve (internally mounted in the gun 308) open to permit the pressurized spray liquid from conduit 314 to pass through the valve and out of the nozzle to form the pattern spray.

A suitable pump, not illustrated, is provided to supply the liquid envelope degrading chemical to the gun 308 through conduit 314 from a suitably supply tank (not illustrated in FIGS. 14 or 15). When the liquid agent is of the type that tends to crystallize in the gun 308 when the machine is not being operated, a purging solution may be supplied, also through conduit 314, to the gun for being sprayed through the gun after all of the envelope batches have been processed and just prior to shutting the machine down. A separate pump may be used to supply such a purging solution from a suitable purging supply means (not illustrated).

For high speed operation, the pump supplying the pressurized liquid degrading agent will typically be run continuously. In lower speed applications, such a degrading agent spray pump may be intermittently run instead of continuously run. In either case, an internal bypass may be provided on both machines to permit the pressure of the liquid degrading agent to be maintained in conduit 314 at the gun 308 when the gun is not spraying.

The envelope end edge spray gun 308 is mounted for reciprocating movement in a direction perpendicular to the planes of the envelopes in the batch 28. To this end, the spray gun 308 is carried on a block 320 which has a pair of spaced apart bushings 322, each of which bushing 322 is slidably disposed on a rod 323. The rods 323 are mounted at either end to cross members 325 and 327.

Secured to the bottom of the block 320, between the bushings 322, is a plate 324 which defines an elongated slot 325 (FIG. 15) extending generally perpendicular to the longitudinal axes of the rods 323. The slot 325 receives a pin 328 which is retained on either side of the plate 324 by means of flanges 326.

The pin 328 is secured to an endless chain 330 which is trained at one end around a sprocket 332 and at the other end around a sprocket 334 as best illustrated in FIG. 15. The sprockets 332 and 334 are mounted to shafts 336 and 338, respectively, which pass through a support plate 340 and are mounted in bearings 342 and 344, respectively. The bearings 342 and 344 are secured to the bottom of the support plate 340.

Shaft 336 extends through bearing 342 and carries a sprocket 346 on its lower end engaged with an endless drive chain 348 which is trained around a sprocket 350 mounted to a drive shaft 352 of a motor 354. Motor 354 is mounted on the plate 340 and is operated, through a suitable control system, to move the spray nozzle assembly 302 along the end of the envelope batch 28. The limit of the movement of the nozzle 310 and of the bushing 322 is illustrated in dashed line in FIG. 15.

To accommodate different size envelopes, each end edge spray nozzle assembly 302 is laterally adjustable so that it can be moved closer to or further away from its respective end of the envelope batch 28. For this purpose, the support plate 340 carries a pair of downwardly projecting bushings 360 which are slidably supported on a pair of cross rods 362. Each cross rod 362 is fixed at either end to a pair of spaced apart brackets 364. The end brackets 364 are supported on a plate 366 which is secured by means of two angles 368 to the vertical frame members 300.

The bushings 360 are slidably disposed on the rods 362 to permit the reciprocation of the plate 340, and hence of the nozzle assembly 302, relative to the envelope batch 28. The plate 340 can be moved toward or away from the envelope batch 28 by means of a motor 370 mounted between a pair of side brackets 372 and front bracket 373 (FIG. 15) carried by cross member 366 between the vertical posts 300. The motor 370 has a threaded drive shaft 376 which is engaged with a threaded bushing 378 carried by an angle 380 secured to the bottom of the plate 340. Energization of the motor 370 in one direction of rotation will thus move the spray nozzle assembly 302 inwardly towards the envelope batch 28 and energization of the motor in the opposite direction of rotation will move the spray nozzle assembly 302 away from the end of the envelope batch 28.

Typically, the distance between the spray nozzle assembly 302 and the end of the envelope batch 28 is initially set before beginning operation of the envelope opening machine. Preferably, the setting is sensed by a suitable device or system and the setting is then fed to a microprocessor which, through the main control system, actuates the motor 370, each time the apparatus 26 control system is energized, to return the spray nozzle assembly 302 to the selected set point. When the apparatus 26 and its control system are de-energized, the motor 370 is automatically cycled to return the spray nozzle to a "home" position at one end of the nozzle travel. However, the microprocessor setting remains undisturbed so that subsequent energization of the apparatus 26 will actuate the motor 370 to return the spray nozzle to the set position.

The upper spray nozzle assembly 304 reciprocates over the top edges of the envelopes along the length of the envelopes in the batch 28. To this end, the spray assembly 304 includes a gun 308 identical to the gun 308 of the end edge spray assembly 302 and described above in detail. The gun 308 of assembly 304 is mounted on a support block 420 having a pair of spaced-apart bushings 422 which are slidably mounted on a pair of spaced-apart rods 423.

As best illustrated in FIG. 14, the rods 423 are mounted on their left-hand end to one leg of an angle 425A and on their right-hand end to a leg of an angle 425B. The angles are mounted to suitable frame members of the machine. For example, on the left-hand end, the angle 425A is mounted to angle 426 by means of bolts 429 disposed in elongated apertures 431 in angle 426. Angle 426 is carried by a vertical frame member 428. Suitable mounting bolts and elongate receiving apertures (not illustrated) are provided on the mounting column 428 for adjusting the carrier angle 426 in a vertical direction to accommodate vertical adjustment of the envelope top edge spray nozzle assembly 304.

As illustrated in FIG. 15, a plate 424 is mounted to the right-hand end of the gun mounting block 420. As best illustrated in FIG. 14, the plate 424 has an elongated slot 427 extending generally perpendicular to the longitudinal axis of the rods 423. The slot 427 receives a pin 428 retained therein on either side of the plate 424 by flanges 429.

The pin 428 is carried on an endless loop chain 430 trained at one end around sprocket 432 and at the other end around sprocket 434. As best illustrated in FIG. 15, sprocket 432 has a shaft portion 442 mounted to a shaft 436. Shaft 436 is mounted on one end for rotation in a plate 443 which in turn is mounted to a plate 445 supported at either end by angles 425 and 427 suitable frame members, such as by angle 425 (on the left-hand end as viewed in FIG. 14). The shaft 436 is mounted for rotation on its distal end in a bracket or bearing 447 which is supported by member 448 to plate 443. Between bracket 447 and the plate 443 the shaft 436 carries a sprocket 446 which is fixed for rotation with the shaft 436. The sprocket 446 is driven through drive chain 449 by means of a drive sprocket 450 secured to shaft 452 of a motor 454.

As best illustrated in FIG. 14, the motor 454 is mounted to a plate 456 carried on support plate 445 extending between angles 425A and 425B. The motor plate 456 is secured to plate 445 by means of bolts 458 through elongate slots 460 in plate 445. A front cover 451 is provided to extend between angles 425A and 425B and has an elongate opening 453 through which the nozzle assembly 304 projects.

Operation of the motor 454 moves the nozzle assembly 304 along the length of the envelopes in the batch 28 to direct the spray of envelope material degrading agent against the envelope top edges.

As best illustrated in FIG. 15, the envelope material degrading agent is sprayed from the nozzle 308 in a substantially planar, fan-shaped spray pattern having an angle indicated by the double headed arrow 412 of about 55 degrees.

An enclosure system is provided to shield much of the structure of the machine from the spray. Specifically, a housing 480 is provided on each end of the envelope batch 28 below the end points of the travel of the envelope top edge spray assembly 304. The enclosures 480 are identical and only the enclosure on the left-hand side of the apparatus, as viewed in FIG. 14, will be described in detail. Specifically, the enclosure 480 has a pair of opposed end walls 482 and 484 and a sidewall 486. Opposite the sidewall 486, the enclosure 480 is open to permit the top edge spray nozzle assembly 304 to move toward the envelopes.

The enclosure 480 includes a bottom reservoir 488 which is supported on an end edge spray assembly enclosure 490 therebelow. The bottom reservoir structure 498 defines a drain orifice 492 therein to permit passage of liquid agent into the lower enclosure 490.

The enclosures 490 associated with the two envelope end edge spray nozzle assemblies 302 are identical and only the enclosure 490 shown on the left-hand side of FIG. 14 will be described in detail. The enclosure 490 includes a back wall 494 with an elongated slot 496 therein to permit the penetration of the nozzle 310 of the spray gun 308. The top of the enclosure 490 is defined by the reservoir 488 of the upper enclosure 480. With reference to FIG. 15, the enclosure 490 also has a pair of opposed end walls 498 and 500. Opposite the rear wall 494 of lower enclosure 490 is a front wall 502 which defines therein a generally trapezoidal shaped aperture 504 to permit the spray to pass out of the enclosure and to the envelope end edges. The enclosure 490 has a floor plate 506 defining an aperture 508 therein which is connected to a drain line 510 for carrying away the spray liquid trapped within the enclosure 490.

The spray liquid discharging from the upper enclosure 480 through the drain aperture 492 is directed away from the end edge spray nozzle 310 below it by means of a slanted baffle or trough 512. As best illustrated in FIG. 15, the trough 512 is slanted toward the end wall 500 of the lower enclosure 490. Thus, the collected spray liquid flows off of the trough 512 adjacent that end wall 500 and down to the floor 506 of the lower enclosure 490 where it discharges through the drain line 510.

A substantially planar spray pattern of the end edge spray assembly 304 is illustrated in dashed line in FIG. 15 and is indicated generally by numeral 313. The cross-sectional configuration of the spray pattern is seen to be a relatively narrow rectangle and thus the spray pattern is said to be "substantially planar". The spray pattern of the top edge spray nozzle assembly 304 has a similar configuration though oriented in a "plane" substantially perpendicular to the envelope top edges. Other types of spray patterns may be used with any or all of the spray nozzle assemblies.

Though not illustrated in the drawings, the spraying station is preferably surrounded by a suitable hood or enclosure which includes, or is ducted to, a suitable chemical filter. Also, though not illustrated, it is desirable to provide an induced draft blower to circulate the atmosphere within the enclosure through the chemical filter and then back into the spraying region.

Preferably, the end edge nozzle assemblies 302 are moved during spraying along the batch edges from one side of the batch to the other side of the batch in one direction only. After each nozzle 302 has traversed its respective batch end once, the movement of the nozzle is terminated and the envelope batch 28 is moved to the next processing station in holder car 200. When a new envelope batch is positioned at the spraying station, the nozzle assemblies 302 discharge the liquid spray while being moved back again along the batch edges.

Similarly, the envelope batch top edge spray nozzle 304 is moved in only one direction while spraying the batch from one end of the batch to the other end of the batch. After that single traverse, the envelope batch 28 is moved to the next station and a new batch is brought into the spraying station. As the top edge nozzle 304 sprays the new batch, it is moved back along the top edges of the envelopes from one end of the batch to the other end to its initial position illustrated in solid line in FIG. 14.

Of course, if it is desired to spray the end edges and top edges of the envelope batch with more than one traverse, the control system can be modified as necessary to effect such operation.

The envelopes are moved in car 200 from the spray station II to the soak station III where the liquid degrading agent is absorbed through the full thickness of the envelope material at the envelope edges.

Figure 17:
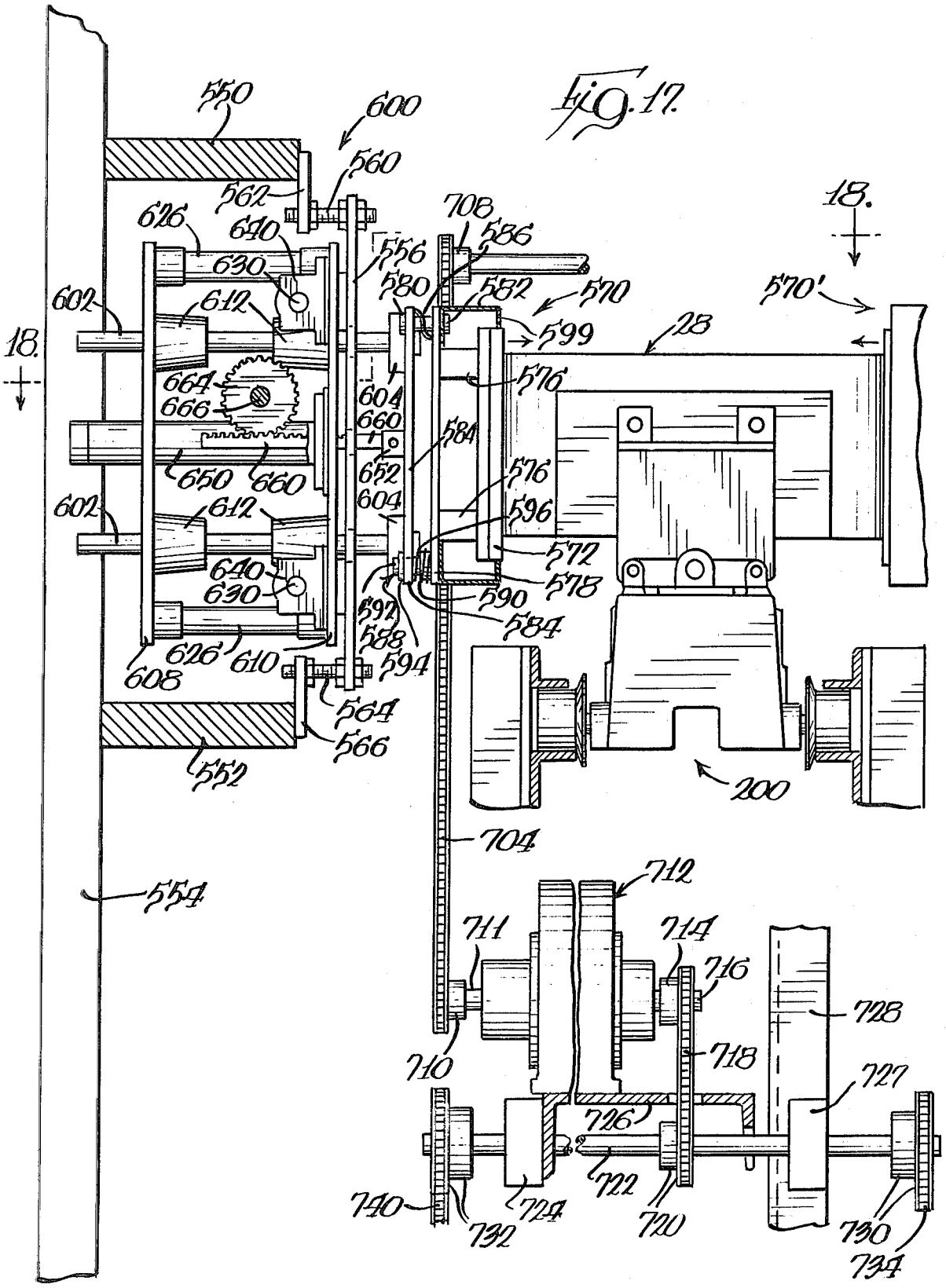
FIG. 17 is a fragmentary, cross-sectional view taken generally along the plane 17—17 in FIG. 15 but with certain mechanisms and some structural detail omitted for purposes of clarity.

From the soak station III, the envelope batch 28 is moved in car 200 to the end edge first heating station IV. The end edge first heating station includes a pair of facing, spaced-apart, identical heating member assemblies 570 and 570' as illustrated in FIG. 17. Only member 570 will be fully described.

The heating member assembly 570 is adapted to be supported and positioned against the batch of envelopes by means of a support and positioner mechanism 600 mounted to frame members, such as column 554, which constitutes the main framework of the apparatus 26.

The support and positioner mechanism 600 includes a vertically oriented, stationary, support plate 556 secured at two points along its upper edge by bolts 560 to lugs 562 on an upper frame membber 550 secured to column 554. Similarly, the plates 556 is secured along its lower edge at two points by bolts 564 to lugs 566 which are in turn secured to a lower frame member 552 secured to column 554. The plate 556 supports the entire envelope end edge heater platen assembly 570 and its associated positioning mechanisms as will next be explained in detail.

Figure 18:
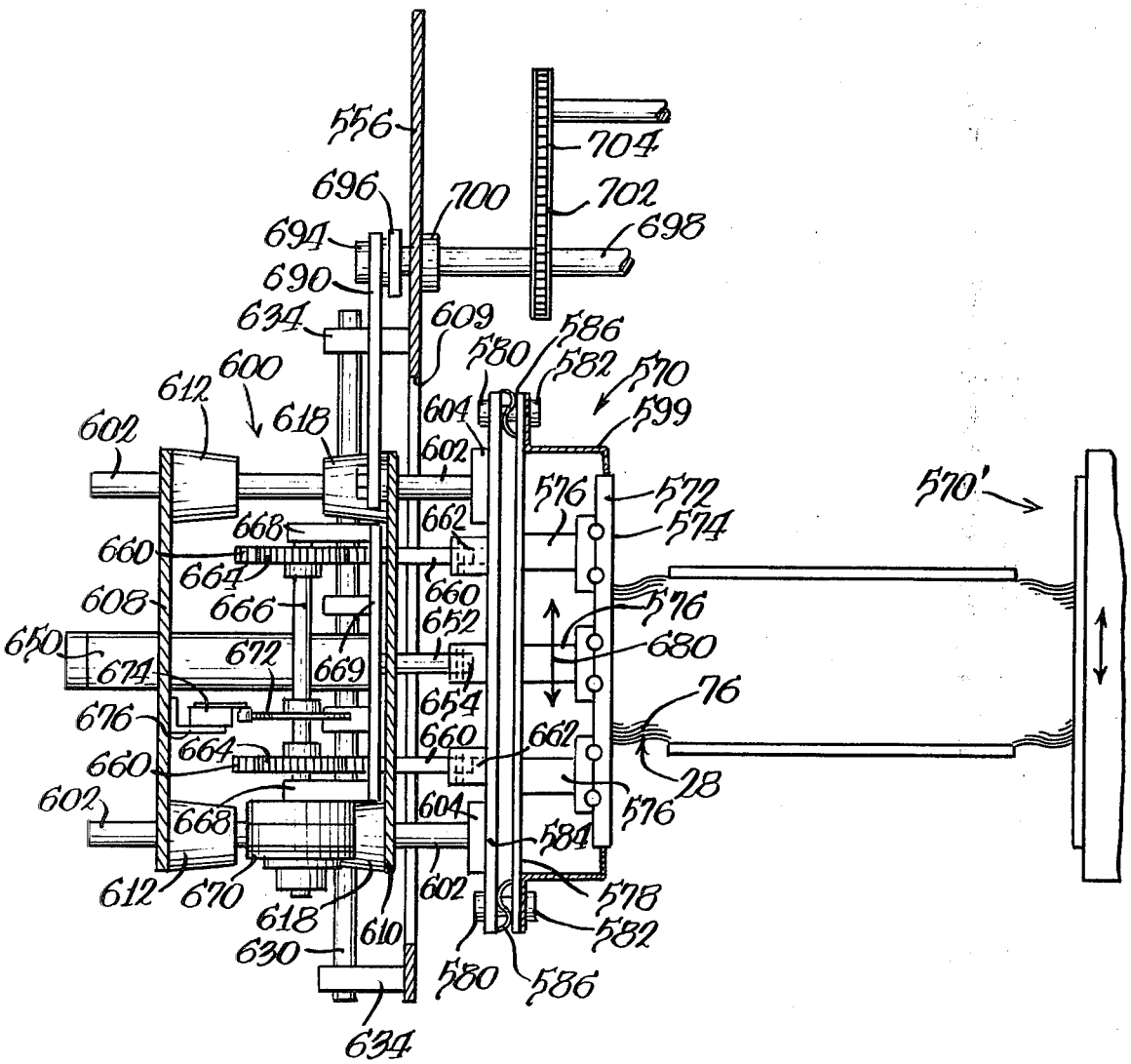
FIG. 18 is a fragmentary, cross-sectional view taken generally along the planes 18—18 in FIG. 17.

With reference to FIGS. 17 and 18, the heater platen assembly 570 includes an end edge envelope heating member or plate 572 having a heating surface 574 for contacting the end edges of the envelopes in the batch 28. The heating member 572 is of the conventional type that contains resistance heating elements which generate heat for conduction through the heating member 572 to the heating surface 574.

The heating member 572 has a plurality of ports or extension members 576. As can be seen in FIGS. 17 and 18, the posts 576 are arranged in two horizontal rows of three posts each. The posts 576 are mounted to a base plate 578 which in turn is mounted to a parallel base plate 584 in a manner that permits the plate 578 to be skewed with respect to the base plate 584.

In particular, and with reference to FIGS. 17 and 18, the plates 578 and 584 are joined together along their upper horizontal edges by two spaced-apart bolts 582.

The bolts are retained on the plates with nuts 580. The plates are resiliently biased apart a small amount by a spring washer or other suitable biasing means 586.

As best illustrated in FIG. 17, the plates 578 and 584 are joined together along their horizontal bottom edges by two spaced-apart pins, one of which is visible in FIG. 17 and is indicated by numeral 588. The pin 588 has an increased diameter portion 590 between the plates 578 and 584 and a reduced diameter portion 592 which passes through an aperture in plate 584 and is retained therethrough by means of a nut 594. The increased diameter portion 590 of pin 588 is fixed to the plate 578. A spring 596 is mounted around the pin 588 between the two plates 578 and 584 to bias the plates apart by a small amount as limited by the nut 594.

The resilient mounting of the heating platen to the base plate 580 described above permits a small skewing of the heating platen surface 574 with respect to the vertical. This can help accommodate a slight cocking of the envelope batch 28 in the holding car 200.

As best illustrated in FIGS. 17 and 18, an enclosure 599 is provided around the heating member 572 and is secured to plate 578.

Figure 16:
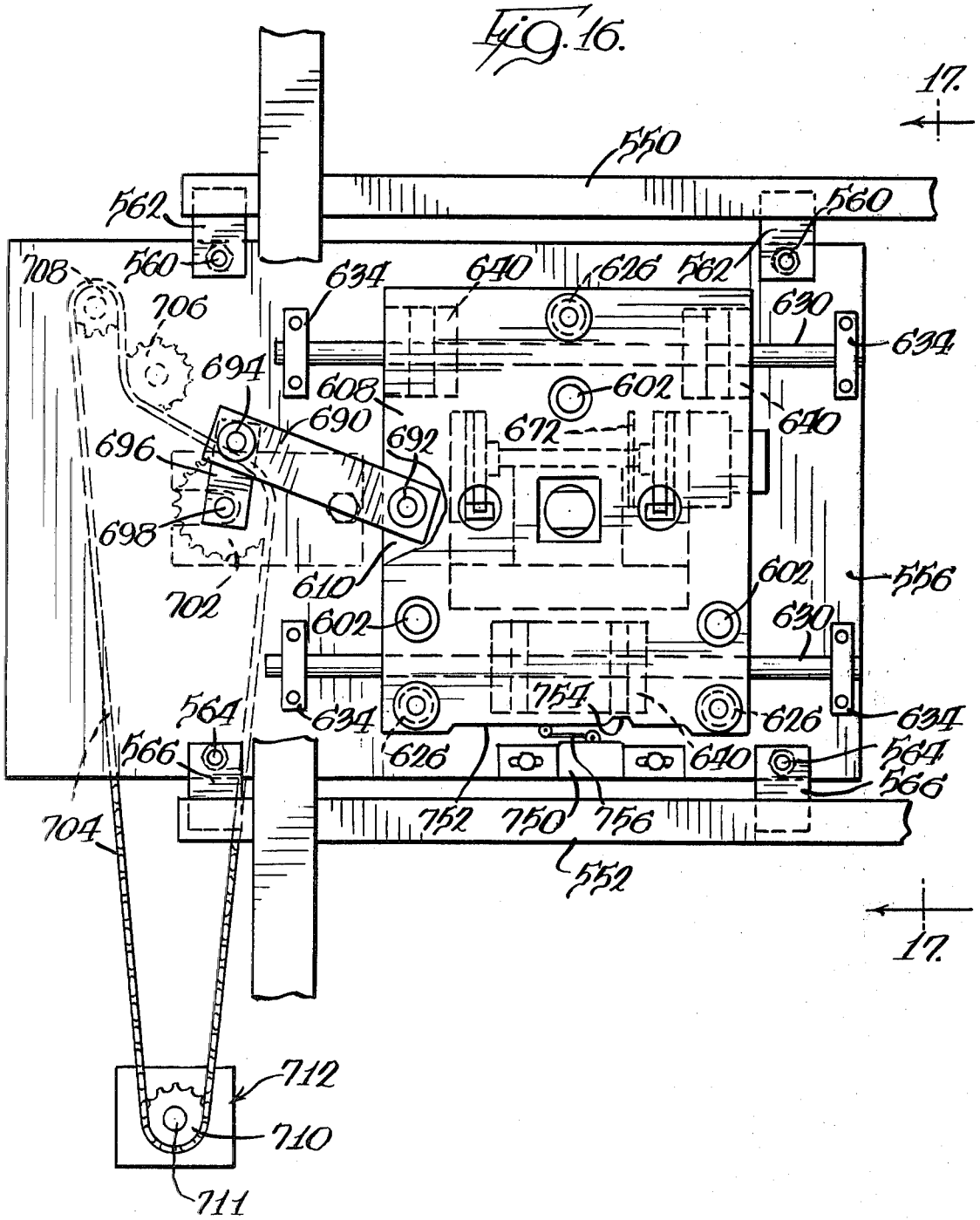
FIG. 16 is an enlarged, fragmentary, side elevational view of the envelope end edge first heating station of the apparatus schematically illustrated in FIG. 11.

The base plate 584 is carried for reciprocating movement by three parallel rods 602 which are arranged in a triangular configuration as illustrated in FIG. 16. To this end, plate 584 is apertured to receive an end of each rod 602 and carries three bushings 604 through which rods 602 are secured to plate 584.

The rods 602 extend through a large aperture 609 in main mounting plate 556 (see FIG. 18) and are slidably mounted through a pair of spaced-apart mounting plates, exterior plate 608 and inner plate 610. Plate 608 is apertured and carries bushings 612 in which the rods 608 are slidably received. Similarly, plate 610 is apertured and slidably mounted to rods 602 with bushings 618.

The plates 608 and 610 are rigidly secured together in spaced-apart, parallel relationship by means of three parallel rods 626 arranged in a triangular configuration as can be ascertained from FIGS. 16 and 17.

The heating platen assembly 570 can thus be movable as a unit with rods 602 toward or away from the envelope batch 28 by a mechanism to be described in detail hereinafter.

The rigid assembly of parallel plates 608 and 610 is also mounted for movement parallel to the conveying path (and hence parallel to the plane containing the end edges of the envelopes in batch 28) by means of a pair of support rods 630. Rods 630 are secured to the base plate 556 by means of brackets 634 on each end. The plate 610 is slidably mounted to the rods 630 in three places by means of bushings 640. The mechanism for reciprocating the plate 610 along the rods 630 will be described in detail hereinafter.

Mounted to plate 610 is a single acting, spring-return pneumatic cylinder actuator 650 which has a piston rod 652 projecting through a suitable aperture in plate 610 and through the aperture 608 in mounting plate 556. The piston rod 652 is secured to the platen mounting plate 584 of the platen assembly 570 by means of a sleeve 654 which is secured to the mounting plate 584. Actuation of the pneumatic cylinder 650 thus effects a movement of the heating platen assembly 570 toward or away from the end edges of the envelopes in batch 28.

The operation of pneumatic cylinder 650 is effected by a suitable control system. Specifically, when the envelope batch holding car 200 is in the proper position within the end edge first heating station IV, a suitable signal is generated by appropriate means associated with the conveyor drive system to actuate the cylinder 650 to move the heating platen assembly 570 against the end edges of the envelopes in batch 28.

Preferably, the heating member 572 of the platen assembly 570 is pushed against the end edges of the envelopes by the cylinder 650 so that the envelopes flex or bend inwardly of their edges as indicated generally at 76 in FIG. 18. Typically the envelopes are flexed so that the end edges deflect inwardly about one eighth inch.

The position of the heating platen assembly 570 may be maintained at the extended position against the envelopes in a number of ways. In the embodiment illustrated, the heating platen assembly 570 may be positively restrained against rearward movement as will next be explained.

The rods 602 that carry the heating platen assembly 570 are prevented from moving from the extended position by a braking system. To this end a pair of racks 660 are secured to the heating platen assembly plate 584 by means of connecting sleeves 662. Each rack 660 is engaged with a pinion gear 664. Each gear 664 is each mounted to a common shaft 666 for rotation therewith. The shaft 666 is supported on either end by bearings 668 which are mounted on either end by bearings 668 which are mounted to a plate 669 connected to the mounting plate 610.

An electrically operated brake 670 is mounted to shaft 666 outwardly of the two pinion gears 664 to one of the bearings 668 and is operably connected to the shaft 666. The brake 670 is operated by means of a pressure switch (not illustrated) that is incorporated in the pneumatic system for operating the pneumatic cylinder 650. As the pneumatic cylinder 650 extends, and as the heating member 572 is forced against the envelopes, the pressure in the pneumatic cylinder 650 increases. The pressure switch in the pneumatic system is set to be actuated at a predetermined increased pressure. The switch actuation causes the brake 670 to be energized. This restrains the shaft 666 from rotating relative to the fixed bearing 668. This effectively restrains the heater platen assembly 570 against the envelope batch 28. While the brake 670 is thus energized, the pnuematic cylinder 650 also remains pressurized.

Between the pinion gears 664, the shaft 666 carries a cam wheel 672 for rotation with the shaft 666 and adapted to actuate a limit switch 674 which is mounted by means of angle 676 to the exterior plate 608. The switch 674 is used to sense and signal the fully retracted position of the heating platen assembly 570.

With the heating platen assembly 570 moved inwardly against the end edges of the envelopes as illustrated in FIGS. 17 and 18, the heating platen assembly 570 is reciprocated alongside the envelope end edges. Preferably, the heating platen assembly is reciprocated in a plane parallel to the plane containing the end edges of the envelopes. The heating platen assembly 570 is reciprocated in that plane in a direction indicated by the double headed arrow 680 in FIG. 18 that is generally perpendicular to the planes of the major portions of the envelopes in the batch 28. The means for reciprocating the heating platen assembly 570 will next be described.

With reference to FIGS. 16 and 18, it can be seen that a crank arm 690 is mounted to the inner plate 610 for rotation about a pin 692. The other end of crank 690 is secured with a pin 694 to a crank arm 696. Crank arm 696 is mounted to a shaft 698 which is journalled within a bearing 700 secured to main plate 556.

A sprocket 702 is secured to shaft 698 and is driven by an endless drive chain 704. Drive chain 704 is trained around an outer idler sprocket 706, an inner idler sprocket 708, and a drive sprocket 710. Drive sprocket 710 is mounted to a driven shaft 711 of a combination electric clutch and brake.

As best illustrated in FIG. 17, a sprocket 714 is mounted to a shaft 716 on the driving side of the clutch and brake 712. The sprocket 714 is engaged with an endless loop chain 718 which is driven by a sprocket 720 mounted to a main jack shaft 722. Jack shaft 722 is supported for rotation on one end by bearing 724 secured to a main frame channel 726 and on the other end by bearing 727 secured to a suitable main frame member 728. Also mounted on the main jack shaft 722 are a pair of sprockets, sprocket 730 and sprocket 732.

With reference to FIGS. 11 and 11A, sprocket 730 is schematically illustrated as being engaged with the endless loop drive chain 734 which is continuously driven by the motor 110 through the sprocket 114.

With reference to FIG. 17, the sprocket 732 on main jack shaft 722 is engaged with an endless loop drive chain 740 which provides power to the stations VII, VIII, and IX, as will be explained in detail hereinafter.

In operation, the envelope end edge heating station platen assembly at station IV is reciprocated after the envelopes have been contacted and flexed inwardly by the heating platen assembly 570 as illustrated in FIGS. 17 and 18. To this end, the previously discussed pressure switch incorporated in the pneumatic system for the pneumatic cylinder 650 is also used to initiate the reciprocation. Specifically, when the heating platen assembly 570 is moved against the envelopes and the pressure in the pneumatic cylinder 650 has increased to the preset amount, actuation of the pressure switch at that preset level, in addition to actuating the brake 670, signals the microprocessor in the control system of apparatus 26 to indicate that the heater platens have been moved inwardly a sufficient amount against the envelope end edges. The microprocessor control system, upon receiving the signal from the pressure switch, initiates the reciprocating action of the heating platen assembly 570. Specifically, the control system signal actuates the combination electric clutch and brake assembly 712 to release the braking action and simultaneously engage the clutch in assembly 712 to permit the endless loop drive chain 704 to be driven through the clutch from the main jack shaft 722.

With reference to FIG. 16, it can be seen that rotation of the sprocket 710 will cause the crank arms 696 and 694 to effect a reciprocating motion to the plates 608 and 610 and, hence, to the heating platen assembly 570. After a predetermined time period, the combination electric clutch and brake 712 is actuated by the control system timer to disengage the clutch and apply the brake. The signal from the control system timer also actuates an electrical solenoid-operated valve (not illustrated) in the pneumatic system of the pneumatic cylinder 650 to depressurize the cylinder for allowing the return of the heating platen assembly 570 to the retracted position under the influence of the internal spring in the cylinder 650.

As best illustrated in FIG. 16, a limit switch 750 may be provided on the stationary mounting plate 566 for being engaged by a bottom surface 752 of the exterior movable mounting plate 608. The bottom surface 752 has a groove 754 and the limit switch 750 is positioned relative thereto so that it is actuated by the groove 754 when the plate 608, and hence the heater platen assembly 570, is at a desired end-of-travel or "home" position within the first heating station IV.

When the combination clutch and brake assembly 712 is actuated by the control system timer to terminate the reciprocation movement of the heating platen assembly 570, the movement of the plate 608 is terminated at the home position as sensed by the switch 750.

As an alternate embodiment, not illustrated, it may be preferable to provide a heating station IV as described above except that the platen assembly braking system, including the brake 670, is eliminated. With such a system, as with the above-described illustrated system incorporating the brake 670, the pneumatic system for pressurizing the pneumatic cylinder 650 is initially actuated when the envelope batch holding car 200 has been incremented to the heating station IV. The main control system for the envelope opening apparatus 26 would initiate an appropriate signal after the completion of the incremental conveyor movement that positions the holding car properly within the heating station IV.

In this alternate embodiment, pressurization of the cylinder 650 moves the heater platen assembly 570 inwardly against the envelope end edges. The pressure applied to the envelope edges by the pneumatic cylinder 650 may be set by controlling a suitable pressure regulator (not illustrated) in the pneumatic system.

The increased pressure in the pneumatic system is sensed by a pressure switch and the signal from the pressure switch is fed into the control system microprocessor. Upon receiving the signal from the pressure switch, the microprocessor initiates the reciprocation of the heating platen assembly against the envelope end edges for a predetermined time period as described above for the illustrated embodiment. The pressure in the cylinder 650 is maintained to hold the heater platen 570 against the envelope end edges.

The control system timer would terminate the reciprocation action, as explained above for the illustrated embodiment. Simultaneously with the termination of the reciprocation of the heater platen assembly, the control system would actuate an appropriate valve in the pneumatic system for cylinder 650 to depressurize the cylinder and permit the spring within the cylinder 650 to return the heating platens to the retracted position away from the envelope end edges.

With reference to FIG. 17, another heating platen assembly 570′ is provided to contact the envelope end edges on the end of the batch 28 opposite the heating platen assembly 570 described in detail above. The heating platen assembly 570′ and the associated support and positioning drive mechanisms are substantially identical to those associated heater platen assembly 570 and described above. The crank arm linkage mechanism for reciprocating the heating platen assembly 570′ is driven off of shaft 698 (FIGS. 16 and 18) in the same manner as the linkage system associated with the heating platen assembly 570. Therefore, the structural details of the heating platen assembly 570′ and the associated support and positioning mechanisms have not been fully illustrated in the figures.

Regardless of which of the above-described platen assembly control system embodiments is used, the normally retracted position of the heating platen assembly 570 provides a predeterminate amount of clearance between the heating surface 574 and the end edges of the envelopes in batch 28. The platen 572 is maintained in the retracted position until a subsequent control signal is generated upon the arrival of a new envelope batch 28 into the end edge first heating station IV.

The envelope batch is next moved from the end edge first heating station IV to the end edge second heating station V where the envelope end edges are heated in the same manner as in station IV. The structure of station V is substantially identical to that of station IV.

Thus, the detailed structure of heating station V is not illustrated or described in detail herein. The structural elements schematically illustrated in FIG. 11 for station V carry the same numerals as the corresponding elements in station IV.

As best illustrated in FIG. 11, the reciprocation of the heating platen assembly within station V is effected by moving the assembly along the rods 630 on the fixed mounting plate 556 by means of a linkage rod 749 which is connected to the exterior mounting plate 608 at station IV and at station V. Thus, when the heating assembly at station IV is reciprocated by the crank arm linkage system through the drive chain 704 as described in detail above, the assembly at station V is correspondingly reciprocated.

After the end edges of the envelope batch 28 have been heated for the second time at station V, the chemical deterioration of the envelope end edges is substantially complete. Therefore, the envelope batch 28 is next moved in its holding car 200 to the end edge brush station VI illustrated schematically in FIG. 11.

Figure 19:
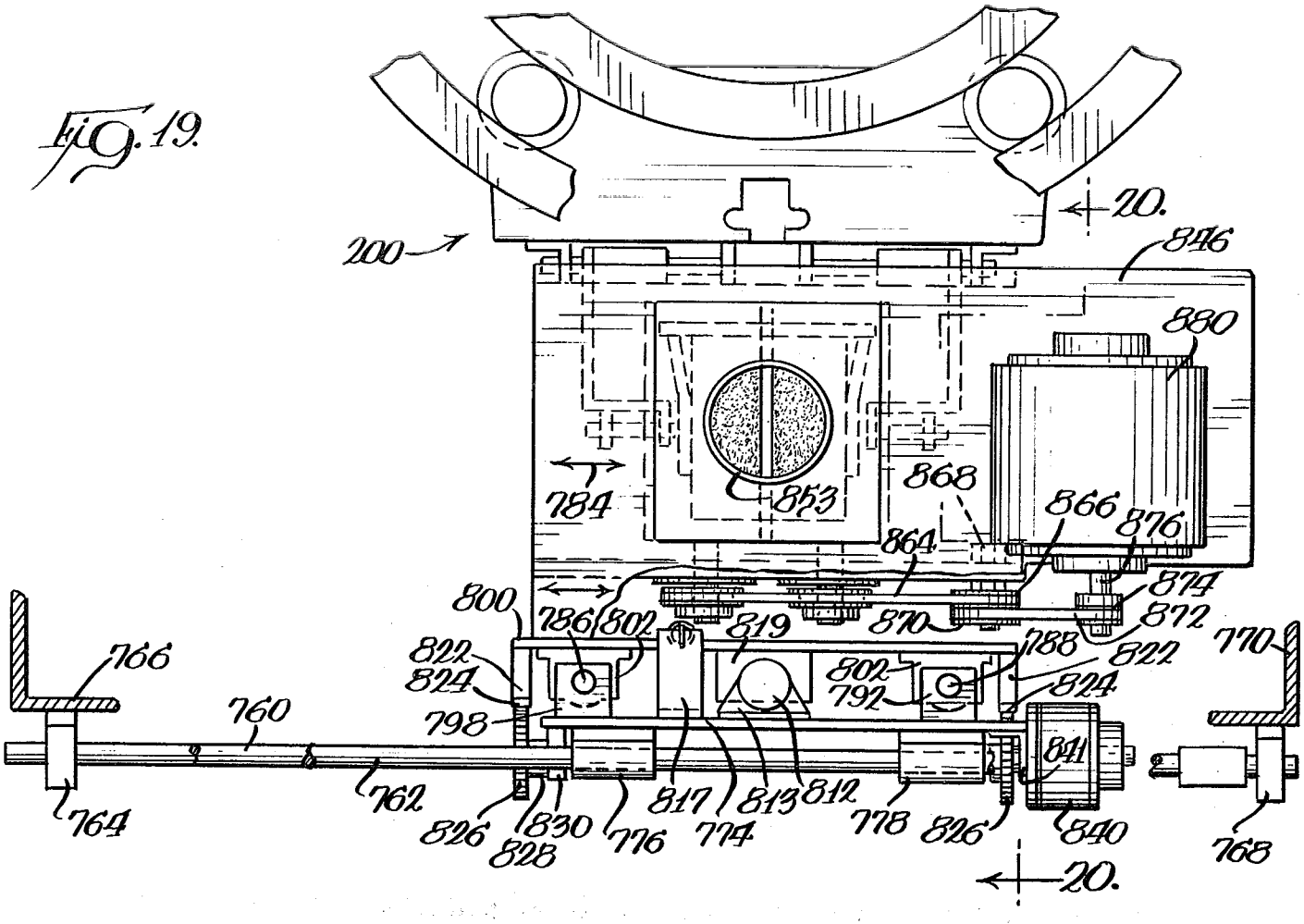
FIG. 19 is an enlarged, side elevational view of the envelope end edge brush station of the apparatus illustrated in FIG. 11 with portions of the structure broken away to show interior detail and with certain structural features omitted for purposes of clarity.
Figure 10:
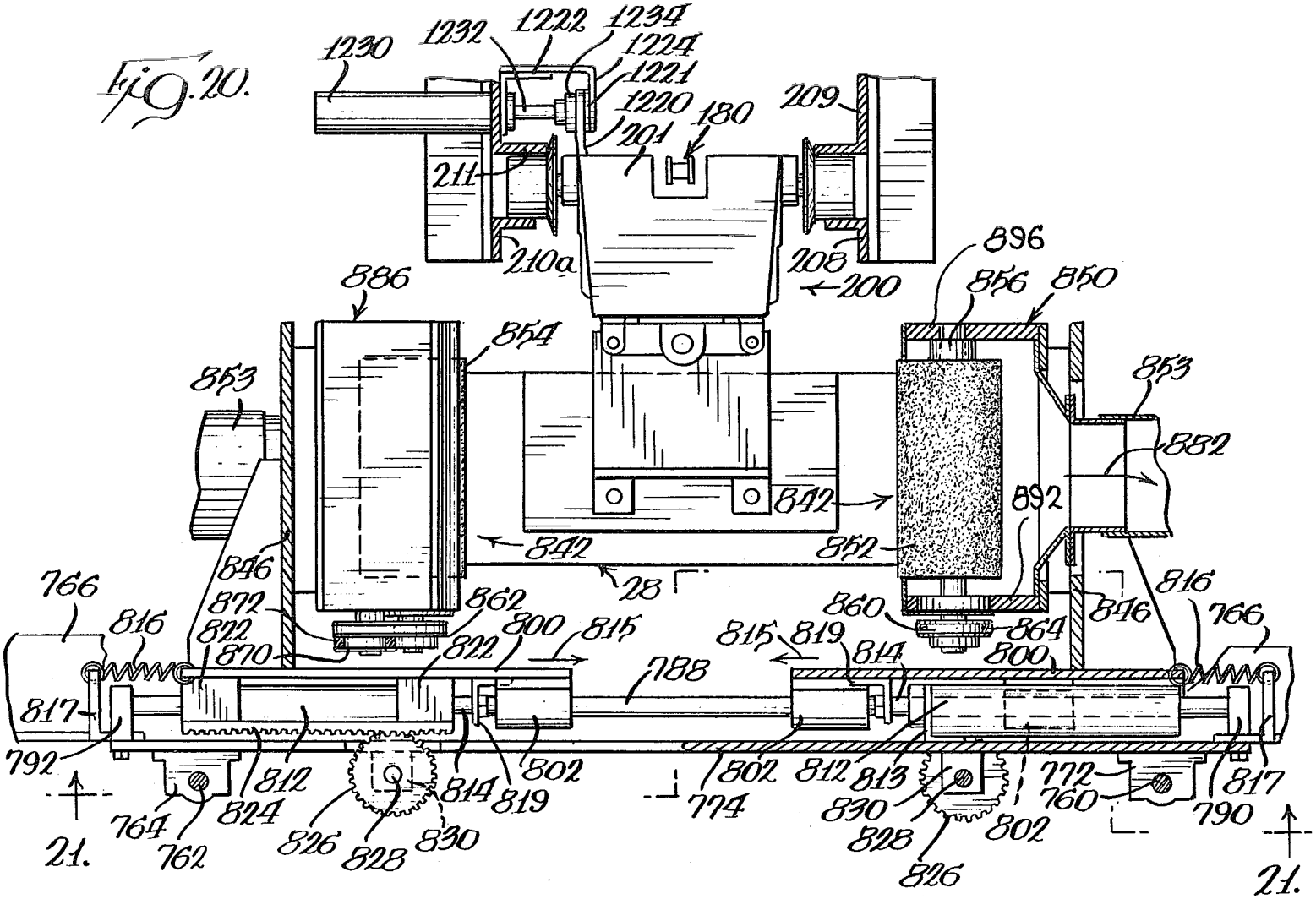
Figure 21:
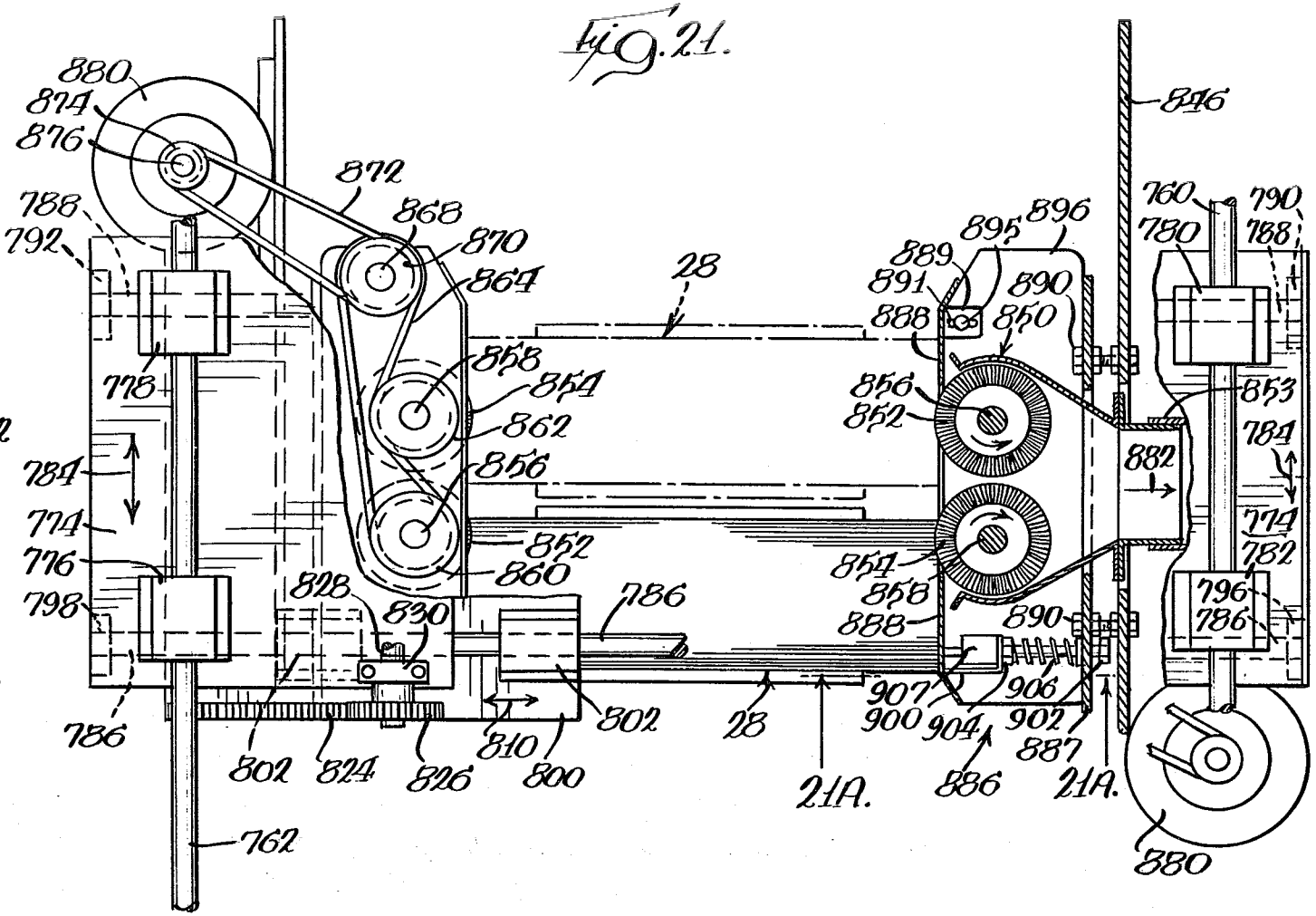
FIG. 21 is a fragmentary, cross-sectional view taken generally along the planes 21—21 in FIG. 20.

As best illustrated in FIGS. 19, 20 and 21, the end brush station VI includes a pair of support rods 760 and 762. As best illustrated in FIG. 19, the left-hand end of support rod 762 is carried in a bracket 764 which is mounted to a main frame angle 766. At the other end, rod 762 is carried in a bracket 768 which is mounted to a main frame angle 770.

Rod 760 is similarly supported to frame angles 766 and 770. As best illustrated in FIG. 20, the rod 760 is carried at one end in a bracket 772 mounted to the main frame angle 766. At the other end, rod 760 is similarly carried in a similar bracket (not visible in the figures) mounted to the main frame angle 770.

A movable support plate 774 is mounted on the pair of rods 760 and 762. To this end, the support plate 774 has a pair of spaced apart, downwardly depending bushings 776 and 778 in which rod 762 is slidably received. Similarly, on the other side, the plate 774 has a pair of downwardly projecting bushings 780 and 782 which are slidably received on the rod 760 as illustrated in FIG. 21. Thus, the plate 774 is reciprocable along the rods 760 and 772 in the direction indicated by the double-headed arrows 784 in FIG. 21. The mechanism for moving the base plate 774 along the rods 760 and 762 will be described in detail after the other structural features of the brush station VI have been described.

With reference to FIG. 19, a pair of rods 786 and 788 are seen to be disposed above the movable plate 774 and aligned generally transversely to the rods 760 and 762 that are disposed below the plate 774. As best illustrated in dashed lines in FIG. 21 and in solid lines in FIGS. 19 and 20, transverse rod 786 is mounted on the right-hand end to the end bracket 796 secured to the upper surface of plate 774 and is mounted at the left-hand end to bracket 798 secured to the upper surface of plate 774.

Similarly, rod 788 is secured on the right-hand end to bracket 790 mounted on the upper surface of plate 774 and is mounted at the left-hand end to bracket 792 secured to the upper surface plate 774.

With reference to the right-hand side of FIG. 20, a movable plate 800 is seen to be positioned over, and mounted parallel to, the plate 774 on the rods 786 and 788.

With reference to the left-hand side of FIG. 20, another movable plate 800 id disposed above, and parallel to, the movable base plate 774 and is also mounted on the pair of rods 786 and 788. Both movable plates 800 have the same structure, are supported in the same manner, and carry identical operating mechanisms. Thus, the structures carried by these plates 800 and associated with the left-hand and right-hand side of the end edge brush station VI (as viewed in FIG. 20) will be designated by the same numerals.

Each plate 800 is slidably disposed on the pair of rods 786 and 788 by means of downwardly depending bushings 802, one of which bushings 802 is illustrated in FIG. 20 in solid line as being mounted to rod 788 and one of which bushings 802 is shown in dashed line as also being mounted to rod 788. FIG. 21 illustrates one of the bushings 802 in solid line mounted to rod 786 and one of the bushings 802 in dashed line also mounted to rod 786. Thus, each plate 800 is movable along rods 786 and 788 as indicated by a doubled headed arrow 810 in FIG. 21.

Below each plate 800 is a pneumatic cylinder operator 812 of the single acting, spring-return type which is supported on the movable base plate 744 by means of a bracket 813. Each cylinder operator has a piston rod 814 which carries an angle 819 secured to the overlying movable plate 800. Thus, operation of the cylinder operator 812 will cause movement of the associated plate 800 along the pair of rods 786 and 788 in the direction indicated by arrow 815 in FIG. 20.

As best illustrated in FIG. 20, each upper plate 800 is biased outwardly by a spring 816 which is secured at one end to the plate 800 and at the other end to an upstanding angle bracket 817 which is in turn secured to the movable base plate 774. When the pressure is released from the pneumatic cylinders 812, the springs 816 will aid the internal spring return mechanisms of the cylinders in returning the plates 800 to the retracted positions (illustrated in solid lines in FIG. 20).

As best illustrated on the left-hand plate 800 in FIG. 20, a pair of downwardly projecting lugs 822 are mounted to the underside of the plate 800 along two opposing sides thereof. A rack 824 is secured to each pair of lugs 822 along each side and is engaged with a pinion gear 826. Each gear 826 is fixed to a single shaft 828 for rotation therewith. The shaft 828 is mounted below and to the movable base plate 774 by means of spaced-apart bearing brackets 830.

As best illustrated in FIG. 19, the shaft 828 below each movable plate 800 extends outwardly of the shaft support bracket 830 at one side of plates 800 and 774 and is operably received in an electric brake 840 that is mounted with angle 841 to plate 774. Actuation of the electric brake 840 will lock the pinion gear shaft 828 against rotation and maintain the plate 800 in a fixed position on the rods 786 and 788.

Projecting upwardly from each plate 800 is a vertical mounting plate 846 as best illustrated in FIGS. 19 and 20. The vertical mounting plate 846 supports a brush assembly 842 which includes a housing 850 connected to a flexible exhaust duct 853. Mounted within the housing 850 are a pair of oppositely rotatable brushes 852 and 854. Brush 852 is mounted to a shaft 856 and brush 854 is mounted to a shaft 858. The shafts 856 and 858 project below the housing 850 and carry pulleys 860 and 862 respectively.

The brushes may be made of any suitable material. It has been found that copper and brass fiber brushes function well and have the additional advantage of eliminating static charge build-up in the assembly.

As best illustrated in FIG. 21, an endless loop drive belt 864 is guided around the brush pulleys 860 and 862. As best illustrated in FIG. 19, the belt 864 is also trained around a pulley 866 mounted to shaft 868 in the bottom of housing 850. Shaft 868 carries another pulley 870 also mounted on shaft 868 and below the pulley 866.

Pulley 870 is driven by another endless loop belt 872 trained around a pulley 874 on a shaft 876 of a motor 880. The motor 880 is supported from vertical plate 846 and is operated by a suitable control system to rotate the brushes 852 and 854 against the end edges of the envelopes.

Particulate matter, vapors and other material in the region of the brushes 852 and 854 is carried through the housing 850 and to the flexible duct 853 under the influence of induced air flow in the direction of arrow 882 shown in FIGS. 21 and 20. The mechanism for effecting the induced air flow may be a conventional vacuum system.

In operation, the cylinder operators 812 are pressurized to move the two brush assemblies 842 against the end edges of the envelopes in batch 28 when the batch holding car 200 is properly positioned at the end edge brush station VI. This may be effected through the control system in response to the termination of the incremental movement of the conveyor by the Geneva drive mechanism or by other suitable means. In any case, the brakes 840 are maintained in a released state when the brushes are in the retracted position and a valve (not illustrated) in the pneumatic supply system for each pneumatic cylinder actuator 812 is opened to pressurize the cylinders 812 to drive the brushes against the batch of envelopes. At the same time, the motors 880 associated with each brush assembly 842 would be energized to rotate the brushes. The brushes will thus be rotating as they first make contact with the envelope batch 28.

The inward movement of the brush assemblies 842 against the envelope batch 28 is terminated when the reaction force on each brush assembly 842 reaches a certain value. To this end, a novel sensing mechanism is provided as will next be explained.

A shroud assembly 886 is mounted to the upstanding vertical plate 846 adjacent each brush assembly 842 as best illustrated in FIG. 21. The shroud assembly 886 includes a rear plate 887 by which the shroud assembly 886 is mounted to vertical plate 846 with four bolts 890. The bolts maintain the shroud assembly 886 at a preset distance from the vertical mounting plate 846. However, the present distance may be adjusted by appropriate adjustment of the bolts 890. The basic purpose of the adjustable bolt mounting structure is to provide a mechanism by which the shroud may be suitably aligned in a plane substantially parallel to the envelope end edges.

Figure 21A:
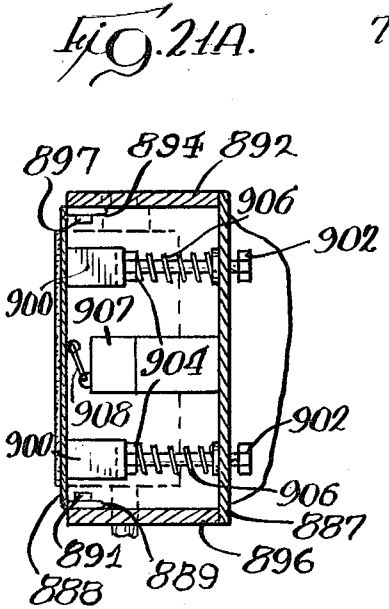
FIG. 21A is a fragmentary, cross-sectional view taken generally along the plane 21A—21A in FIG. 21.

As best illustrated in FIGS. 20 and 21, the brushes are seen to project a slight amount outwardly beyond the front of the shroud 886. With reference to FIGS. 21 and 21A, the front of the shroud 886 is defined by a bearing wall 888, the top of the shroud is defined by a top wall 896, the rear of the shroud is defined by rear wall 887, and the bottom of the shroud is defined by a bottom wall 892.

The bearing wall 888 is pivotably disposed in the housing 886. To this end, as best illustrated in FIGS. 21 and 21A, the front bearing wall 888 has a top lug 889 and a bottom lug 894 at one side of the shroud. As best illustrated in FIG. 21A, the top lug 889 is disposed adjacent the top wall 896 and the bottom lug 894 is disposed adjacent the bottom wall 892. The top lug 889 defines therein an elongate aperture 891 through which is received a pin 895 depending downwardly from the top wall 896. Similarly, the bottom wall 892 has an upwardly projecting pin 897 received in an elongate aperture (not visible in FIG. 21A) in the bottom lug 894. Thus, the front bearing wall 888 is free to pivot about an axis passing through the aligned, upper and lower pins 895 and 897, respectively.

With continued reference to FIGS. 21 and 21A, it is seen that, on the end of the bearing wall 888 opposite the lugs 889 and 894, a pair of L-shaped brackets 900 are secured to the inner surface of the front bearing wall 888. Adjacent the brackets, and adapted to abut each bracket, is a bolt 902 which is received in a suitable aperture within the rear wall 887 of the shroud assembly. A nut 904 is mounted at the end of each bolt 902 for contacting the L-shaped channel 900.

A coil suppression spring 906 is provided around each bolt 902 between the nut 904 on one end of the bolt and the rear wall 887. Thus, the spring 906 biases the nut 904 on the end of each bolt 902 against the U-shaped bracket. This forces the front bearing wall 888 of the shroud assembly outwardly toward the batch of envelopes. The limit of outward movement of the front bearing wall 888 is reached when the heads of the bolts 902 contact the rear wall 887.

Disposed between the two bolts 902, and mounted to the rear wall 887 of the shroud assembly is a limit switch 907. The limit switch 907 has an actuating arm 908 which is adapted to be engaged by the front bearing wall 888 as it pivots inwardly in response to the force of the batch of envelopes.

When the batch of envelopes 28 is initially incremented to its proper location within the end brush assembly station VI, the reciprocable plate 774, on which the brush assemblies are carried, is initially positioned at a "home" position along the rods 760 and 762 (FIG. 19). In this position, the shroud assembly is laterally displaced towards one end relative to the batch of envelopes as shown for the envelopes illustrated in solid line in FIG. 21. With the brush assemblies in this initial position, the end edges of the envelopes in the batch 28 are aligned with the flat portion of the bearing wall 888 adjacent the bias springs 906 and the limit switch 907.

As the shroud assembly is moved inwardly with the entire brush assembly by the above-discussed pneumatic cylinders 812, the end edges of the envelopes in the batch 28 cause the front bearing wall 888 to pivot about the pins 895 and 897 and to actuate the switch 907. To the extent that some of the envelopes in a large batch may also impinge upon the brushes 854 or 852, the fibers in those brushes bend inwardly so that the other envelopes in the batch will still be permitted to contact the bearing wall 888 of the second assembly and to pivot the bearing wall inwardly to actuate the switch 907.

The actuation of the limit switch 907 energizes the above-discussed electric brakes 840 to then hold the brush assembly at the extended position against the batch of envelopes. The cylinder operators 812 remain pressurized.

When both end edge brush assemblies 842 have been moved properly against the oppositely facing ends of the envelope batch 28 and the associated electric brakes 840 applied to maintain the brush assemblies with proper force against the batch, the brushes are moved along the envelope end edges in a plane perpendicular to the envelopes in a direction indicated generally by the double headed arrows designated by numeral 784 in FIG. 21. This is effected by moving the entire brush assembly, as mounted on the movable main mounting plate 774, along the rods 760 and 762. The mechanism for reciprocating the brushes in this manner will next be explained.

With reference to FIG. 11, a plurality of pulleys 920 are mounted adjacent the stations III, IV, and V, to suitable frame members (which have been omitted from the schematic illustration in FIG. 11). A cable 922 is secured to the outer plate 608 of the end edge first heating station IV as indicated generally by numeral 924. The cable 922 is guided around the pulleys 920 and is wound around and connected to a capstan 926. Capstan 926 is mounted to a bracket 927 on the machine frame.

A sprocket 928 is connected to the capstan 926 for rotation therewith. A length of chain 932 is secured at one end to plate 930 on the movable brush assembly of station VI and is trained around the sprocket 928. The chain 932 extends alongside the end edge brush assembly at station VI and is secured at the other end to a cable 933 wrapped around a counterbalance clockspring 934 and secured thereto at point 935. The clockspring 934 is mounted in a fixed position relative to the movable brush assembly of station VI by means of suitable support members (not illustrated).

When the end edge first heating station IV is stationary at the "home" position and maintained thereby by the electric brake on clutch 712, the capstan 926 is prevented by the taut cable 920 from rotating in the counterclockwise direction as viewed in FIG. 11. This prevents the connected sprocket 928 from rotating in the counterclockwise direction. Therefore, the end brush assembly at station VI is maintained, against the weight of gravity, in the position on rod 760 and 762 as illustrated in FIG. 11.

The weight of the brush assembly, exerted on chain 932 at plate 930, extends to rotate the sprocket 928 engaged with the chain in a counterclockwise direction as viewed in FIG. 11.

At the other end, the clockspring 934 is arranged to provide an opposing torque that tends to rotate the clockspring 934 in the clockwise direction indicated by the arrow 936 in FIG. 11. This tends to pull the cable 933 around in the clockwise direction and opposes the counterclockwise rotation force of the brush assembly weight on the upper sprocket 928. The force thus transmitted from clockspring 934 acts upwardly on brush assembly plate 930. However, the torque of the counterbalance clockspring 934 is chosen to be slightly less than that required to overcome the vector component of the station VI weight acting downwardly parallel to the rods 760 and 762. Thus, were it not for the restraint of cable 920 on capstan 926, the brush assembly of station VI would slide downwardly on the rods 760 and 762 to the extent permitted by the length of the rods or by the limit of the unwound cable length 933 on the clockspring 934.

When the end edge heating assembly at station IV is moved to the left during the reciprocation of the heating platens, the cable 922 effectively lengthens relative to the capstan 926 thus permitting the capstan 926 to be rotated in the counterclockwise direction (as viewed in FIG. 11) by the sprocket 928 under the influence of the weight of the end edge brush assembly at station VI acting on chain 932. The end edge brush assembly at station VI thus slides downwardly under the influence of its weight (minus the opposing counterbalance force of clockspring 934) until the station IV heating assembly exterior plate 608 reaches the extreme left-hand position of its travel and starts to return to the right.

As the station IV exterior plate 608 starts to return to the right, the cable 922 is necessarily pulled with the plate 608. The cable 922 thus rotates the capstan 926 at station VI in the clockwise direction. This causes the connected sprocket 928 to rotate in the clockwise direction to move the chain length 932 and then pull the end edge brush assembly at station VI upwardly along the rods 760 and 762. Owing to the counterbalance torque applied through clockspring 934 to the cable 933 and chain 932, the required tension in cable 920 is substantially reduced.

Thus, it is seen that as the heating platen assemblies at station IV and V are reciprocated during the heating step, the end edge brush assembly at station VI is also necessarily reciprocated at the same frequency (but over a longer stroke).

At the termination of the reciprocating movement, the control system actuates the end edge brush assembly brakes 840 to unlock the brushes at the inwardly extending positions against the envelope batch and depressurizes the end edge brush assembly cylinders 812 so that the springs 816 retract the brushes to the clearance position on either side of the envelope batch. Simultaneously, the control system de-energizes the brush drive motors 880.

The envelope batch 28 is incremented by the conveyor from the end edge brushing station VI to a jogging station indicated generally by VII in FIG. 11. It is to be noted that, as the holding car 200 carries the envelope batch 28 from the upper horizontal path in the conveyor around the conveyor idler sprocket 244 and into the lower horizontal path at the jogging station VII, the batch of envelopes is necessarily inverted.

Prior to heating the inverted top edges of the envelopes in subsequent stations VIII and IX, it is desirable to align the inverted top edges of the envelopes in a common horizontal plane. To this end, the jogging station VII includes a conventional vibrating jogger device 950 mounted on a support and positioning mechanism 600' that is substantially identical to the mechanism 600 in heating station IV. The mechanism 600' is oriented in station IV to provide movement parallel to the plane of the conveyor loop whereas the mechanism 600 is oriented to provide movement perpendicular to the plane of the conveyor loop. The elements in mechanism 600' are designated with the same numerals used for the corresponding elements in mechanism 600.

Figure 22:
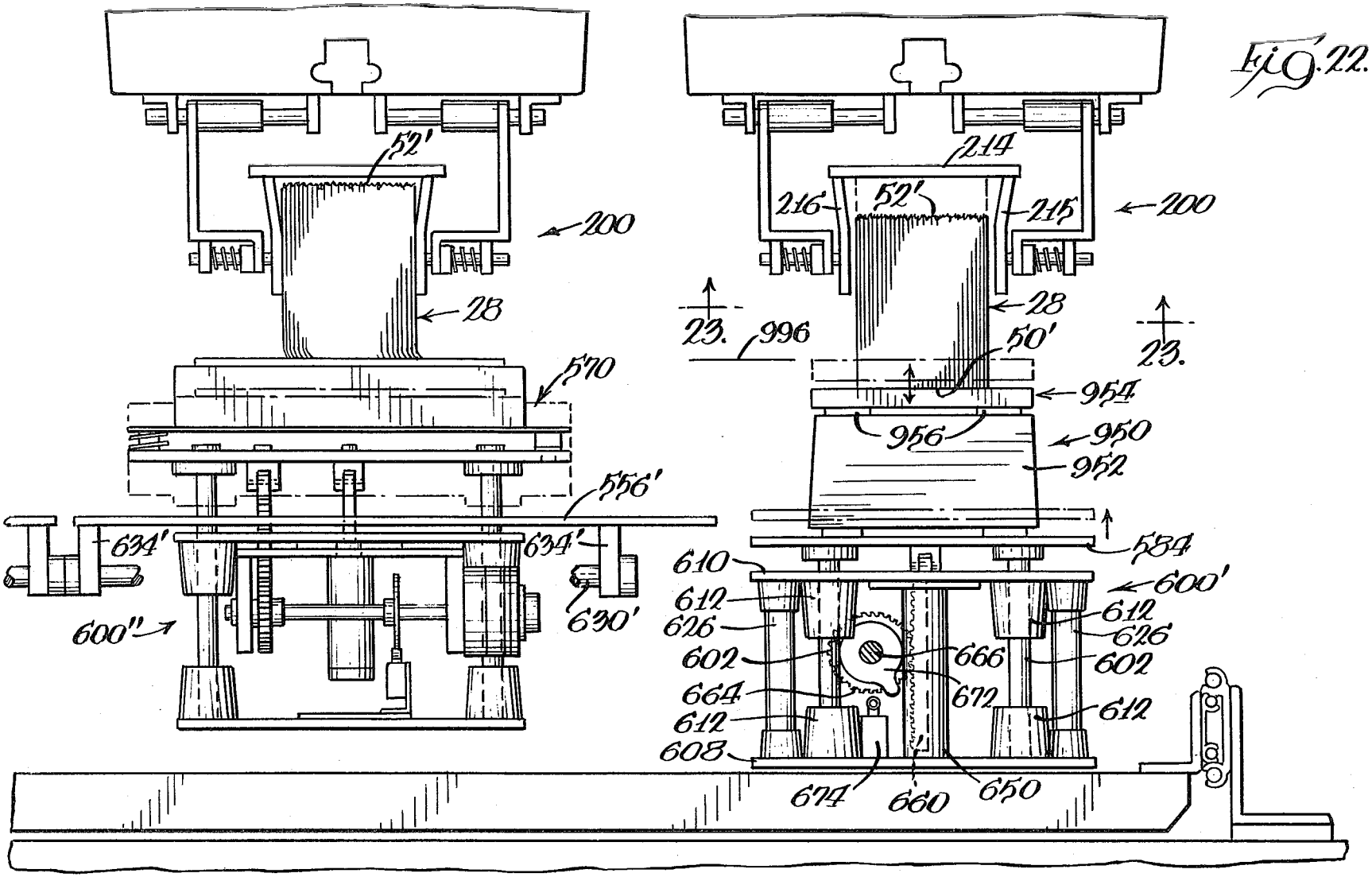
FIG. 22 is an enlarged, fragmentary, side elevational view of the envelope jogging station and the inverted envelope top edge first heating station of the apparatus schematically illustrated in FIG. 11.
Figure 23:
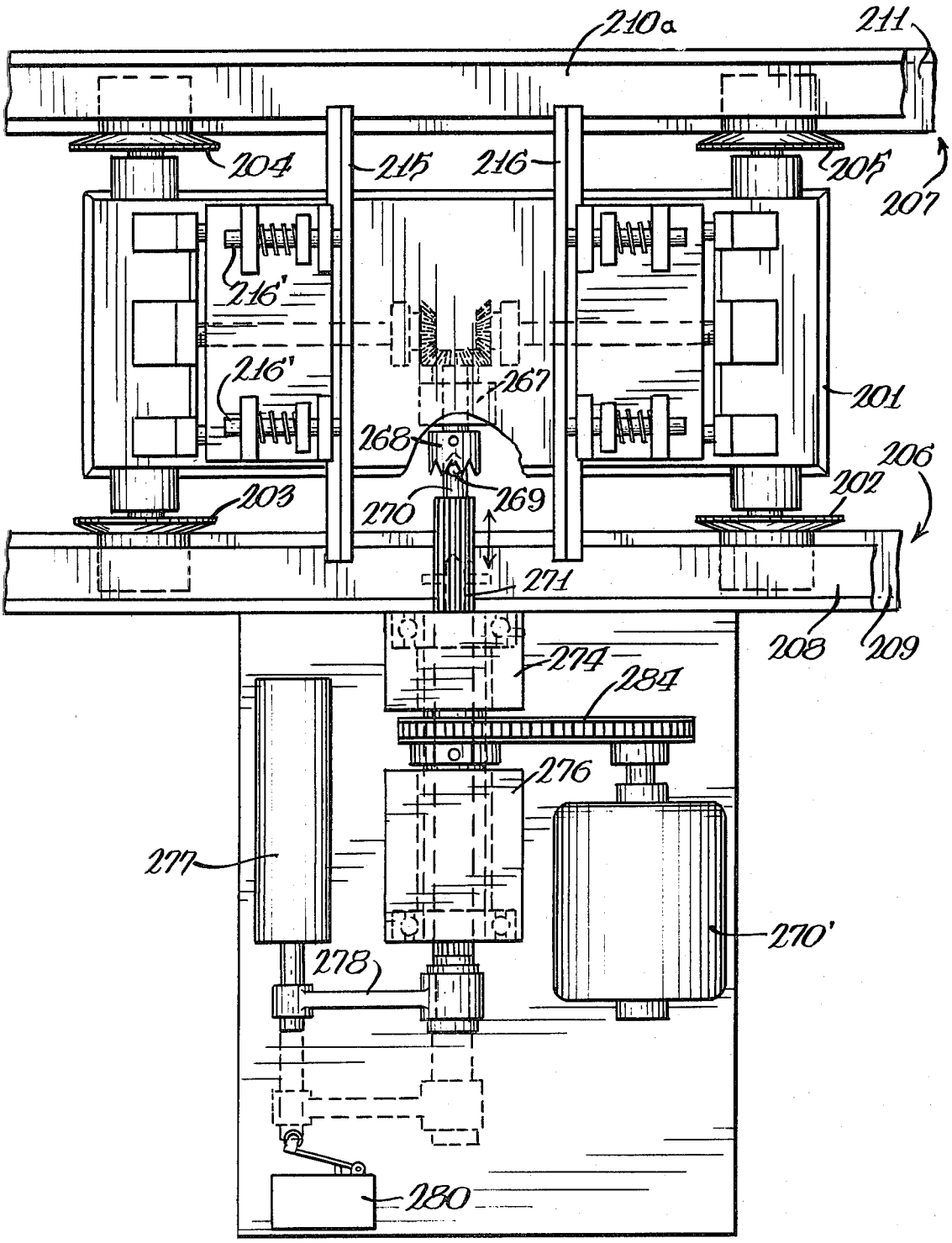
FIG. 23 is a bottom plan view taken generally along the plane 23—23 in FIG. 22.

The jogging station VII comprising the jogger 950 and jogger supported and positioning mechanism 600' is shown in the right-hand side of FIG. 22. The jogger 950 may be of suitable conventional design having a vibrating jogging surface 954 mounted on a base 952 by means of posts 956. The base 952 includes the conventional eccentric drive mechanism for vibrating the support member 954 with at least some component of vertical motion.

The jogger 950 is mounted on the movable plate 584 of the support and positioner mechanism 600'. The plate 584 is disposed below and parallel to lower horizontal path of the conveyor. The structure and operation of the mechanism 600' is substantially identical to mechanism 600 in station IV except that mechanism 600' has only one rack and pinion 664 and 660, respectively, whereas mechanism 600 has a pair of spaced-apart rack and pinion assemblies. The mechanism 600' is mounted to a bottom main frame member 1060 through the plate 608.

When a envelope batch holding car 200 is moved into position at the jogging station VII, the "inverted" bottom edges of the envelopes, indicated by numeral 52' in FIG. 22 are adjacent the surface of the plate 214 of the car 200. It is desired to release the envelope batch 28 from between the clamp members 215 and 216 to permit the batch 28 to drop a short distance, under the influence of gravity, to the vibrator plate 954 of the jogger 950 which is supported on the plate 584 in the lowered position illustrated in solid line in FIG. 22.

To this end, the clamping mechanisms on the holder car 200 are released to permit the batch 28 to drop therefrom onto the jogger 950. The clamping structure and operating mechanisms for the car 200 has been described above in detail with reference to FIGS. 13 and 14. Attention is directed to that discussion for the details of the structure.

An envelope batch clamp/unclamp motor, identical to the motor 400 described above with reference to the loading station I, is proVided at station VII (though it is not visibile in FIG. 11 or in FIG. 22). Associated with the clamp/unclamp motor are the disengageable drive coupling mechanism and pneumatic cylinder reciprocation mechanism that are also present at station I and that were described in detail with reference to station I (as particularly illustrated in FIG. 13).

The motor and drive coupling at the jogging station VII are actuated by the apparatus control system when the incoming batch of envelopes has been properly incremented to the station VII. The clamp/unclamp motor at station VII has a revolution counter that counts the number of revolutions to a predetermined "full open" clamp position. As the clamps open, the envelopes drop to the jogger plate 954. When the revolution counter senses that the clamps have been opened to the full open position, the control system switches off the motor and actuates the jogger 950 to energize for a predetermined time period.

Alternatively, the jogger 950 may be continuously energized. In any case, after a predetermined time interval during which the batch 28 is vibrated on the jogger 950, the control system causes the jogger 950 to be elevated to the position shown in dash line in FIG. 22 by the previously described pneumatic cylinder actuator 650.

The jogger is elevated until the inverted top edges of the envelopes hit the clamp assembly plate 214. At that point the clamps are closed against the envelope batch by a suitable actuation system. One such system includes a pressure switch (not illustrated) connected to the pneumatic circuit which pressurizes the pneumatic cylinder actuator 650. When the envelopes hit the clamp assembly plate 214, the pressure within the pneumatic cylinder actuator 650 increases. The pressure switch would be set to be actuated at an increased pressure level corresponding to the point at which the envelopes hit the plate 214. The pneuamtic cylinder actuator 650 would remain pressurized but the actuation of the pressure switch would initiate reclamping of the envelope batch at the raised position.

Alternatively, a mechanical microswitch may be provided at the elevated position of the jogger to similarly actuate reclamping of the envelope batch.

As a third alternative, the limit switch 674 would be positioned to be actuated by the cam 672 on the rack and pinion mechanism below the jogger 950. Actuation of the limit switch 674 would also initiate reclamping of the batch. In any of the alternatives described above, an electric brake (not visible in FIG. 22), similar to the electric brake 670 in the positioning mechanism 600 in the heating station IV, could also be provided, if desired, to hold the jogger 950 in the elevated position as the envelope batch is being reclamped.

Regardless of what switching mechanism is used to sense the raising of the jogger 950 to the proper elevation, the clamp/unclamp motor is next actuated, through the control system, to rotate in the proper direction for moving the holder clamps against the batch of envelopes.

A timer is actuated with the motor and the timer permits the motor to run for a predetermined time, say about three seconds, to achieve full clamping of the envelope batch. When the timer has run out, the control system de-energizes the motor, actuates the cylinder (identical to cylinder 277 in FIG. 13) to withdraw the drive shaft from the holder car 200 and also actuates a suitable electric solenoid valve in the pneumatic control system for the jogger cylinder operator 650 to depressurize the cylinder 650 and permit the jogger 950 to be returned to the lowered or "home" position.

If an electric brake is incorporated to hold the jogger in the elevated position (by preventing further rotation of the shaft 666, and hence preventing movement of the rack 660 and of the connected support plate 584 from the elevated position), the electric brake would also be released after the clamp/unclamp motor has reclamped the envelope batch in the holder car 200.

After the batch 28 has been reclamped in car 200, it is ready to be indexed to the next station for further processing. Consequently, the batch holder car 200 is then incremented by the conveyor to the envelope top edge first heating station VIII as illustrated in FIG. 11 and as illustrated on the left-hand side of FIG. 22.

The heating station VIII has a heating platen assembly 570 that is identical to the heating platens used in the envelope end edge first and second heating stations IV and V discussed above in detail with reference to FIGS. 17 and 18.

The heating platen assembly 570 in station VIII is mounted on a support and positioner mechanism 600" which is substantially identical to the positioner mechanism 600' at the jogging station VII and discussed above with reference to the right-hand side of FIG. 22. Consequently, the structural elements of mechanism 600" in station VIII are designated by the same numerals as applied to the corresponding elements of the elements of mechanism 600'.

The mechanism 600" is rotated 90 degrees relative to the orientation of the mechanism 600' and is slidably mounted to rods 630' secured to a stationary horizontal plate 556' with brackets 634'. The mounting structure of plate 556' and rods 630' is identical to that of heating stations IV and V except that the plate 556' is horizontal in station VIII and vertical in stations IV and V. At station VIII, the stationary plate 556′ is supported, through brackets 634′, to frame member 1060, by means of posts 1050.

At the inverted envelope top edge first heating station VIII, the heating platen assembly 570 is moved against the inverted top edges of the envelopes in the batch 28 by the pneumatic cylinder 650 in basically the same manner as is done in the envelope end edge first and second heating stations IV and V as explained above.

With the top edge heating platen assembly 570 contacting the inverted top edges of the envelopes and bending the envelopes inwardly, the assembly 570 is reciprocated to reverse the bend of the envelopes. This is accomplished by means of a drive system which will next be described.

As illustrated schematically in FIG. 11, a combination electric clutch and brake 1000, similar to the combination clutch and brake 712 that was described above with reference to FIG. 17, is supported on lower horizontal frame member 1060 and carries a sprocket (not visible in FIG. 11) engaged with the drive chain 740. On the driven side of the clutch 712, the clutch carries a sprocket 1006 engaged with an endless loop chain 1008 trained around a sprocket 1010 mounted for rotation on shaft 1012 which is supported in suitable bearing members (not visible in FIG. 11). The shaft 1012 carries another sprocket (not visible in FIG. 11) around which is trained an endless loop chain 1014 which is engaged with sprocket 1016 mounted on a shaft 1018 journalled for rotation in bearing bracket 1017 on plate 556.

Mounted to shaft 1018 is a first crank arm 1020 which is pinned on its distal end to a second crank arm 1022 by means of pin 1024. The second crank arm 1022 is secured with pin 1025 to the exterior side plate 608 of the heating platen positioner 600 at the inverted top edge first heating station VIII. Actuation of the combination electric clutch and brake 1006 to engage the clutch and release the brake will permit the above-described chain drive and linkage mechanism to reciprocate the heater platen positioner 600″ in station VIII.

After the reciprocation at station VIII is completed, the envelope batch 28 is moved by holder car 200 to the top edge second heating station IX as illustrated schematically in FIG. 11.

Station IX is substantially identical to station VIII and thus the structural elements of station IX are designated by the same numerals as the corresponding elements in station VIII. The heater platen assembly support and positioner 600″ in heating station IX is rigidly connected to the adjacent support positioner 600″ at heating station VIII by means of a rigid rod 1052 which is secured through a swivel joint to the exterior plates 608 at each station. Thus, reciprocation of the positioner 600″ in heating station VIII by the drive mechanism will necessarily cause the positioner 600″ in the heating station IX to reciprocate in tandem.

As illustrated in FIG. 11, the components on stations VII, VIII, and IX, are mounted a horizontal base member 1060 which is part of a sliding drawer system that permits the components to be pulled out from underneath the lower horizontal conveying path. To this end, roller bearing guides 1062 are provided at each end of the horizontal base member 1060.

From the inverted envelope top edge second heating station IX, the envelope batch 28 is transported in car 200 by the conveyor to the final processing station, the inverted envelope top edge brush station X.

Figure 24:
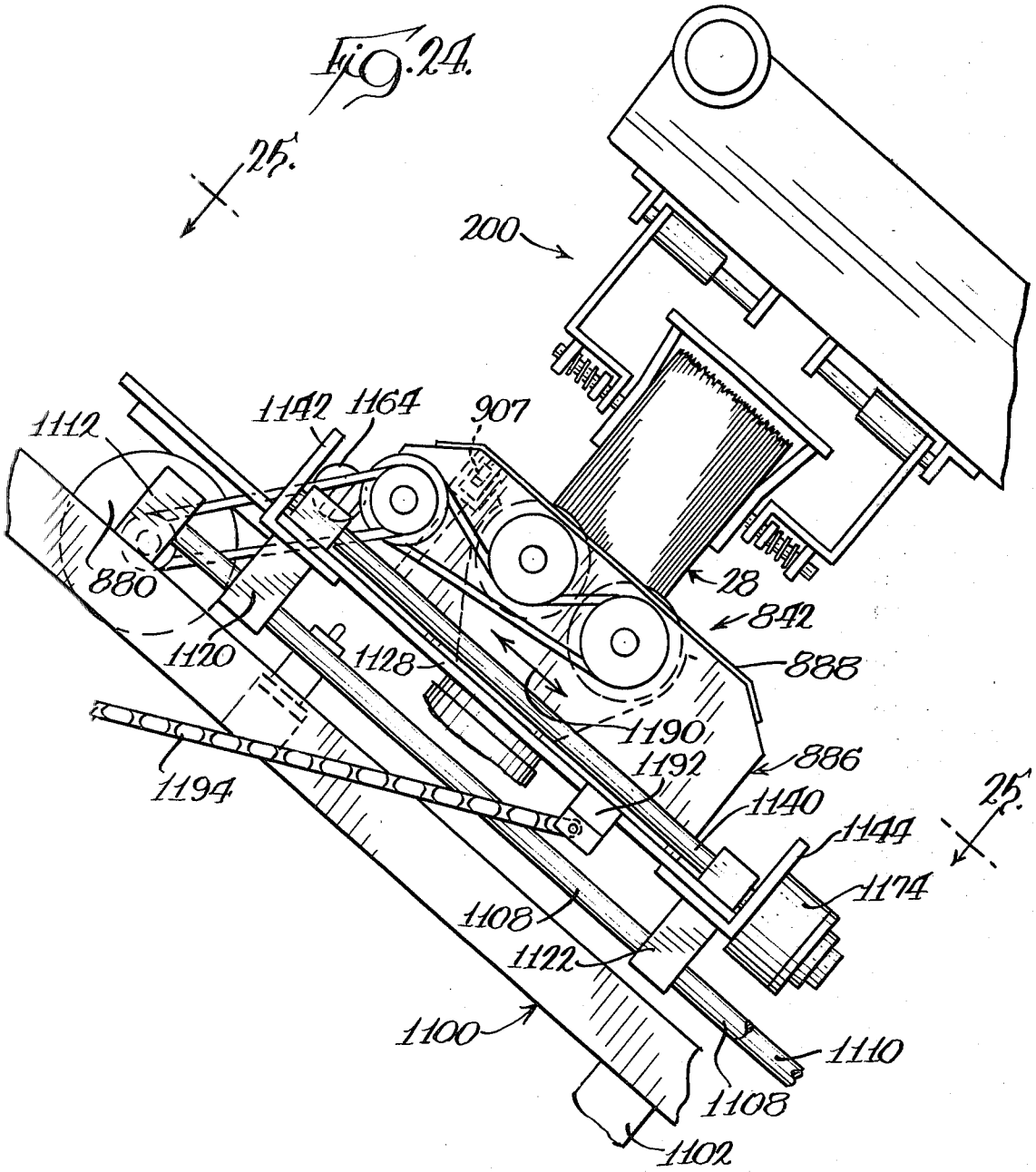
FIG. 24 is an enlarged, fragmentary, side elevational view of the inverted envelope top edge brush station of the apparatus illustrated schematically in FIG. 11.
Figure 25:
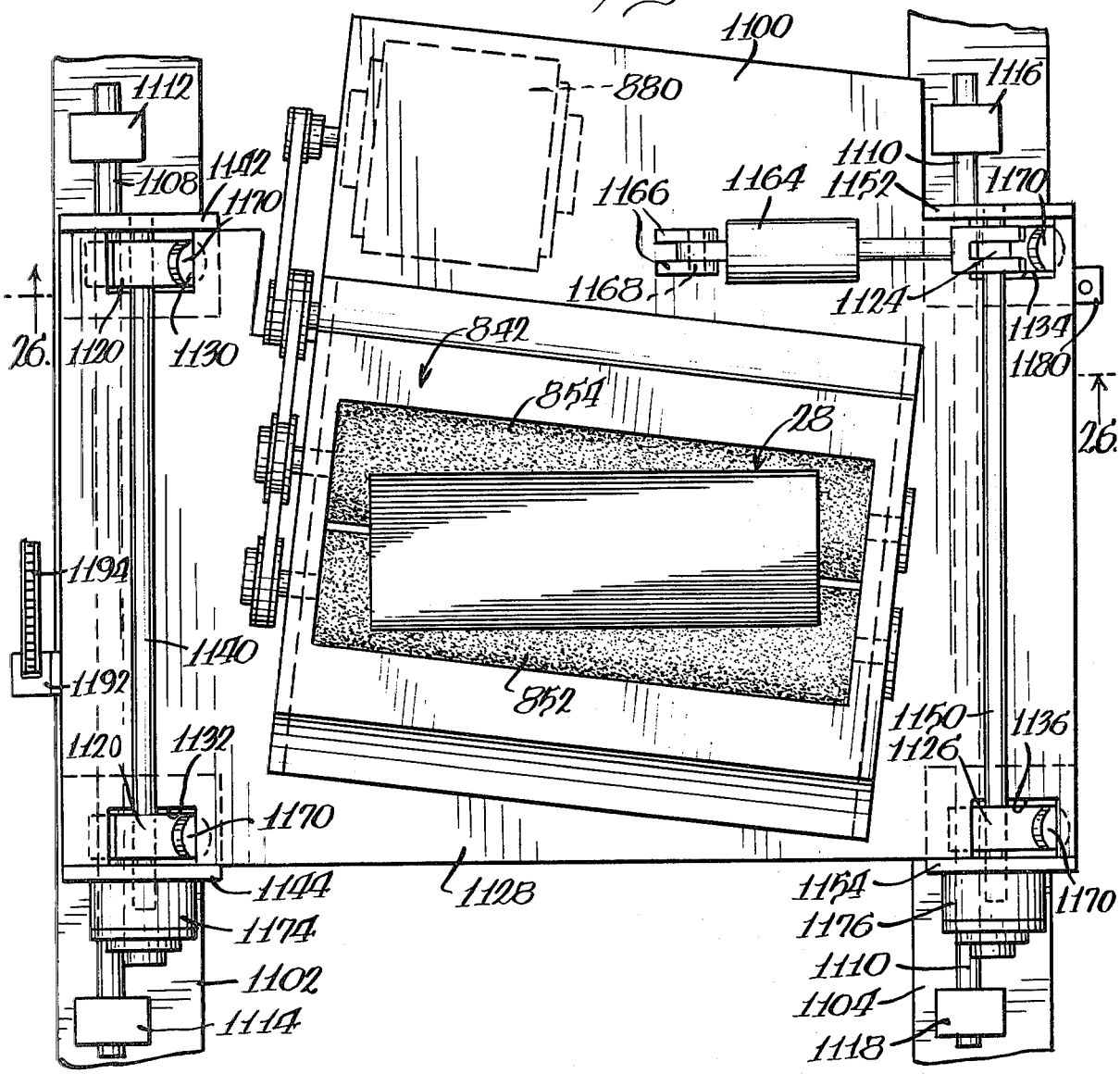
FIG. 25 is a fragmentary view taken along the plane 25—25 in FIG. 24.
Figure 26:
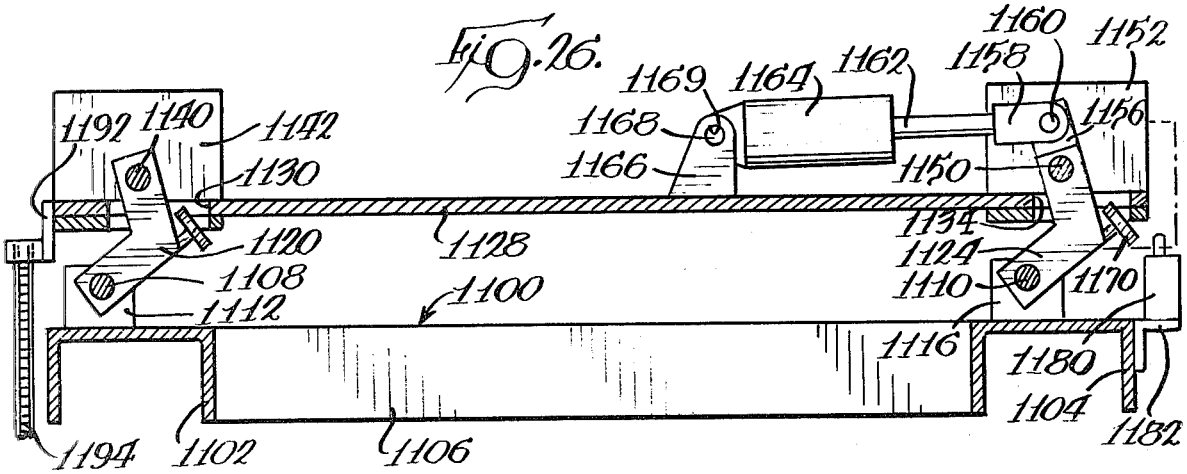
FIG. 26 is a fragmentary, cross-sectional view taken generally along the plane 26—26 in FIG. 25.

FIG. 24 shows an enlarged view of station X. A fixed, slanted frame 1100 is mounted to a suitable vertical frame 1101. As best illustrated in FIGS. 25 and 26, the support frame 1100 includes two spaced-apart channels 1102 and 1104 joined by one or more cross members 1106. A pair of rods 1108 and 1110 are mounted above and to the frame 1100. Specifically, the rod 1108 is mounted to channel 1102 by lug 1112 at one end and by lug 1114 at the other end. Similarly, rod 1110 is mounted to channel 1104 by means of lug 1116 at one end and lug 1118 at the other end.

Slidably disposed on rod 1108 are a pair of spaced-apart angled crank arms 1120 and 1122. Crank arm 1120 is shown in side elevation in FIG. 26. Although angled crank arm 1122 is not shown in side elevation in the Figures, the configuration is identical to that of crank arm 1120.

Slidably disposed on the other rod 1110 are a pair of spaced-apart angled crank arms 1124 and 1126. Crank arm 1124 is shown in side elevation in FIG. 26. Although crank arm 1126 is not shown in side elevation in the Figures, it has a configuration identical to that of crank arm 1124.

A movable plate 1128 is positioned above, and generally parallel to, the main frame 1100. The plate 1128 has apertures 1130, 1132, 1134, and 1136 for receiving therethrough the upwardly projecting end portions of the crank arms 1120, 1122, 1124, and 1126, respectively. The upper end portions of crank arms 1120 and 1122 are rigidly fixed to a rod 1140 which is secured at one end to mounting angle 1142 on plate 1128 and at the other end to mounting angle 1144 as plate 1128.

Similarly, the upper ends of crank arms 1124 and 1126 are rigidly fixed to a rod 1150 which is mounted at one end in an upstanding angle 1152 on plate 1128 and at the other end in an upstanding angle 1154 on plate 1128.

As best illustrated in FIG. 26, crank arm 1124 has a reduced thickness terminal portion 1156 for being connected to a bracket 1158 by means of pin 1160. The bracket 1158 is secured to a piston rod 1162 associated with a pneumatic cylinder operator 1164. The pneumatic cylinder operator 1164 is pivotally mounted to an upstanding pair of support lugs 1166 on plate 1128 by means of a shaft 1168 which is journalled in bores 1169 of lugs 1166.

Thus, operation of the pneumatic cylinder operator 1164 will pivot crank arm 1124 about rod 1110 to cause the plate 1128 to be raised or lowered relative to the main frame 1100. It is to be noted that the plate 1128 may also be reciprocated parallel to the main frame 1100 on the rods 1108 and 1110.

Wheel-like bearings 1170 are provided on the bottom of each crank arm. These hold the plate 1128 at a predetermined elevation from the main frame 1100 when the plate 1128 is lowered and in the normal, centered position relative to its range of travel along the rods 1108 and 1110. These bearings 1170 also accommodate the reciprocation of the plate 1128 relative to the underlying frame 1100.

An envelope edge brush assembly 842 is mounted to the upper plate 1128 as clearly shown in FIGS. 24 and 25. The assembly 842 is substantially identical to the envelope end edge brush assembly 842 employed at the end edge brushing station VI and described above in considerable detail with respect to FIGS. 9–21. Accordingly, elements of the envelope edge brush assembly 842 illustrated in FIGS. 24 and 25 are indicated with the same numerals as the corresponding elements of the brush assembly 842 in FIGS. 19-21.

The brush assembly 842 in FIGS. 24 and 25 is seen to be set at an angle on mounting plate 1128 with respect to the planes of the envelopes in the batch 28. In contrast, the brush assembly 842 at the end edge brush station VI is aligned so that the longitudinal axes of the brushes are substantially parallel to the planes of the envelopes. Since the brushes 852 and 854 must cover the entire length of the inverted top edge of each envelope in the batch 28, the brushes at this inverted top edge brushing station X typically have a greater length than the corresponding brushes in the end edge brushing station VI.

In operation, the control system causes a suitable valve (not illustrated) in the pneumatic system supplying the pneumatic cylinder 1164 to pressurize the cylinder and move the plate 1128 towards the envelopes in the batch 28. As the front bearing wall 888 of the shroud 886 bears against the inverted top edges of the envelopes in the batch 28, the limit switch 907 (shown in dashed lines in FIG. 24) is actuated in the same manner as with the brush assembly 842 in the end edge brush station VI described above with reference to FIGS. 19-21. The switch 907 is incorporated in the control circuit for the pneumatic cylinder operator 1164 and to a braking system described hereinafter.

Depressurization of the pneumatic cylinder 1164 when the brushes are extended against the envelopes would permit the reaction force of the envelopes to push the brush assembly 842 and the supporting plate 1128 away from the envelopes toward the main frame 1100. To prevent this occurrence, an electric brake 1174 is mounted to angle 1144 and operably connected to rod 1140. Similarly, an electric brake 1176 is mounted to angle 1154 and operably connected to rod 1150. Actuation of the shroud pressure switch 906, through a suitable control circuit, energizes the brakes 1174 and 1176 to restrain the rods 1140 and 1150 from rotating relative to their associated angles 1144 and 1154. Since the crank arms 1120, 1122, 1124, and 1126 are fixed to the rods 1140 and 1150, the rods must rotate about their longitudinal axes as the links are lowered from the elevated positions shown in FIG. 26. Energizing the brakes 1174 and 1176 to restrain the ends of the rods 1140 and 1150, respectively, from rotation will thus prevent the crank arms from lowering on the rods 760 and 762.

After the brush assembly 842 has been positioned properly against the inverted top edges of the envelopes in the batch 28, the brushes are reciprocated in a plane generally parallel to the inverted side edges of the envelopes in a direction generally perpendicular to the planes of the envelopes as indicated by double headed arrow 1190 in FIG. 24. It is to be remembered that the upper plate 1128, supported on the crank arms 1120, 1122, 1124, and 1126, is movable on the support rods 1108 and 1110 so as to move the edge brush assembly 842 in the desired direction.

To move the plate 1128, a lug 1192 is provided on the side of the upper plate 1128 and a chain 1194 is secured to the lug 1192. As best illustrated in FIG. 11, a length of chain 1194 is trained around a sprocket 1195 on frame 1100 and is secured at the other end to a cable 1197 that is wound around a counterbalance clockspring 1198 and secured thereto at 1200. The clockspring 1198 is mounted to a suitable fixed frame member 1199 and functions to apply a torque in the clockwise direction as viewed in FIG. 11 and as indicated by the arrow 1202.

A capstan 1204 mounted to the sprocket 1196 for rotation therewith. A cable 1206 is wound on and secured to the capstan 1204. The cable 1206 is also trained around an idler pulley 1208 on the frame and secured at the other end to the heating platen support and positioner assembly 600" in station IX at 1210.

With reference to FIGS. 11 and 24, the counterbalance clockspring 1198 exerts a clockwise torque to pull the cable 1197 in a direction tending to raise the inverted envelope top edge brush assembly at station X against its own weight on the rods 1108 and 1110. However, the counterbalance torque is not alone sufficient to actually lift the assembly at station X. Thus, unless restrained by the cable 1206 acting through capstan 1204 connected to sprocket 1195, the brush assembly at spraying station X would slide downwardly to the end of the permitted travel on the rods 1108 and 1110.

When the inverted envelope top edge heating platen assemblies 570 at stations VIII and IX are reciprocated by the drive chain and linkage system described in detail above, the end of cable 1206 that is secured at 1210 to the station IX positioner 600" is necessarily reciprocated also. When the positioning assembly 600" is moved to the left, the cable 1206 is effectively lengthened relative to the capstan 1204. Therefore, the weight of the assembly at brush station X, acting through chain 1194 around sprocket 1196, can rotate the capstan 1204 in the clockwise direction as viewed in FIG. 11. As this occurs, the chain 1194 is pulled by the assembly at station X so as to unwind a portion of the cable 1197 against the oppositely directed torque of clockspring 1198.

Movement of the heating platen positioner 600" at station IX to the right pulls the cable 1206 to the right. This causes the capstan 1204 to rotate in the counterclockwise direction as viewed in FIG. 11. Since the sprocket 1195 is fixed for rotation with the capstan 1204, the sprocket 1195 also rotates in the counterclockwise direction to pull chain 1194 so as to raise the brush assembly at station X. As chain 1194 turns sprocket 1196, a portion of the length of the attached cable 1197 is taken up on the clockwise biased clockspring 1198. The torque furnished by the counterbalance clockspring 1198 in the clockwise direction decreases the amount of tension to which the cable 1206 must be subjected in raising the brush assembly at station X.

The top edge brushing step is continued for a predetermined time period by the control system. At the termination of the period, the electric brakes 1174 and 1176 are de-energized from a signal from the control system. At the same time, a control system signal initiates the operation of an electric solenoid air supply valve (not illustrated) in the pneumatic supply system for the pneumatic operator 1164 to depressurize the single acting, spring-return cylinder to permit the plate 1128 to move downwardly under its own weight towards the main frame 1100, thereby moving the brush assembly 842 away from the inverted top edges of the envelopes and establishing a clearance.

As best illustrated on the right-hand side in FIG. 26, a limit switch 1180 is mounted to a bracket 1182 carried on channel 1104. The limit switch 1180 is positioned to be contacted by the underside of angle 1152 carried on top plate 1128 as the top plate 1128 is moved to the retracted position toward the frame 1100.

The switch 1180 senses the full retraction of the end edge brush assembly support plate 1128 to the "home" position. The switch actuation in the "home" position is treated by the control system as a permissive condition for the further incremental movement of the conveyor.

With the plate 1128 in the retracted position, the brush assembly 842 is located away from the envelope batch 28 to provide sufficient clearance to allow the envelope batch 28 to be moved to the next station.

The envelope batch 28 is moved in the holding car 200 to the loading/unloading station I. At this location, the batch of completely opened envelopes is removed from the holding car 200. To this end, the transfer device 24 has already been positioned properly at station I since a batch of sealed envelopes had been transferred by the device 24 to the immediately preceding car 200.

At station I, the clamps on car 200 are opened as previously explained with reference to FIGS. 11 and 13, so that the batch of envelopes may be moved out of the envelope opening apparatus 26 by the transfer device 24 to a next processing station. To this end, a paddle, identical to paddle 126 illustrated in FIG. 11, but on the opposite end of the envelope batch 28, is moved by the device 24 against the opposite end of the batch 28 to move the batch 28 into a guide channel (not illustrated) and out of station I. The batch of opened envelopes may be discharged by the transfer device 24, as to the apparatus 20 illustrated in FIG. 1, and a new batch of sealed envelopes may be transferred back from the apparatus 20 by the device 24 to the loading station I at the envelope opening apparatus 26.

Though not illustrated, fume collector hoods may be provided over the envelope edge heating stations. Preferably, a fume hood is located over the two heater stations IV and V and another fume hood is located over the two heater stations VIII and IX. A duct system is provided to both of the fume hoods for exhausting the fumes to conventional wet vacuum cleaners. The exhaust from the wet vacuum cleaners is directed to a chemical filter which may include a charcoal filter element or the like. The discharge from the chemical filter is then directed back to the four heating stations through a suitable duct system.

Both of the brush stations VI and X are connected, through the vacuum ducts 853 previously described, to a system for extracting particulate matter into a conventional wet vacuum system. The exhaust from the wet vacuum system is preferably passed through a chemical filter, such as a charcoal filter or the like. The exhaust from the charcoal filter is returned to the interior of the apparatus above the upper conveying path.

At one or more of the ten stations around the conveyor, it may be desirable to provide additional means for securing the envelope holding car 200 in place on the guide track in which it rides so as to prevent any undesirable movement at the particular station during the treatment of the envelope batch at that station. An example of such a mechanism is illustrated in FIG. 20.

Specifically, the base 201 of the car 200 is provided with a pair of opposed, projecting, plate-like members or lugs 1220. Also, in the region of the particular station, the track is modified by adding a pair of angles, such as angles 1222 and 1224 secured to track angle 211. The vertical leg of angles 1224 is seen to be aligned adjacent a lug 1220 on the car base 201. If desired, the lug 1220 may be provided with a bearing member 1221 for contacting the angle 1224.

On one side of the conveyor, a pneumatic cylinder operator 1230 is mounted through track angle 2111 as shown in FIG. 20. The pneumatic cylinder operator 1230 has a piston rod 1232 with an enlarged bearing head 1234 for bearing against the outside of one of the lugs 1220 on the car base 201. Actuation of the pneumatic cylinder 1230 to force the head 1234 against the car lug 1220 will securely clamp the lug 1220 between the head 1234 and the vertical leg of the angle 1224. The above-described clamping system may be effected by actuating the cylinder 1230 through a suitable control system whenever increased restraint of the batch holding car 200 is desired at one or more of the ten stations.

Figure 27:
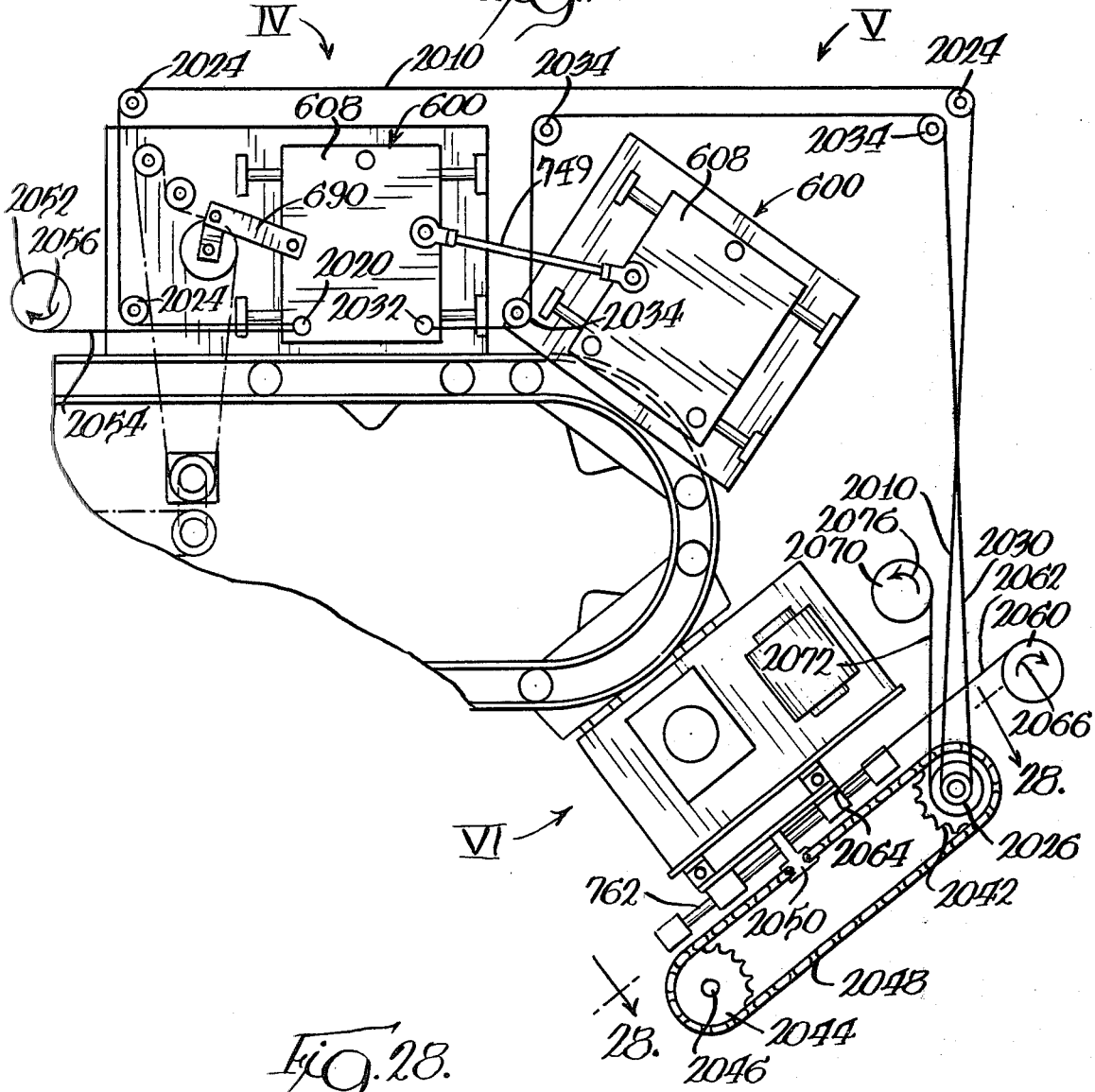
FIG. 27 is an enlarged, fragmentary, schematic illustration of the right-hand portion of the conveying loop illustrated in FIG. 11 but showing an alternate embodiment of the reciprocation mechanism for stations IV, V, and VI.
Figure 28:
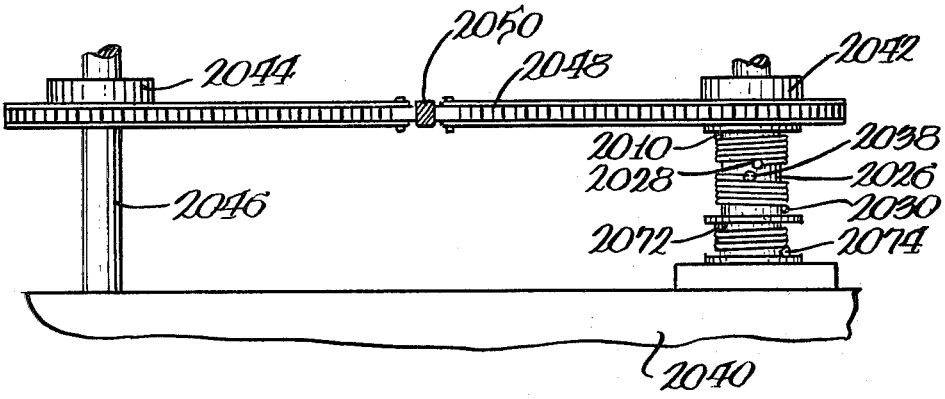
FIG. 28 is an enlarged, fragmentary, cross-sectional view taken generally along the plane 28—28 in FIG. 27.

FIGS. 27–30 illustrate an alternate embodiment for reciprocating the mechanism at stations IV, V, VI, VIII, IX and X in a manner that reduces the loading on the combination clutch and brake 712 (FIGS. 11 and 17). Specifically, FIGS. 27 and 28 schematically illustrate the alternate reciprocating mechanism for stations IV, V and VI that all reciprocate together. For ease of reference, only the right-hand portion of the conveyor, fully illustrated in FIG. 11, is shown in FIG. 27. Except insofar as will be pointed out hereinafter, the elements of the apparatus illustrated in FIG. 27 correspond to those illustrated in FIG. 11.

Dual main drive cables are employed in the alternate embodiment of the reciprocation system. First, a cable 2010 is secured to the movable plate 608 of heating station IV at 2020. The cable 2010 is trained around a plurality of fixed pulleys 2024 and wound on a capstan 2026 as clearly illustrated in FIG. 28. The terminal end of cable 2010 is fixed to the capstan at 2028.

A second cable 2030 is secured at one end to the movable plate 608 of heating station IV at 2032 and is trained around a plurality of fixed pulleys 2034. The second cable 2030 is also wound around the capstan 2026 as illustrated in FIG. 28 and secured thereto at 2038.

As best illustrated in FIG. 28, the capstan 2026 is mounted for rotation to a fixed frame member 2040. Mounted to the capstan 2026 for rotaion therewith is a sprocket 2042. Spaced from sprocket 2042, but aligned therewith, is a second sprocket 2044 which is rotatable about a shaft 2046 mounted to the frame member 2040. A chain loop 2048 is trained around the sprockets 2042 and 2044. The envelope end edge brush assembly at station VI is connected to the chain 2048 by means of link member 2050.

The heating platen assembly on base plate 608 at heating section IV is reciprocated to the left and to the right by link 690 in a manner described previously in great detail with reference to FIGS. 11, 16, and 17. When the assembly at station IV moves to the left, the cable 2030 will be pulled to the left as viewed in FIG. 27. This will rotate the capstan 2026 in the counterclockwise direction as viewed in FIG. 27. This will cause the chain 2048 to move in a counterclockwise direction to lower the end edge brush assembly at station VI. Of course, movement of the feeder platen assembly at station IV in the opposite direction, to the right as viewed in FIG. 27, will raise the end edge brush assembly at station VI.

To reduce the force required to reciprocate the system as described above, a counterbalance clockspring 2052 may be mounted to a suitable fixed frame member and connected with a wound on cable 2054 to point 2020 of the base plate 608 of the heater platen assembly at station IV. The counterbalance clockspring 2052 is arranged to provide a desired torque in the clockwise direction indicated by the arrow 2056.

Similarly, at the end edge brush station VI, a counterbalance clockspring 2060 may be mounted to a suitable fixed frame member and connected by means of a wound on cable 2062 to the brush assembly at 2064. The clockspring 2060 would be arranged to provide a desired torque in the clockwise direction as indicated by the arrow 2066. A third counterbalance clockspring 2070 may be mounted to a suitable frame member and connected via a cable 2072 to the capstan 2026 at 2074. If the clockspring 2070 is arranged to provide torque in the counterclockwise direction as indicated by the arrow 2076 in FIG. 27, that torque will be an added counterbalance force to the component of the weight of the brush assembly at station VI. It will thus act in concert with the counterbalance clocksprings 2052 and 2060.

The three counterbalance clocksprings 2052, 2060 and 2070 desirably provide a total combined torque to almost completely, or at least partially, counterbalance the weight component of the end edge brush assembly at station VI.

Figures 29, 30:
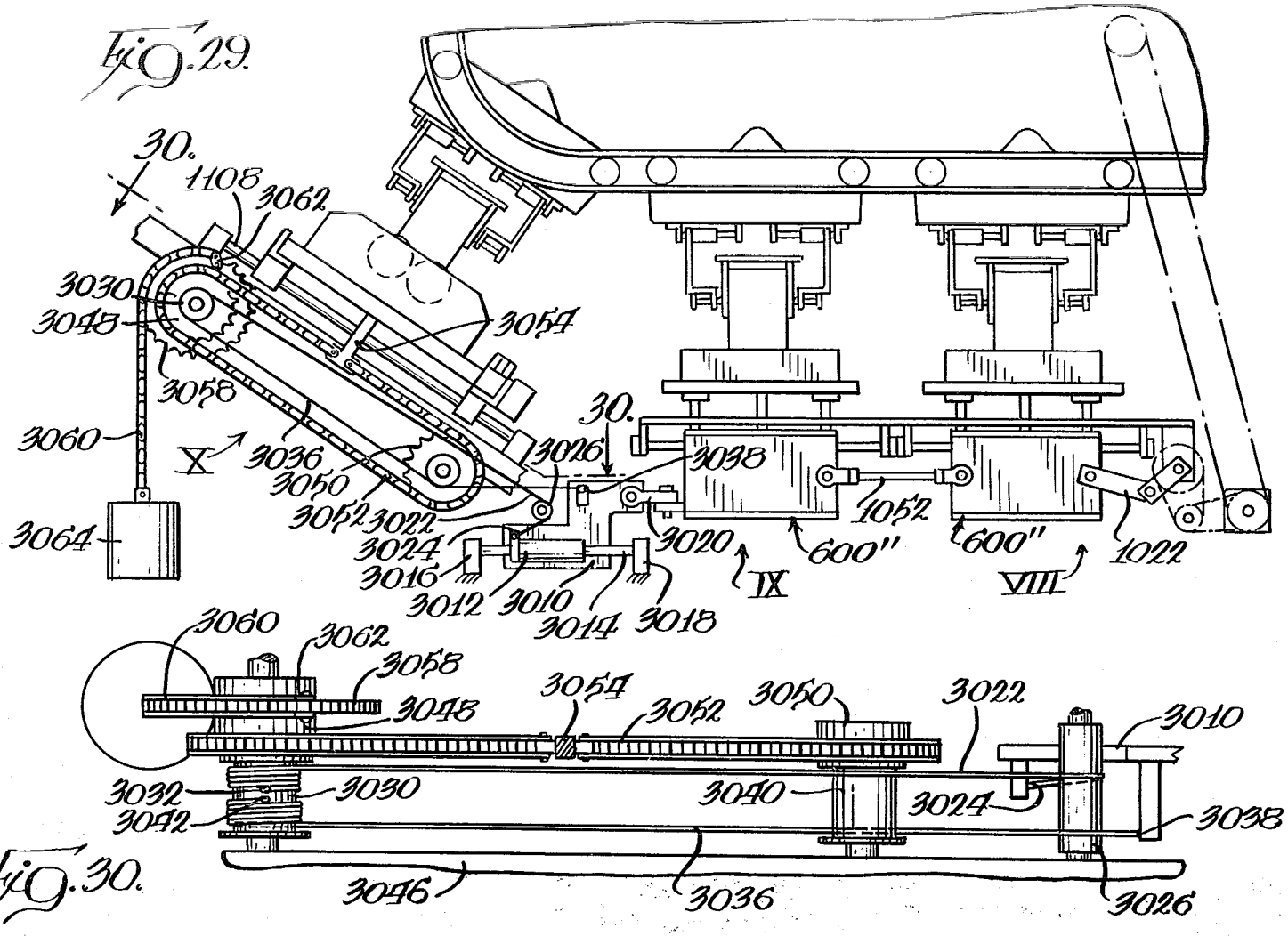
FIG. 29 is an enlarged, fragmentary schematic illustration of the left-hand portion of the conveying loop illustrated in FIG. 11 but showing an alternate embodiment of the reciprocation mechanism for stations VIII, IX, and X.
FIG. 30 is an enlarged, fragmentary, cross-sectional view taken generally along the plane 30—30 in FIG. 29.

The alternate method for reciprocating the stations VIII, IX, and X is illustrated in FIGS. 29 and 30. Again, except as hereinafter set forth, the elements of the mechanisms at the stations VIII, IX and X, are essentially identical to the corresponding stations in FIG. 11 and previously described in detail.

The inverted top edge envelope heating mechanism 600″ at station VIII is connected via link 1052 to the second heating mechanism 600″ at station IX. A traveling link plate 3010 is slidably disposed, by means of bearing 3012, on a rod 3014 fixed to the frame by posts 3016 and 3018. The sliding link 3010 is connected to the mechanism 600″ at heating station IX by means of link 3020.

A cable 3022 is secured to the sliding link plate 3010 at 3024 and is trained around a frame mounted pulley 3026. The other end of the cable 3022 is wound around a capstan 3030 and secured to the capstan at 3032.

Another cable 3036 is secured to the slidable link plate 3010 at 3038, is guided partially around shaft 3040, is wound on capstan 3030, and is secured at its other end to the capstan 3036 at 3042.

Both the capstan 3030 and the shaft 3040 are mounted to a fixed frame 3046. A sprocket 3048 is secured to the capstan 3030 and another sprocket 3050 is secured to the shaft 3040 in alignment with sprocket 3048. A chain loop 3052 is trained around the sprockets 3048 and 3050 and is connected to the envelope top edge brush assembly at station IX by means of link 3054.

Secured to the capstan 3030 and sprocket 3048 for rotation therewith is another sprocket 3058. A length of chain 3060 is fixed at one end 3062 to the sprocket 3058 and is secured at the other end to a counterbalance weight 3064.

The first envelope inverted top edge heater platen assembly 600″ at station VIII is driven by link 1022 in a manner previously described in detail with respect to the first embodiment illustrated in FIG. 11. Through this link 1022, the mechanism 600″ at station VIII is reciprocated to the left and to the right as viewed in FIG. 29. The reciprocation is transmitted through the connecting rod 1052 to the station IX and from there through the link 3020 to the link plate 3010 which reciprocates on the rod 3014.

When the system is moved to the right as viewed in FIG. 29, the cable 3036 is also pulled to the right and rotates the capstan 3030 in a counterclockwise direction. This moves the chain 3052 in a counterclockwise direction and raises the envelope top edge brush assembly at station X. Conversely, movement of the mechanisms 600″ in stations VIII and IX to the left will cause cable 3022 to pull the brush assembly at station X downwardy.

The counterbalance weight 3064 acts to counterbalance at least some, if not almost all, of the component of the weight of the brush assembly at station X that is acting downwardly parallel to the support rod 1108 on which the assembly is slidably disposed.

In this specification and in the claims, the envelopes are described as being arranged in a face-to-face relationship to form a batch of envelopes. The term "face-to-face" shall be defined to include the arrangement of envelopes with their major front and back surfaces aligned substantially parallel. The back surface of one envelope may confront the front surface of an adjacent envelope or the front surface of one envelope may confront a front surface of an adjacent envelope. Further, one envelope may be oriented right side up with respect to an adjacent envelope which may be oriented upside down. The word "face" in the term "face-to-face" is not intended to designate a particular surface of an envelope that bears an address or other printed matter. The "face" of an envelope may bear no address and may be blank or may bear an address.

The above detailed description has been given for ease of understanding only. No unnecessary limitations are to be understood therefrom, as modifications will be obvious to those skilled in the art.

What is claimed is:

1. a method of processing envelopes wherein each envelope has two planar panels that (1) define opposite faces of the envelope and (2) are connected together along a plurality of edges; said method being effective to separate said panels of each envelope along at least one of said edges; said method comprising the steps of:

(a) arranging a plurality of said envelopes in face-to-face relationship to form at least one batch of envelopes with an outer envelope at each end of the batch and with at least one edge of each envelope in the batch being disposed substantially in a common plane that is generally normal to the envelope faces;

(b) maintaining said batch of envelopes under compression by exerting a force against a portion of the surface of each of said two outer envelopes in the batch;

(c) before or after step (a), applying to at least said one edge of each of the envelopes an envelope material degrading agent that functions as a degrading agent more effectively when heated;

(d) effecting relative movement between said batch of envelopes and a heating surface towards each other to contact the edges of said envelopes in said batch to which said agent has been applied; and (e) with contact established by step (d), reciprocating the heating surface in opposite directions substantially parallel with said common plane of the contacted edges for promoting more effective transfer of heat to the contacted envelope edges and for facilitating escape of vapor from the contacted envelope edges.

2. The method in accordance with claim 1 in which steps (d) and (e) are effected so as to heat said contacted one edge of each of the envelopes in the batch to a temperature of between 250° F. and 650° F.

3. The method in accordance with claim 2 in which said steps (d) and (e) are effected to raise the temperature of said contacted one edge of each of the envelopes in the batch to a temperature of about 400° F.

4. The method in accordance with claim 3 in which steps (d) and (e) are effected for a total time of between about 5 seconds and about 120 seconds.

5. The method in accordance with claim 4 in which step (d) is effected after a time interval of between 5 and 30 seconds following application of said envelope material degrading agent and in which steps (d) and (e) are effected for a time period of about 24 seconds.

6. The method in accordance with claim 5 in which steps (d) and (e) are effected twice with two different heating surfaces seriatim by contacting the envelope edges to which said agent has been applied for a predetermined time period with one heating surface and by subsequently contacting the envelope edges to which said agent has been applied for another predetermined time period with another heating surface.

7. The method in accordance with claim 1 in which each said envelope has a top edge, a bottom edge, and a pair of spaced-apart oppositely facing end edges;

in which step (a) includes arranging said plurality of envelopes to form said batch with said top edge of each envelope disposed substantially in a common plane that is generally normal to the envelope faces and with said end edges of each envelope in the batch disposed substantially in two common planes that are generally normal to the envelope faces;

in which step (c) includes applying said degrading agent to both end edges of each of the envelopes in said batch and to said top edge of each of the envelopes in said batch;

and in which step (d) includes positioning said batch of envelopes between two opposed heating surfaces and moving both of said heating surfaces substantially simultaneously to contact said opposite end edges of said envelopes in said batch to bend the batch of envelopes inwardly beyond the point of initial contact with the contacted end edges of each envelope being bent out of the plane in which they are located prior to said contact.

8. The method in accordance with claim 7 in which step (c) further includes applying said degrading agent to said top edge of each of the envelopes in said batch and in which step (d) further includes moving a third heating surface to contact the top edges of each of the envelopes in said batch to bend the batch of envelopes inwardly beyond the point of initial contact with the contacted top edge of each envelope being bent out of the plane in which it was located prior to said contact.

9. The method in accordance with claim 8 in which the step of contacting the top edges of the envelopes in the batch with a third heating surface is effected after the step of contacting the end edges of the envelopes in the batch with said two opposed heating surfaces.

10. The method in accordance with claim 1 in which step (c) is effected after step (b) and includes spraying said envelope material degrading agent in liquid form on said envelopes.

11. A method of processing envelopes wherein each envelope has two generally rectangular planar panels that (1) define opposite faces of the envelope and (2) are connected together along a top edge, a bottom edge, and two oppositely facing end edges; said method being effective to separate said panels of each envelope along at least said end edges and said top edge; said method comprising the steps of:

(a) arranging a plurality of envelopes in face-to-face relationship to form at least one batch of envelopes with an outer envelope at each end of the batch, with one end edge of each envelope in the batch disposed substantially in a first common plane that is generally normal to the envelope faces, with the second end edge of each envelope in the batch disposed substantially in a second common plane that is generally normal to the envelope faces, and with said top edge of each envelope in the batch disposed substantially in a third common plane that is generally normal to the envelope faces;

(b) maintaining said batch of envelopes under compression by exerting a force against a portion of the surface of each of the two outer envelopes in the batch;

(c) applying to said two end edges and to said top edge of each of the envelopes in said batch an envelope material degrading agent that functions as a degrading agent more effectively when heated;

(d) moving a pair of end edge heating surfaces toward each other on either side of said batch in directions generally normal to said first and second end edge common planes to contact the end edges of the envelopes and to exert sufficient force on said envelopes with said end edge heating surfaces to bend the envelopes in the batch inwardly at each end edge more than 1/32 inch beyond the point of initial contact and to bend the contacted edge of each envelope out of the plane in which it was located prior to said contact;

(e) with contact established by (d), reciprocating the end edge heating surfaces in directions substantially parallel to said first and second common planes to intermittently reverse the orientation of the envelope end edge bends and effect transient increases of the spacing between the contacted end edges of the adjacent envelopes for promoting more effective transfer of heat to the contacted envelope end edges and for facilitating escape of vapor from the contacted envelope end edges;

(f) terminating steps (d) and (e);

(g) moving a top edge heating surface in a direction normal to said third common plane of the envelope top edges to contact the top edges of the envelopes and to exert sufficient force on said envelopes with said top edge heating surface to bend the envelopes inwardly at the top edge more than 1/32 inch beyond the point of initial contact and to bend the contacted top edge of each envelope out of the plane in which it was located prior to said contact; and (h) with contact established by step (g), reciprocating said top edge heating surface in opposite directions substantially parallel to said third common plane to intermittently reverse the orientation of the envelope top edge bends and effect transient increases of the spacing between the contacted top edges of adjacent envelopes for promoting more effective transfer of heat to the contacted envelope top edges and for facilitating escape of vapor from the contacted envelope top edges.

12. The method in accordance with claim 11 in which steps (d) and (g) are effected with separate heating surfaces that are each channeled to increase the escape of vapor from the contacted edges of the envelopes.

13. A method of processing envelopes wherein each envelope has two planar panels that (1) define opposite faces of the envelope and (2) are connected together along a plurality of edges; said method being effective to separate said panels of each envelope along at least one of said edges; said method comprising the steps of:

(a) arranging a plurality of envelopes in face-to-face relationship to form at least one batch of envelopes with an outer envelope at each end of the batch and with at least one edge of each envelope in the batch being disposed substantially in a common plane that is generally normal to the envelope faces;

(b) maintaining said batch of envelopes under compression by exerting a force against a portion of the surface of each of said two outer envelopes in the batch;

(c) before or after step (a), applying to at least said one edge of each of the envelopes an envelope material degrading agent that functions as a degrading agent more effectively when heated;

(d) effecting relative movement between said batch of envelopes and a heating surface towards each other to contact the edges of the envelopes in said batch to which said agent has been applied and to exert sufficient force on said envelopes with said heating surface to bend the batch of envelopes inwardly beyond the point of initial contact and to bend the contacted edge of each envelope out of the plane in which it was located prior to said contact for promoting more effective transfer of heat to the contacted envelope edges; and (e) reciprocating said heating surface parallel to said common plane with a stroke length of about 3 inches at a frequency of about ¼ Hertz for a total of 3 cycles.

14. An apparatus for processing envelopes wherein each envelope has two planar panels that (1) define opposite faces of the envelope and (2) are connected together along a plurality of edges; said apparatus being effective to separate said panels of each envelope along at least one of said edges to which a degrading agent has been applied that functions more effectively upon application of heat; said apparatus comprising:

(a) means for holding a plurality of envelopes in face-to-face relationship to form at least one batch of envelopes with an outer envelope at each end of the batch and with at least one edge of each envelope in the batch being disposed substantially in a common plane that is generally normal to the envelope faces;

(b) clamping means associated with said envelope batch holding means for exerting a force against a portion of the surface of each of the two outer envelopes in the batch to maintain the batch of envelopes under compression;

(c) heating means for contacting and heating the envelope edges to which said agent has been applied;

(d) means for effecting relative movement between said envelope batch holding means and said heating means towards each other to contact the envelope edges to which said agent has been applied; and (e) means for effecting relative reciprocating movement between said batch of envelopes and said heating means in directions substantially parallel with said common plane of the contacted envelope edges for promoting more effective transfer of heat to the contacted envelope edges and for facilitating escape of vapor from the contacted envelope edges.

15. The apparatus in accordance with claim 14 in which said means for effecting relative reciprocating movement between said envelope batch holding means and said heating means includes a fixed support rod, means slidably mounting said heating means on said rod, and means for reciprocating said heating means relative to said rod.

16. The apparatus in accordance with claim 14 in which said heating means includes the following:

a heating member defining said heating surface for contacting the edges of the envelopes in the batch, a first base plate mounted on said heating member, a second base plate generally parallel to said first base plate and mounted to said first base plate in spaced-apart relation with means for resiliently biasing said first and second base plates apart, limiting means for limiting the maximum relative spacing between said first and second base plates, a plurality of reciprocating guide rods aligned in parallel and mounted to said second base plate, an actuator support plate slidably disposed on said reciprocating guide rods and a single acting, spring-return pneumatic cylinder actuator mounted to said actuator support plate, said cylinder actuator having a piston rod secured to said second base plate; and in which said apparatus further includes support means for (1) slidably supporting said actuator support plate for reciprocating movement in a plane generally normal to the line of action of said actuator piston and (2) restraining said actuator support plate from movement in either opposed direction along the line of action of said actuator piston whereby operation of said actuator effects movement of said first and second base plates and said heating member between a retracted position in which said heating surface is spaced away from the edges of the envelopes in said batch and an extended position in which said heating surface is in contact with the edges of said envelopes in said batch.

17. A method of processing envelopes wherein each envelope has two planar panels that (1) define opposite faces of the envelope and (2) are connected together along a plurality of edges; said method being effective to separate said panels of each envelope along at least one of said edges; said method comprising the steps of:

(a) arranging a plurality of said envelopes in face-to-face relationship;

(b) aligning the envelopes with at least one edge of each envelope being disposed substantially in a common plane but is generally normal to the envelope faces;

(c) maintaining the envelopes under compression along a line of action generally normal to the envelope faces;

(d) before or after step (a), applying to at least said one edge of each of the envelopes an envelope material degrading agent that functions as a degrading agent more effectively when heated;

(e) effecting relative movement between the envelopes and a heating surface toward each other to contact the edges of said envelopes to which said agent has been applied; and (f) with contact established by step (e), reciprocating the heating surface in opposite directions substantially parallel with said common plane of the contacted edges for promoting more effective transfer of heat to the contacted envelope edges and for facilitating escape of vapor from the contacted envelope edges.

18. The method in accordance with claim 1 further including the steps, after step (e), of (1) moving said batch of envelopes away from said heating surface and, of (2) brushing away particulate envelope material from the contacted envelope edges, and of (3) simultaneously effecting removal of said particulate material with a vacuum induced air flow.

* * * * *

UNITED STATES PATENT OFFICE
CERTIFICATE OF CORRECTION

PATENT NO. : 4,356,684

DATED : November 2, 1982

INVENTOR(S) : Ellis et al.

It is certified that error appears in the above-identified patent and that said Letters Patent are hereby corrected as shown below:

Column 6, line 33, --end-- should be inserted after "one".

Column 7, line 58, "aadditionally" should be --additionally--.

Column 10, line 51, "comprised" should be --completed--.

Column 20, line 47, delete "angles 425 and 427".

Column 25, line 66, "566" should be --556--.

Column 28, line 8, "id" should be --is--.

Column 28, line 30, "744" should be --774--.

Column 30, line 28, "suppression" should be --compression--.

Column 30, line 64, "second" should be --shroud--.

Column 38, line 44, "1196" should be --1195--.

Column 43, line 48, "are" should be --were--.

Column 46, line 18, "on" should be --to--.

Signed and Sealed this

*Twenty-sixth* Day of *April 1983*

[SEAL]

*Attest:*

GERALD J. MOSSINGHOFF

*Attesting Officer*

*Commissioner of Patents and Trademarks*